US009638483B1

(12) United States Patent
Hoffman et al.

(10) Patent No.: US 9,638,483 B1
(45) Date of Patent: May 2, 2017

(54) AMMUNITION MAGAZINE FOR RECIPROCALLY-CYCLED WEAPON

(71) Applicants: Brian Hoffman, Bangor, PA (US); Alexander Smith, Long Valley, NJ (US); Hansen Lukman, Rockaway, NJ (US)

(72) Inventors: Brian Hoffman, Bangor, PA (US); Alexander Smith, Long Valley, NJ (US); Hansen Lukman, Rockaway, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 129 days.

(21) Appl. No.: 14/659,739

(22) Filed: Mar. 17, 2015

Related U.S. Application Data

(60) Provisional application No. 62/026,180, filed on Jul. 18, 2014.

(51) Int. Cl.

| | |
|---|---|
| ***F41A 9/00*** | (2006.01) |
| ***F41A 9/61*** | (2006.01) |
| ***F41A 9/79*** | (2006.01) |
| ***F41A 7/08*** | (2006.01) |
| ***F41A 9/30*** | (2006.01) |

(52) U.S. Cl.
CPC *F41A 9/79* (2013.01); *F41A 7/08* (2013.01); *F41A 9/30* (2013.01)

(58) Field of Classification Search
CPC ..... F41A 9/79; F41A 7/08; F41A 9/30
USPC ..... 89/33.06, 33.16, 33.25
See application file for complete search history.

(56) References Cited

U.S. PATENT DOCUMENTS 2,180,741 A * 11/1939 Lisov ..... F41A 9/64 42/50
2,494,728 A * 1/1950 Stacey ..... F41A 9/25 89/33.16
2,870,675 A * 1/1959 Salisbury ..... F41B 6/00 124/3
4,343,223 A * 8/1982 Hawke ..... H05H 1/54 124/3
4,677,895 A * 7/1987 Carlson ..... F41B 6/006 124/3
4,733,595 A * 3/1988 Oberly ..... F41B 6/006 124/3
4,813,332 A * 3/1989 Jasper, Jr. ..... F41B 6/006 138/103
4,858,512 A * 8/1989 Jasper, Jr. ..... F41B 6/006 124/3
5,237,904 A * 8/1993 Kuhlmann-Wilsdorf F41B 6/006 102/517
5,419,234 A * 5/1995 Sanderson ..... B64D 7/00 89/33.16

(Continued)

*Primary Examiner* — Samir Abdosh
(74) *Attorney, Agent, or Firm* — John P. DiScala

(57) ABSTRACT

An ammunition magazine is used with a reciprocally-cycled weapon for delinking and firing cartridges in close-end linked ammunition belts. The magazine includes a housing with an ammunition indexing mechanism fixed to one side of the housing. A magazine feed box is disposed above the ammunition indexing mechanism. The magazine feed box includes a movable follower having an upper and a lower position and cam pins that engage cam slots in the magazine feed box. The movable follower is configured to receive a cartridge from the weapon.

11 Claims, 61 Drawing Sheets

(56) References Cited

U.S. PATENT DOCUMENTS

| | | | | |
|---|---|---|---|---|
| 6,176,169 | B1 * | 1/2001 | Rostocil | B64D 7/00 42/25 |
| 6,263,776 | B1 * | 7/2001 | Rostocil | B64D 7/00 89/11 |
| 6,696,775 | B2 * | 2/2004 | Engel | H02K 41/0352 124/3 |
| 6,725,759 | B1 * | 4/2004 | Kathe | F41B 6/00 124/3 |
| 8,302,584 | B1 * | 11/2012 | Lu | F41B 6/003 124/3 |
| 2004/0255767 | A1 * | 12/2004 | Frasca | F41B 6/00 89/8 |
| 2005/0155487 | A1 * | 7/2005 | Frasca | F41B 6/00 89/8 |
| 2007/0277668 | A1 * | 12/2007 | Frasca | F41B 6/00 89/8 |
| 2010/0194212 | A1 * | 8/2010 | Proulx | F41B 6/006 310/12.07 |

* cited by examiner

AMMUNITION MAGAZINE FOR RECIPROCALLY-CYCLED WEAPON

CROSS-REFERENCE TO RELATED APPLICATIONS

The present application claims the benefit of priority of U.S. provisional patent application Ser. No. 62/026,180 filed on Jul. 18, 2014, which is incorporated by reference herein.

STATEMENT OF GOVERNMENT INTEREST

The inventions described herein may be manufactured, used and licensed by or for the United States Government.

BACKGROUND OF THE INVENTION

The invention relates to weapons and in particular to reciprocally-cycled, small and medium caliber weapons.

A reciprocally cycled, externally actuated weapon is disclosed in U.S. Pat. No. 8,297,167 issued on Oct. 30, 2012 to Brian Hoffman and having the same assignee as the present patent application. The contents of U.S. Pat. No. 8,297,167 are incorporated by reference herein.

The weapon disclosed in the '167 patent is suitable, for example, for firing belted ammunition that uses open-end links. Examples of open-end linked ammunition are shown in FIGS. 12C and 12D. Because much belted ammunition uses closed-end links, a need exists for a weapon similar to the weapon of the '167 patent, but with the ability to fire belted ammunition that uses open-end links or closed-end links, such as the closed-end linked ammunition shown in FIGS. 12E and 12F.

In addition, it is desirable for a weapon to have "first round select" capability. "First round select" is the ability of the weapon to fire, on the very first cycle following a magazine change, the same ammunition type that was just loaded in a magazine, even if the ammunition type presented to the weapon in the previous magazine was of a different type. Another desirable feature is "first cycle fire." "First cycle fire" is the weapon's ability to fire a cartridge on the very first operating cycle following a magazine upload. Many small and medium caliber weapons require one or more charging cycles when initially presented with a belted ammunition supply, before the first shot may be fired.

It is advantageous for externally-powered small and medium caliber weapons that rely on an external power supply to consume as little power as possible. And, it is desirable for a weapon to have small downrange projectile dispersion (for example, tighter shot groups).

A need exists for a weapon system that possesses one or more of the advantageous features described above.

SUMMARY OF INVENTION

One aspect of the invention is an ammunition magazine for use with a reciprocally-cycled weapon for delinking and firing cartridges in close-end linked ammunition belts. The magazine includes a housing with an ammunition indexing mechanism fixed to one side of the housing. The housing is configured to store the close-end linked ammunition belts and the ammunition indexing mechanism is configured to feed the close-end linked ammunition belts. A magazine feed box is disposed above the ammunition indexing mechanism. The magazine feed box includes a movable follower having an upper and a lower position and cam pins that engage cam slots in the magazine feed box. The movable follower is configured to receive a cartridge from the weapon.

The ammunition indexing mechanism may be a rotating sprocket that rotates about an axis and engages the close-end linked ammunition belts. The rotating sprocket may be driven by the weapon.

The movable follower may be biased to the lower position by a spring-loaded follower return. The follower may include a spring-loaded sub-follower that imparts to a cartridge therein motion that is transverse to the axis of the sprocket. The movable follower may have two degrees of freedom with respect to the magazine feed box.

The magazine feed box may include a follower release sear that holds the follower in the upper position. The follower release sear may hold the follower in the upper position by engaging a follower sear surface. The magazine feed box may include a sear window.

Another aspect of the invention is method that includes providing a novel magazine, placing the magazine adjacent to a weapon and supplying cartridges from the magazine to the weapon in a first round select mode. The method may include supplying cartridges from the magazine to the weapon in a first cycle fire mode.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 12B is cut away to depict several magazine components related to the feeding of ammunition and how those components are oriented with respect to the weapon of FIG. 12.

FIGS. 12C and 12D show an open-linked belt design and are top and bottom isometric views, respectively, of several rounds linked together. FIGS. 12E and 12F show a closed-link belt design and are top and bottom isometric views, respectively, of several rounds linked together.

FIG. 17A is a partial top section taken along line A-A of FIG. 17B. FIG. 17B is a front view of the extractor body assembly of FIG. 18. FIG. 17C is an auxiliary partial section taken along the line C-C of FIG. 17B. FIG. 17D is a partial side section taken along the lines D1-D1 and D2-D2 in FIG. 17B.

FIG. 19A is a partial sectioned top view taken along line A-A of FIG. 19B. FIG. 19B is a front end view of FIG. 19D. FIG. 19C is an auxiliary partial section taken along the line C-C of FIG. 19B. FIG. 19D is a side view of FIG. 19B.

FIG. 20A is a partial top section taken along line A-A of FIG. 20B. FIG. 20B is a front end view. FIG. 20C is a side view.

FIGS. 21 and 22 are partially sectioned along line D2-D2 of FIG. 17B and FIG. 22 is partially cut away to show the extraction positioned cartridge.

FIG. 26A is a rear end view. FIG. 26B is an auxiliary partial section taken along the line B-B of FIG. 26A. FIG. 26C is a partial top section view taken along the line C-C of FIG. 26D. FIG. 26D is a partial side section taken along line D-D of FIG. 26A.

FIG. 28A is a rear end view. FIG. 28B is an auxiliary partial section along the line B-B of FIG. 28A. FIG. 28C is a partial side section along line C-C of FIG. 28A. FIG. 28D is a partial top section view along the line D-D of FIG. 28C.

FIG. 35A is a sectional view along line A-A of FIG. 35B. FIG. 35B is partially sectioned along line B-B of FIG. 35A.

FIG. 38A is partially sectioned along lines A1-A1 and A2-A2 of FIG. 38B. FIG. 38B is partially sectioned along line B-B of FIG. 38A.

DETAILED DESCRIPTION

FIGS. 1-11 and the corresponding text describe the weapon disclosed in U.S. Pat. No. 8,297,167. The novel weapon disclosed in FIGS. 12-44 has some similarities in construction and operation to the weapon disclosed in U.S. Pat. No. 8,297,167.

Figure 1:
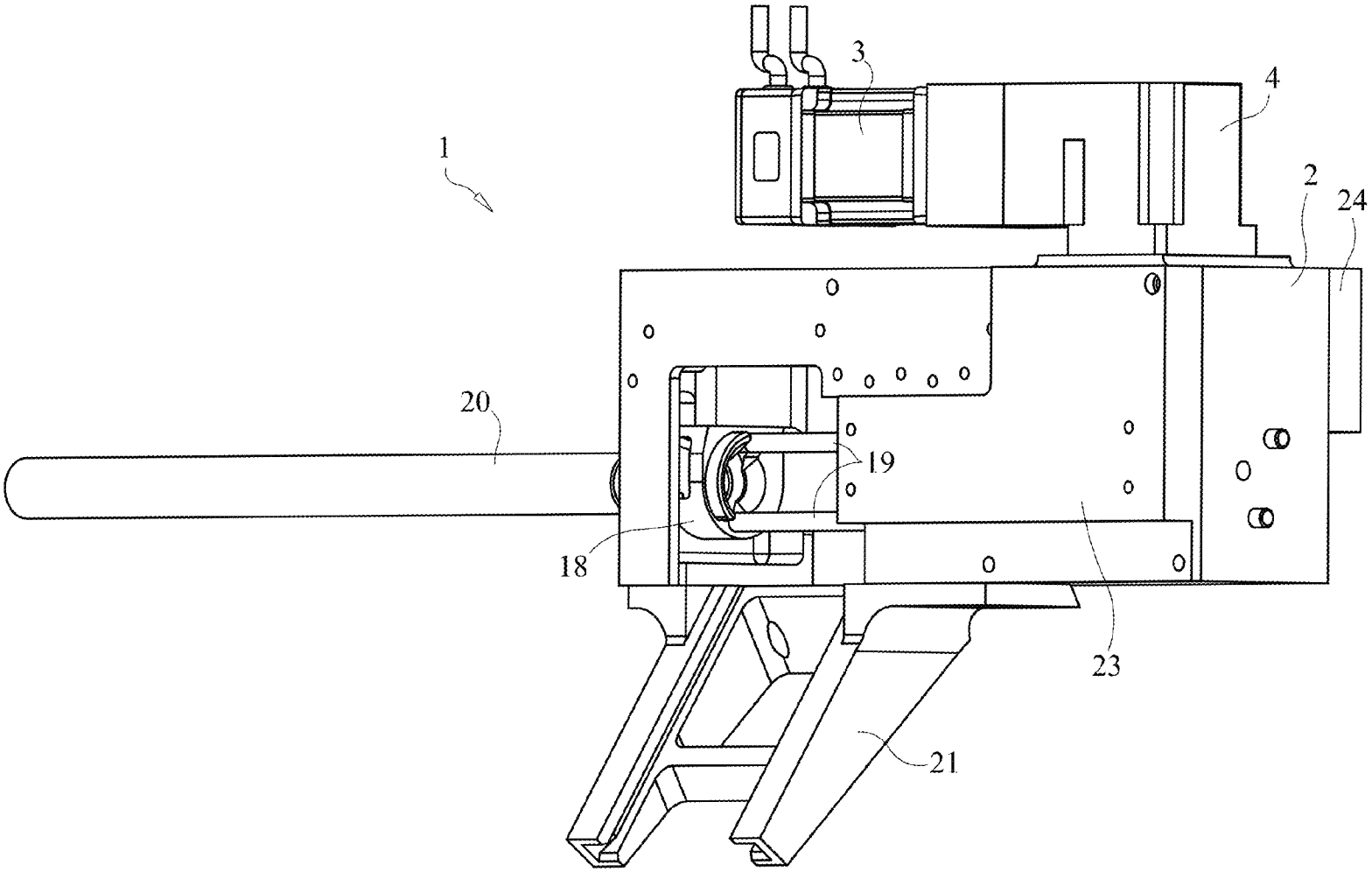
FIG. 1 PRIOR ART
FIG. 1 is a perspective side view of one embodiment of a reciprocally-cycled, externally-operated weapon.

FIG. 1 is a perspective side view of one embodiment of a reciprocally-cycled, externally-operated weapon 1. Weapon 1 may be externally powered by a rotative driver, such as a motor 3. A gear box 4 may be included, if needed, as a separate component or as an integral part of motor 3. Motor 3 may be selected from many types of motors, including, for example, electric, pneumatic, internal combustion, and others. It is important that the source of power for motor 3 is external to weapon 1. External to weapon 1 means that the motor 3 does not depend on the operation of weapon 1 for its power. For example, motor 3 does not depend on products of combustion or recoil that may be produced by weapon 1.

As shown in FIG. 1, weapon 1 may include a barrel extension 18, a barrel 20, a receiver 2, a right side cover 24, a left side cover 23 and a pair of tubes 19 mounted in receiver 2. A track 21 may be provided to assist in feeding ammunition to weapon 1. Weapon 1 may include several subassemblies. The subassemblies may include a drivetrain subassembly, an operating group subassembly, and a barrel subassembly. The operating group subassembly may include a bolt subassembly and a firing pin subassembly.

Figure 5A:
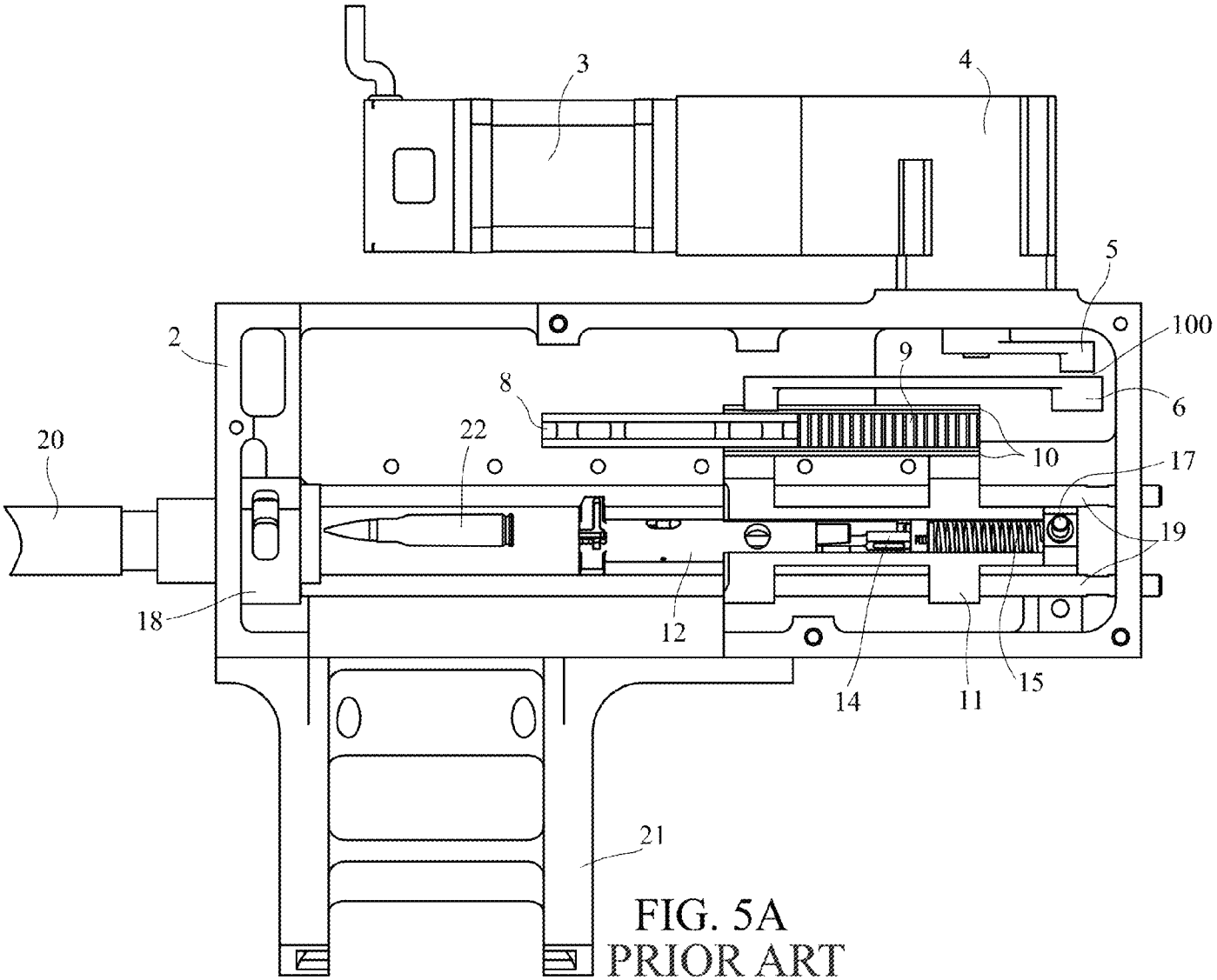
FIG. 5A PRIOR ART
FIG. 5A is a partial side view, partially cut-away.
Figure 5B:
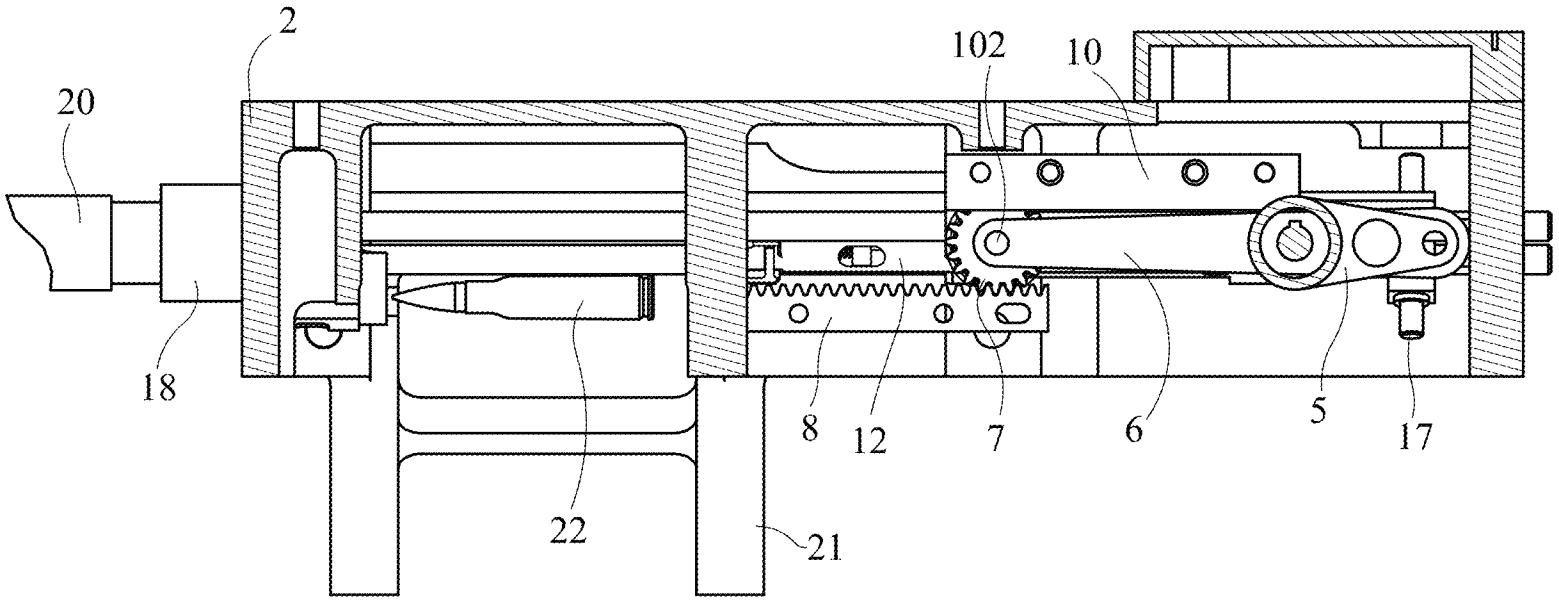
FIG. 5B PRIOR ART
FIG. 5B is a partial top view, in section, showing a first position of the weapon of FIG. 1.

The drivetrain subassembly may provide the energy necessary to cycle the operating group subassembly and complete other operations that may include cartridge stripping, cartridge feeding, cartridge chambering, bolt locking, cartridge firing, bolt unlocking, cartridge case extraction, cartridge case ejection, and, in some embodiments, cartridge indexing. The drivetrain subassembly may be seen, for example, in FIGS. 5A and 5B. FIG. 5A is a partial side view, partially cut-away, and FIG. 5B is a partial top view, in section, showing a first position of the weapon 1 of FIG. 1. The drivetrain subassembly may include a motor 3, a gear box 4, a crank 5, a connecting rod 6, a pinion 7, and a stationary rack 8.

Figure 2A:
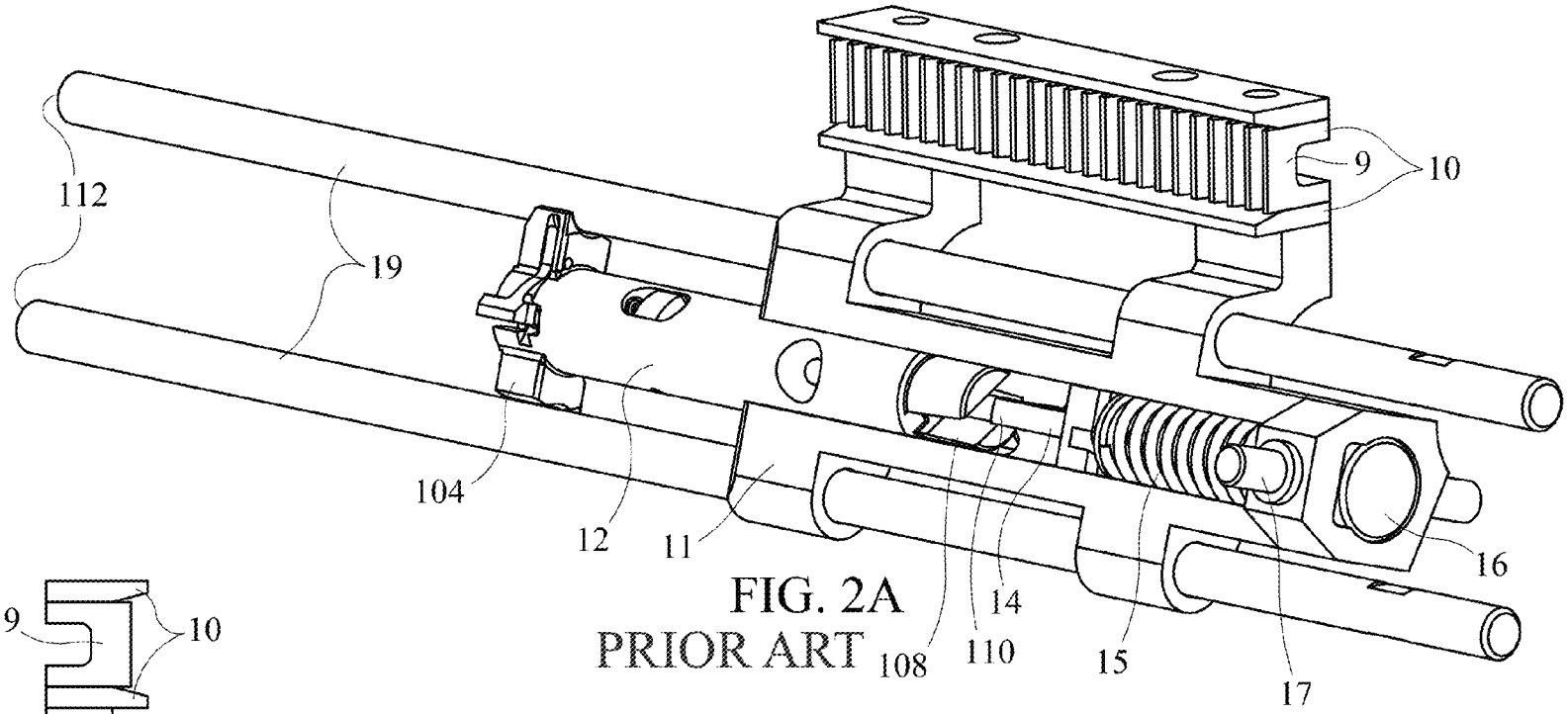
FIG. 2A PRIOR ART
FIGS. 2A, B, C, and D are perspective, front, right side, and left side views, respectively, of an operating group subassembly.
Figure 2B:
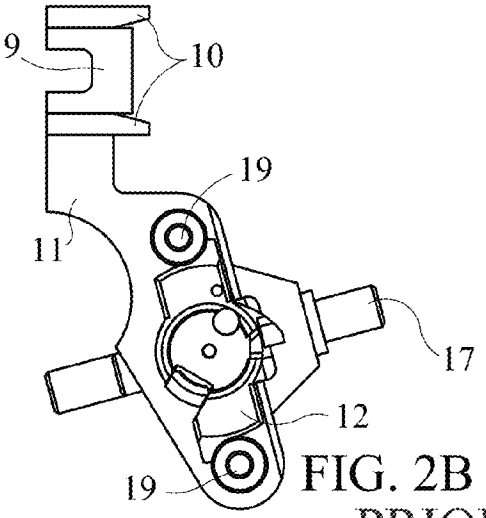
FIG. 2B PRIOR ART
Figure 2C:
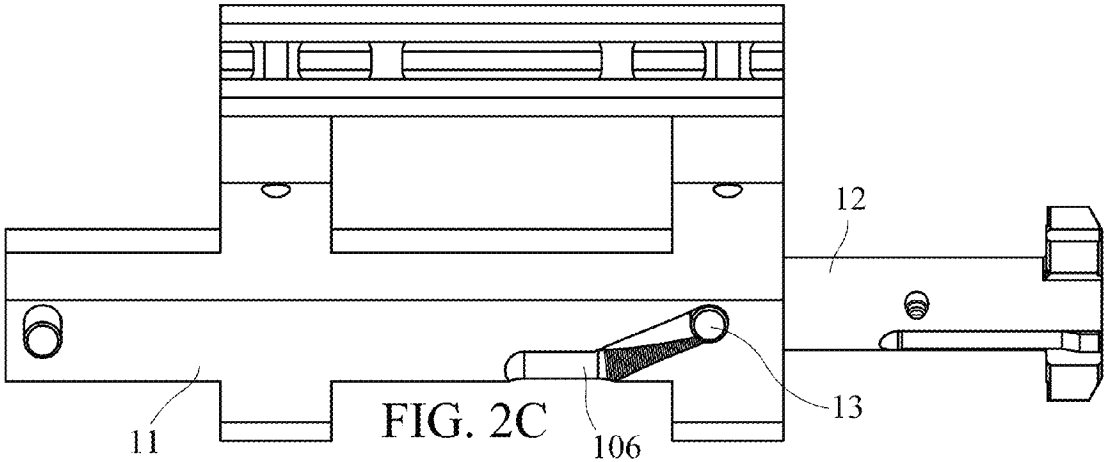
FIG. 2C PRIOR ART
Figure 2D:
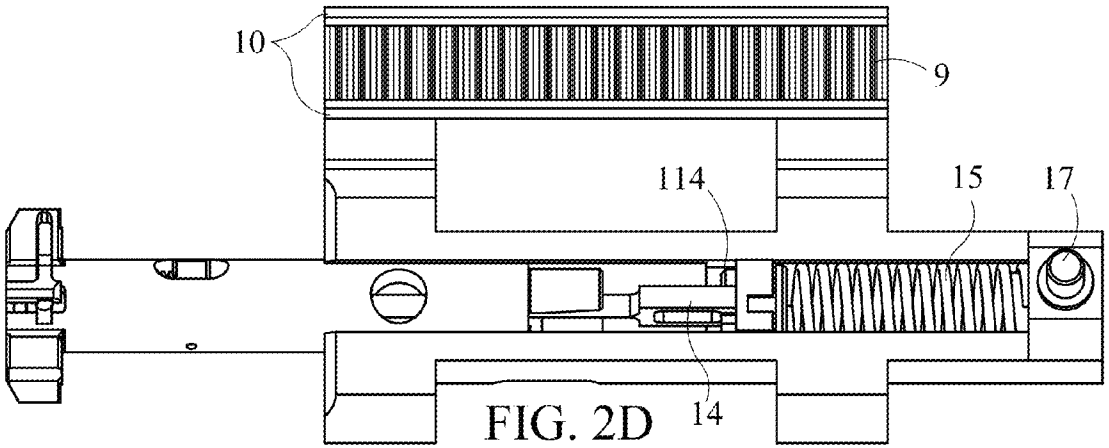
FIG. 2D PRIOR ART

The operating group subassembly may be defined as the internal (within the receiver 2) components (excluding the drivetrain subassembly) that reciprocate throughout the operating cycle of the weapon 1. FIGS. 2A, B, C, and D are perspective, front, right side, and left side views, respectively, of an operating group subassembly. The operating group subassembly may include a bolt carrier 11, pinion guides 10, a translating rack 9, a firing pin subassembly 14, a firing pin drivespring 15, a retaining plug 16, a power take off (PTO) cam pin 17, and a bolt subassembly 12. The bolt carrier 11 may reciprocate in a sliding manner on a bolt carrier support, such as, for example, the tubes 19.

Figure 3A:
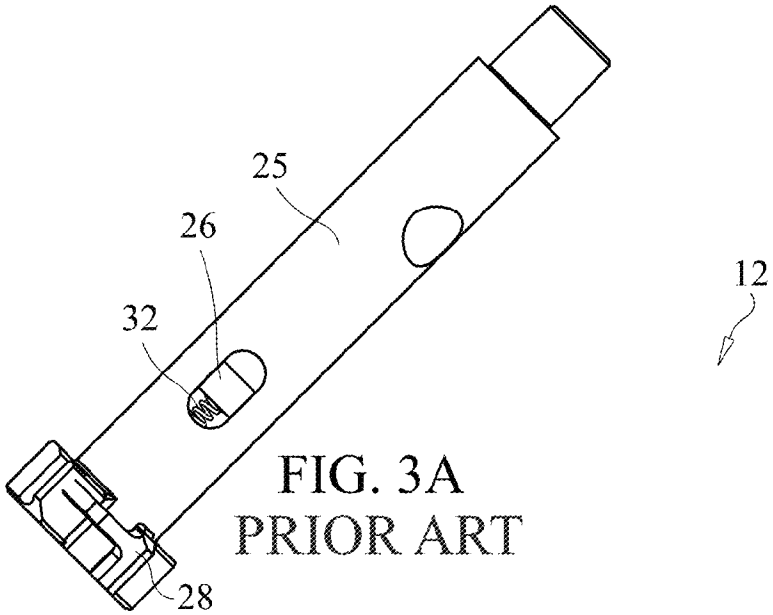
FIG. 3A PRIOR ART
FIGS. 3A and 3B are auxiliary side and front views, respectively, of a bolt subassembly.
Figure 3B:
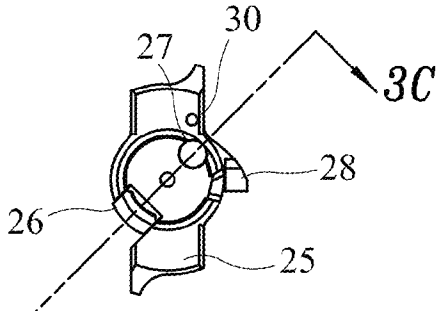
FIG. 3B PRIOR ART
Figure 3C:
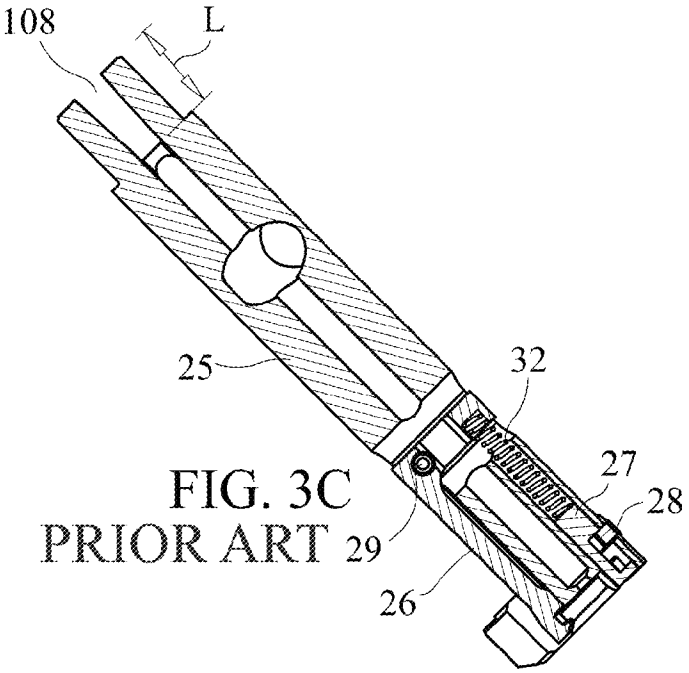
FIG. 3C PRIOR ART
FIG. 3C is a sectional view along the line 3C-3C of FIG. 3B.

FIGS. 3A and 3B are auxiliary side and front views, respectively, of a bolt subassembly 12, and FIG. 3C is a sectional view of the bolt subassembly 12 taken along the line 3C-3C of FIG. 3B. The bolt subassembly 12 may include a bolt 25, an extractor 26, an extractor pin 29, an extractor/ejector spring 32, a depressible radial rammer 28, a rammer pin 30, a rammer spring, and an ejector 27.

Figure 4:
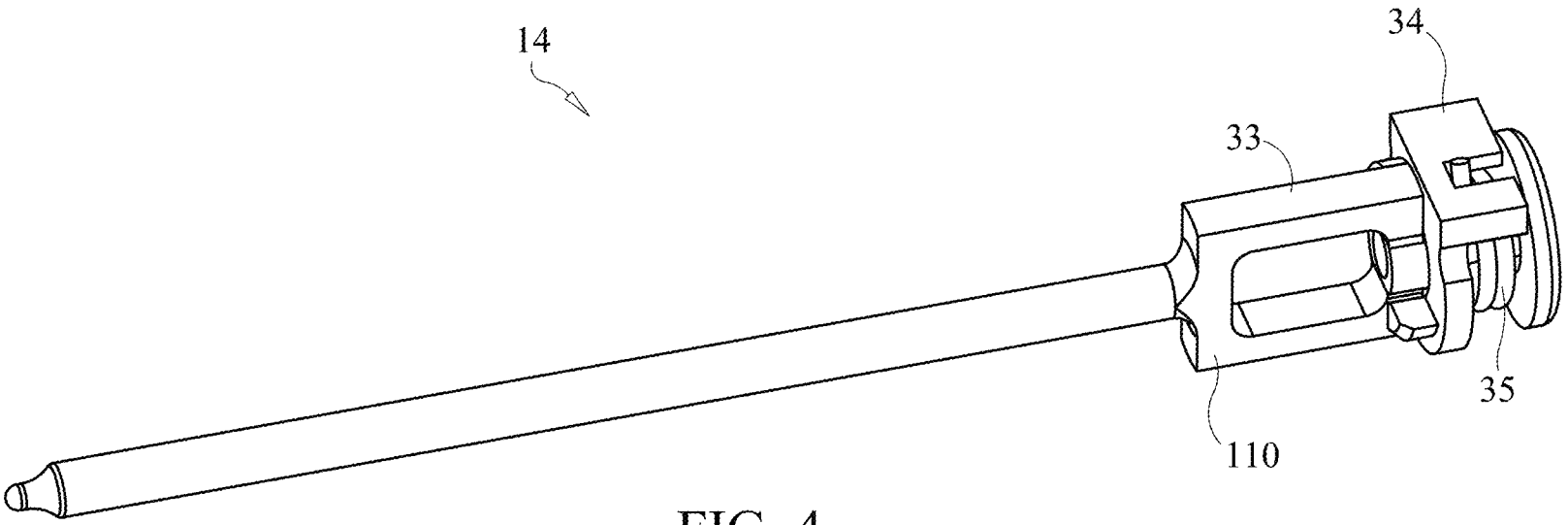
FIG. 4 PRIOR ART
FIG. 4 is a perspective view of a firing pin subassembly 14.

FIG. 4 is a perspective view of a firing pin subassembly 14. The firing pin subassembly may include a firing pin 33, a firing pin base 34, and a torsion spring 35.

The barrel subassembly may include a barrel extension 18 and a barrel 20, as shown, for example, in FIG. 1.

The functional cycle of the weapon 1 may be understood by a description of the components of the weapon 1 as the weapon 1 moves through its functional cycle. FIGS. 5-11 show, respectively, seven functional positions of weapon 1. In each of FIGS. 5-11, the "A" figure shows a partial side view, partially cut-away, of the weapon 1, and the "B" figure shows a partial top view, in section, of the weapon 1.

FIG. 5A is a partial side view, partially cut-away, and FIG. 5B is a partial top view, in section, showing a first position of the weapon 1 of FIG. 1. The functional cycle may begin when the motor 3 transmits torque to the crank 5 via the output shaft of the gear box 4. The crank 5 and the output shaft of the gear box 4 may be rigidly coupled using, for example, a key and keyway, interference fit, friction collar, set screw, or other means. The crank 5 may be pinned to the connecting rod 6 at location 100 (FIG. 5A) using, for example, a shoulder screw, pin, or other means. The opposite end of the connecting rod 6 may be coupled to the pinion 7 at location 102 (FIG. 5B) using, for example, a shoulder screw, pin, or other means. The pinion 7 may engage both the stationary rack 8 and the translating rack 9. The translating rack 9 may be rigidly coupled to the bolt carrier 11 to thereby move with the bolt carrier 11.

The output motion of the bolt carrier 11 resulting from the rotation of the crank 5 is a combination of the kinematics of the crank 5 and the connecting rod 6, along with the stroke multiplying effect caused by the interaction of the translating rack 9, the pinion 7, and the stationary rack 8. The geared engagement between the teeth of the rotating pinion 7, the stationary rack 8, and the translating rack 9 may allow for a desirable two-to-one multiplying effect, compared to the stroke length associated with using only a connecting rod and crank linkage arrangement. The pinion guides 10 may constrain the vertical movement of the pinion 7 as the pinion 7 rotates and translates throughout the cycle.

Figure 6A:
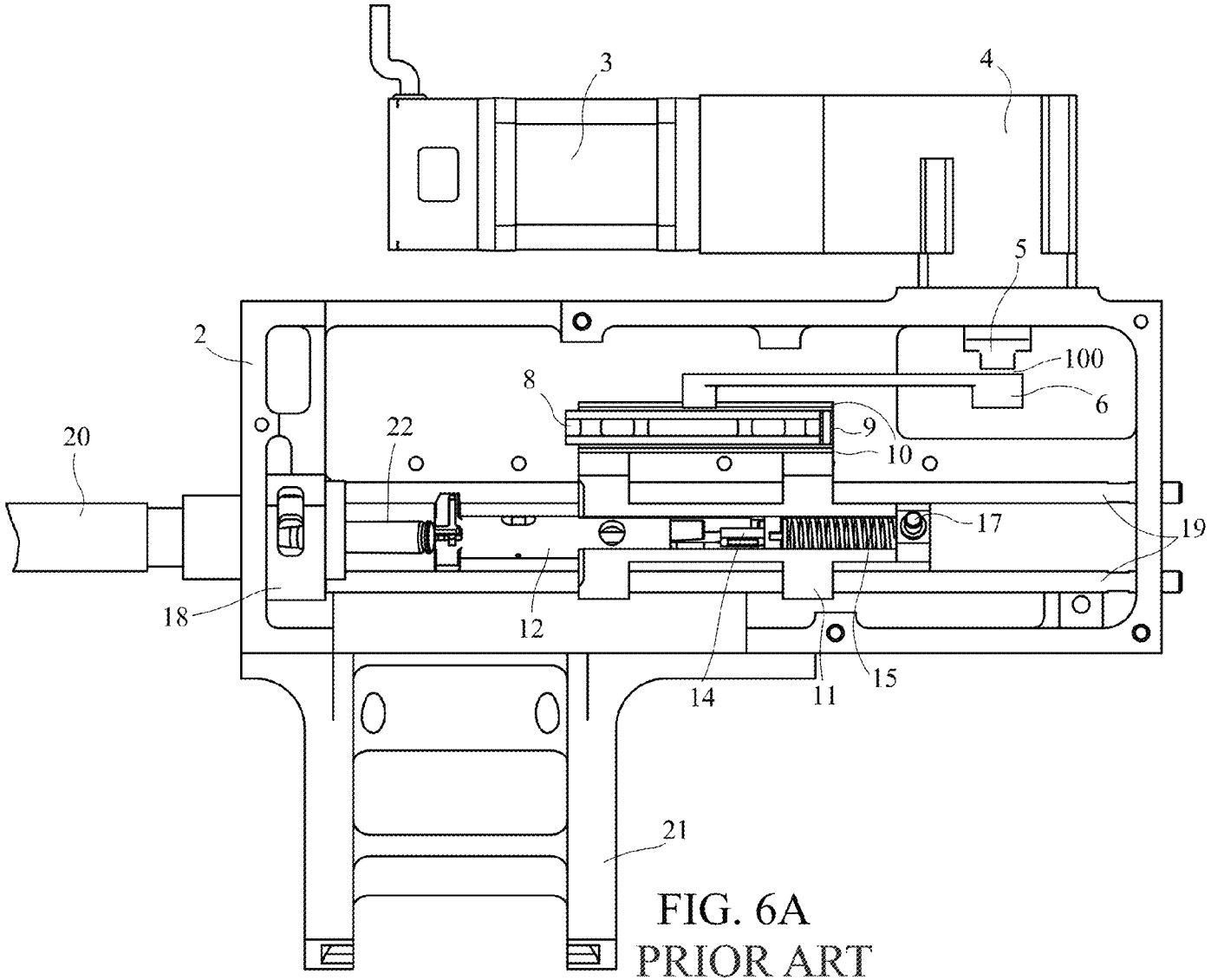
FIG. 6A PRIOR ART
FIG. 6A is a partial side view, partially cut-away.
Figure 6B:
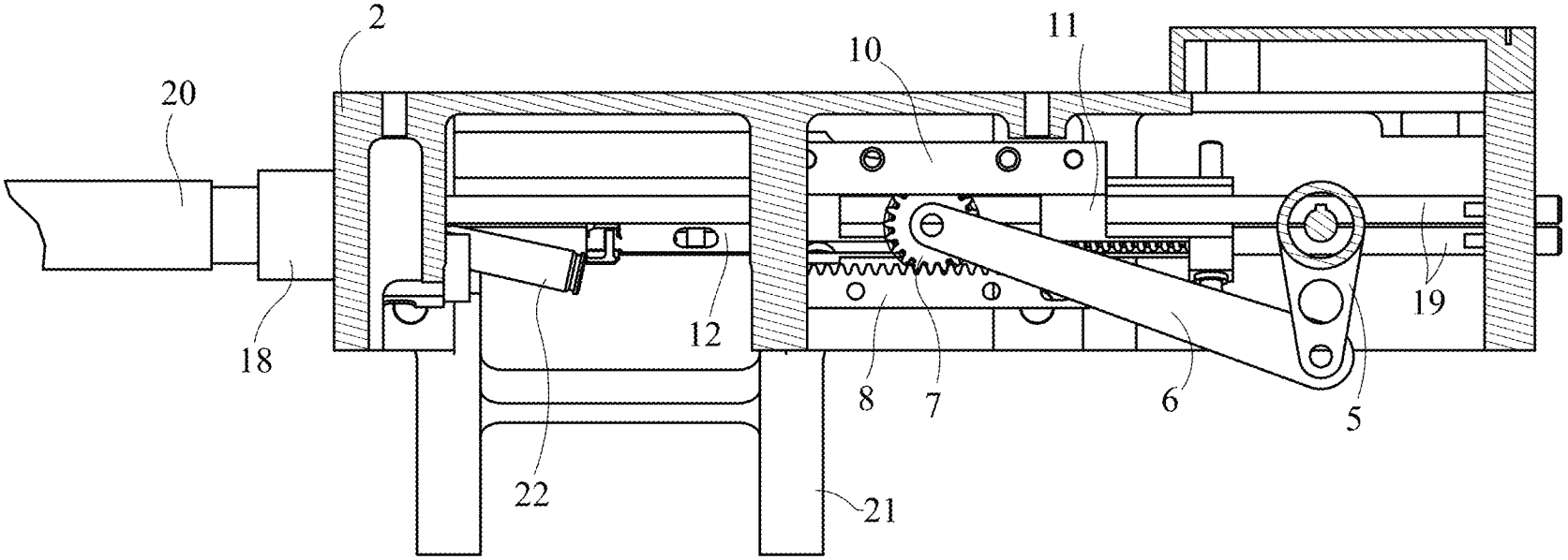
FIG. 6B PRIOR ART
FIG. 6B is a partial top view, in section, showing a second position of the weapon of FIG. 1.

FIG. 6A is a partial side view, partially cut-away, and FIG. 6B is a partial top view, in section, showing a second position of the weapon 1 of FIG. 1. The second position of FIGS. 6A and 6B illustrates the locations of the internal components of the weapon 1 after the crank 5 rotates ninety degrees from the first position, shown in FIGS. 5A and 5B. At this point, as well as any point throughout the cycle, the operating group subassembly has traveled a distance twice that of the distance traveled by the pinion 7 and the end of the connecting rod 6 connected to the pinion 7.

During translation of the operating group subassembly, the bolt carrier 11 may be supported by and may slidably reciprocate on two tubes 19. In the illustrated embodiment, tubes 19 may be cylindrical in shape. Translation of the bolt subassembly 12, as well as angular position control of the bolt subassembly 12, may be facilitated by the tubes 19. Other methods may also be used to support the bolt carrier 11 and control the angular position of the bolt subassembly 12. For example, the receiver 2 may be fabricated with integral features that support the bolt carrier 11 and control the angular position of the bolt subassembly 12.

At this point in the cycle, the bolt subassembly 12 reaches a point where it begins to strip a cartridge 22 from the ammunition supply and feed it into the barrel extension 18 towards the chamber of the barrel 20. Stripping of cartridge 22 may be accomplished by means of the depressible radial rammer 28, which may pivot about the rammer pin 30

(FIGS. 3A-C). For most of the cycle, the depressible radial rammer 28 may remain in its stripping (non-depressed) position relative to the bolt 25, due to the restorative force of the rammer spring.

Depending on the particular application, the ammunition supply may or may not be mechanically linked and/or controlled by the PTO cam pin 17, which may be rigidly coupled to the bolt carrier 11 (FIG. 2A). For example, the PTO cam pin 17 may engage a cam slot in a feed cover designed to manipulate a linked belt of ammunition (such as those typically used in the M249 and M240 machine guns), or the PTO cam pin 17 may engage a cylindrical cam that indexes a feed sprocket (such as those used in the XM235 Rodman Squad Automatic Weapon). In other embodiments, the ammunition supply may be self-regulating/controlling, such as a spring-fed stacked magazine, similar to those used in the M16/M4 series of assault rifles. In other embodiments, additional and other unique ammunition supply mechanisms may be utilized. For certain ammunition sources, the track 21 (FIG. 1) may be utilized for securing the ammunition supply and/or controlling the presented cartridges 22.

Figure 7A:
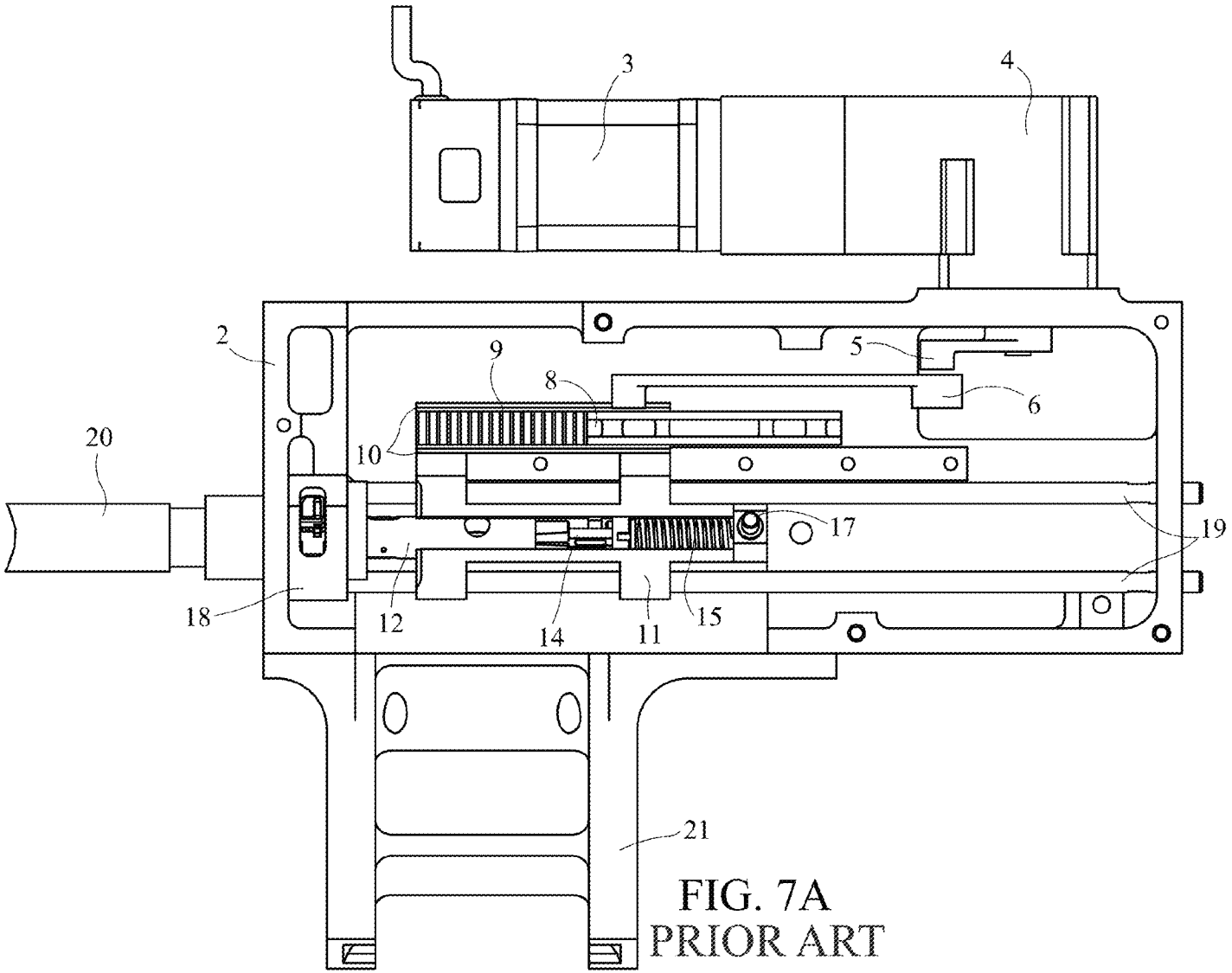
FIG. 7A PRIOR ART
FIG. 7A is a partial side view, partially cut-away.
Figure 7B:
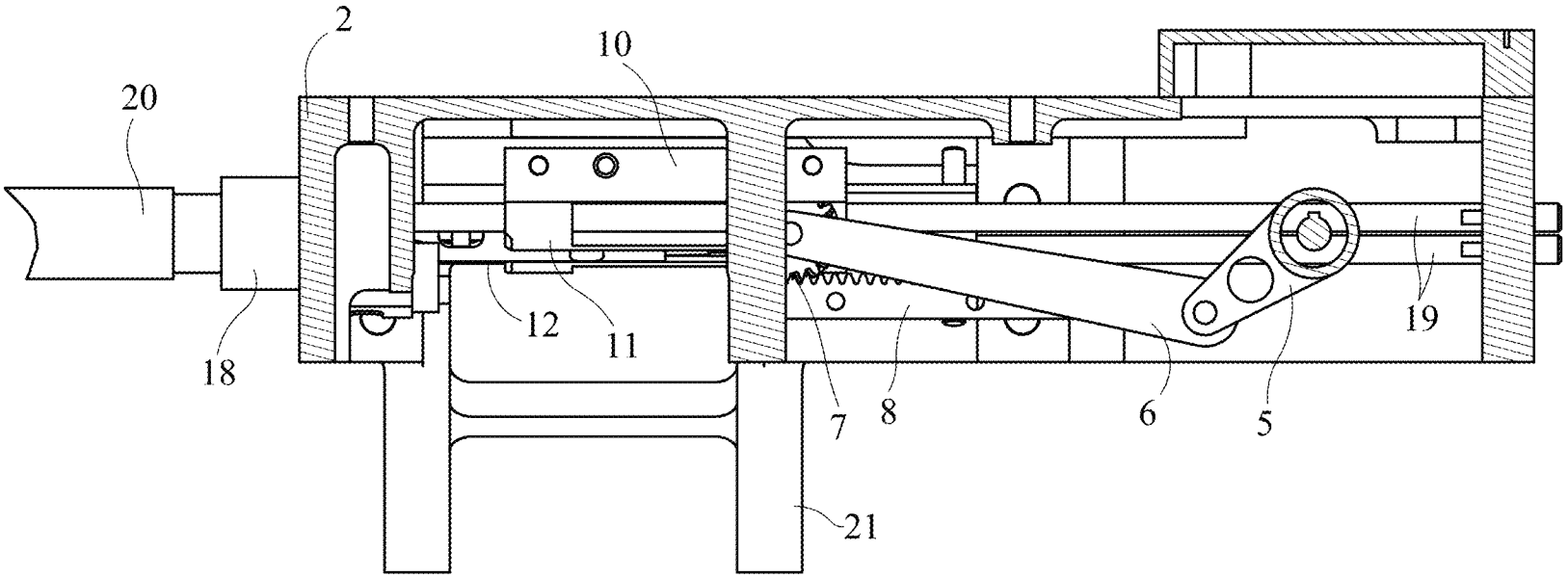
FIG. 7B PRIOR ART
FIG. 7B is a partial top view, in section, showing a third position of the weapon of FIG. 1.

Further crank 5 rotation from the second position of FIGS. 6A and 6B results in additional forward translation of the operating group subassembly to the third position shown in FIGS. 7A and 7B. FIG. 7A is a partial side view, partially cut-away, and FIG. 7B is a partial top view, in section, showing the third position of the weapon 1 of FIG. 1. At this point the chambering of cartridge 22 is complete. Translation of the bolt subassembly 12 ceases, but the bolt subassembly 12 is rotating relative to the bolt carrier 11. This rotation of the bolt subassembly 12 relative to the bolt carrier 11 is possible only after the cartridge 22 is fully chambered and the front 104 (FIG. 2A) of the bolt subassembly 12 clears the front 112 of the tubes 19. Once clear of the tubes 19, the angular position of the bolt subassembly 12 is no longer restricted. The bolt cam pin 13 (FIG. 2C) may engage a cam slot 106 in the bolt carrier 11, which in turns facilitates the intended rotation of the bolt subassembly 12.

At this point, the front of the bolt subassembly 12 resides within an internal pocket of the barrel extension 18. As the bolt subassembly 12 rotates, the locking surfaces of the bolt 25 overlap the corresponding locking surfaces of the barrel extension 18. This process, commonly referred to as bolt locking, supports the firing event of the cartridge 22 and decouples the reaction forces associated with the firing event from the other components of the operating group subassembly and the drivetrain subassembly.

While the bolt subassembly 12 is no longer moving forward, the bolt carrier 11 is still undergoing forward translation. The relative movement between the bolt subassembly 12 and bolt carrier 11 allows the firing pin drivespring 15 to further compress. Further compression of the firing pin drivespring 15 generates the potential energy necessary to propel the firing pin subassembly 14 forward and initiate ignition of the cartridge 22, which occurs a bit later in the cycle. The firing pin drivespring 15 may function as an energy generator to supply the energy needed to propel the firing pin subassembly 14 toward the cartridge 22.

At this point in the cycle, the ejector 27 (FIGS. 3B and C) is fully depressed and further compresses the extractor/ejector spring 32. The extractor 26 has also rotated about the extractor pin 29 until the extractor 26 sits over the rim of the case of the cartridge 22.

Figure 8A:
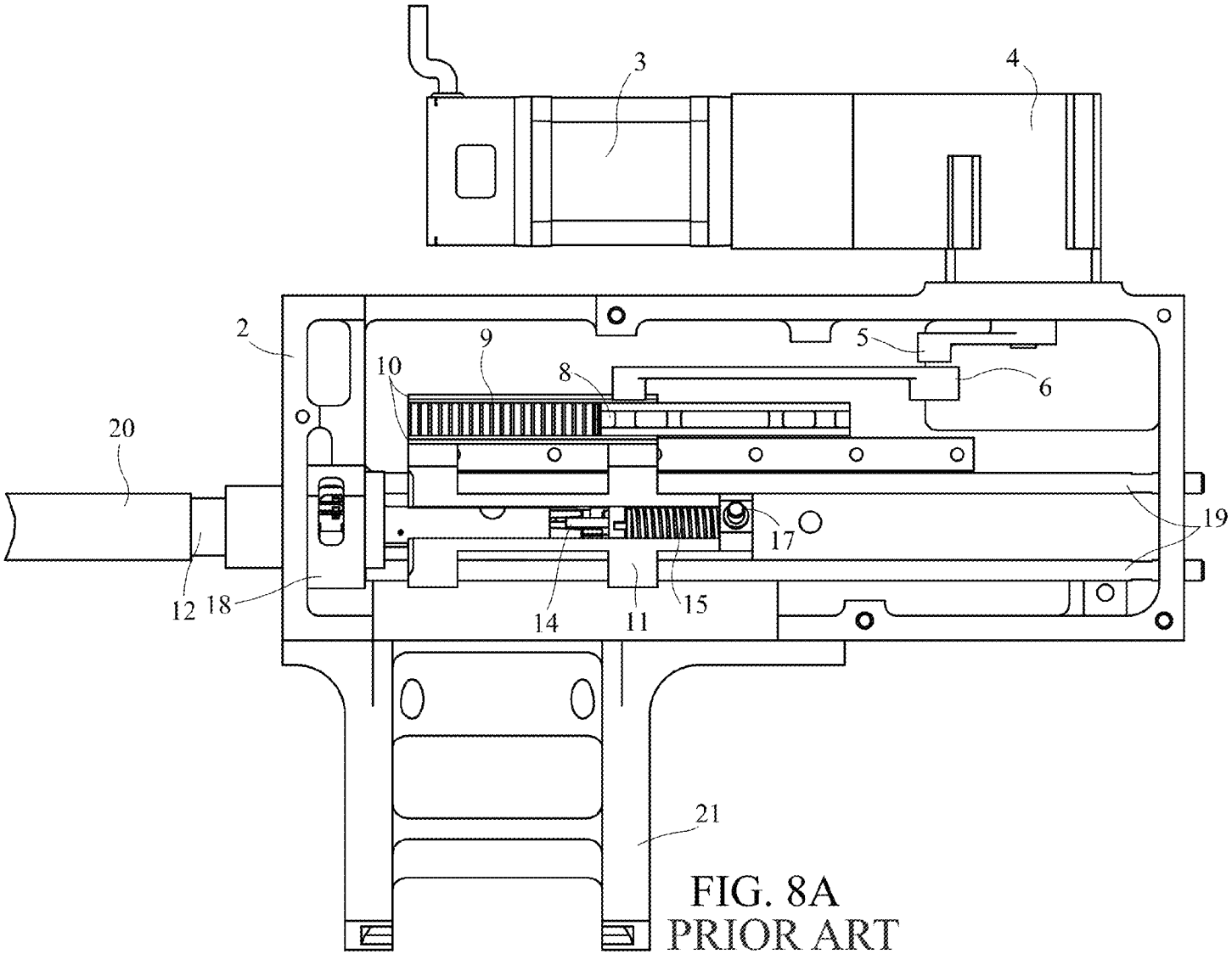
FIG. 8A PRIOR ART
FIG. 8A is a partial side view, partially cut-away.
Figure 8B:
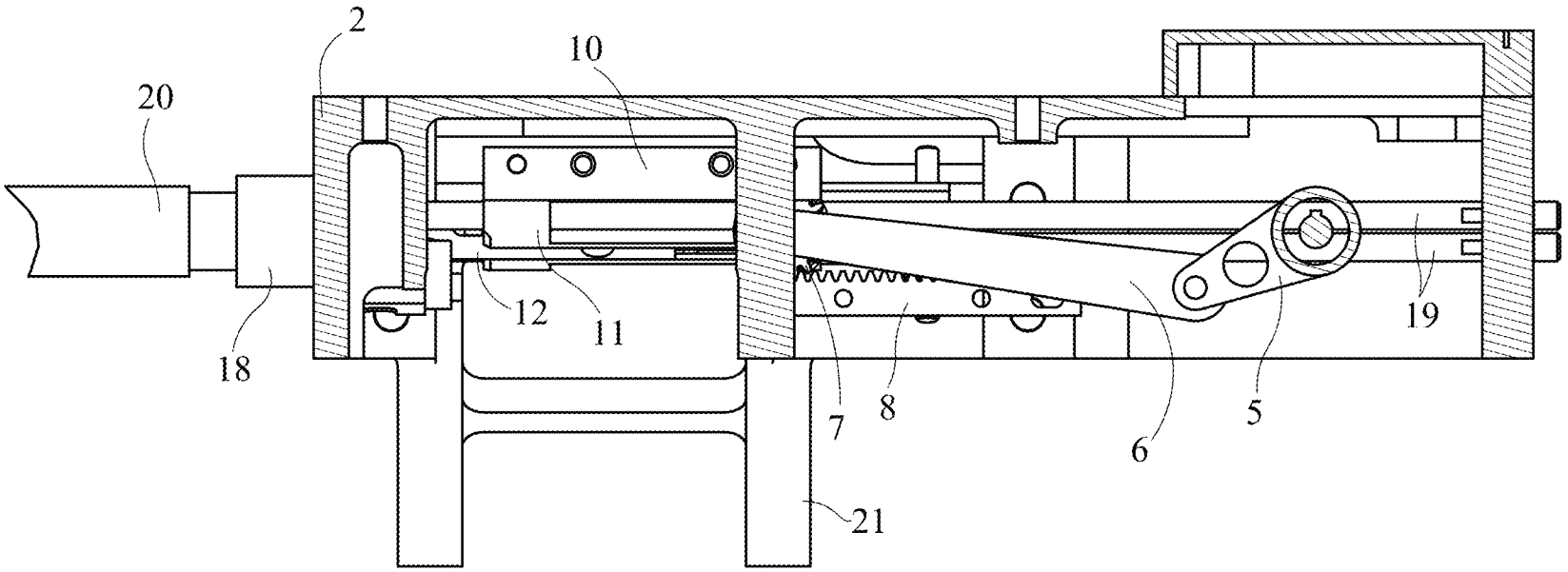
FIG. 8B PRIOR ART
FIG. 8B is a partial top view, in section, showing a fourth position of the weapon of FIG. 1.

FIG. 8A is a partial side view, partially cut-away, and FIG. 8B is a partial top view, in section, showing a fourth position of the weapon 1 of FIG. 1. In the fourth position of the cycle, the bolt subassembly 12 has completed its angular rotation. The locking surfaces of the bolt 25 are fully engaged with those of the barrel extension 18. As soon as the bolt subassembly 12 reaches its fully rotated and locked position, a slot 108 (FIGS. 2A and 3C) in the rear of the bolt 25 becomes aligned with an engaging feature 110 (FIGS. 2A and 4) on the firing pin 33. The firing pin subassembly 14 is thereby free to move forward a distance equal to the length L (FIG. 3C) of the slot 108 in the rear of the bolt 25.

The forward movement of the firing pin subassembly 14 over the distance L is powered by the potential energy stored in the firing pin drivespring 15. The firing pin drivespring 15 extends from its compressed state to generate the velocity and associated kinetic energy of the firing pin subassembly 14 that is necessary for successful ignition of cartridge 22. The moment when the slot 108 in the rear of the bolt 25 becomes aligned with the engaging feature 110 on the firing pin 33 is analogous to "pulling the trigger" on a weapon that has a trigger. At that moment, an event has been triggered that will result in the firing pin 33 being propelled forward toward the primer of the cartridge 22, with the intent of firing the cartridge 22.

Figure 9A:
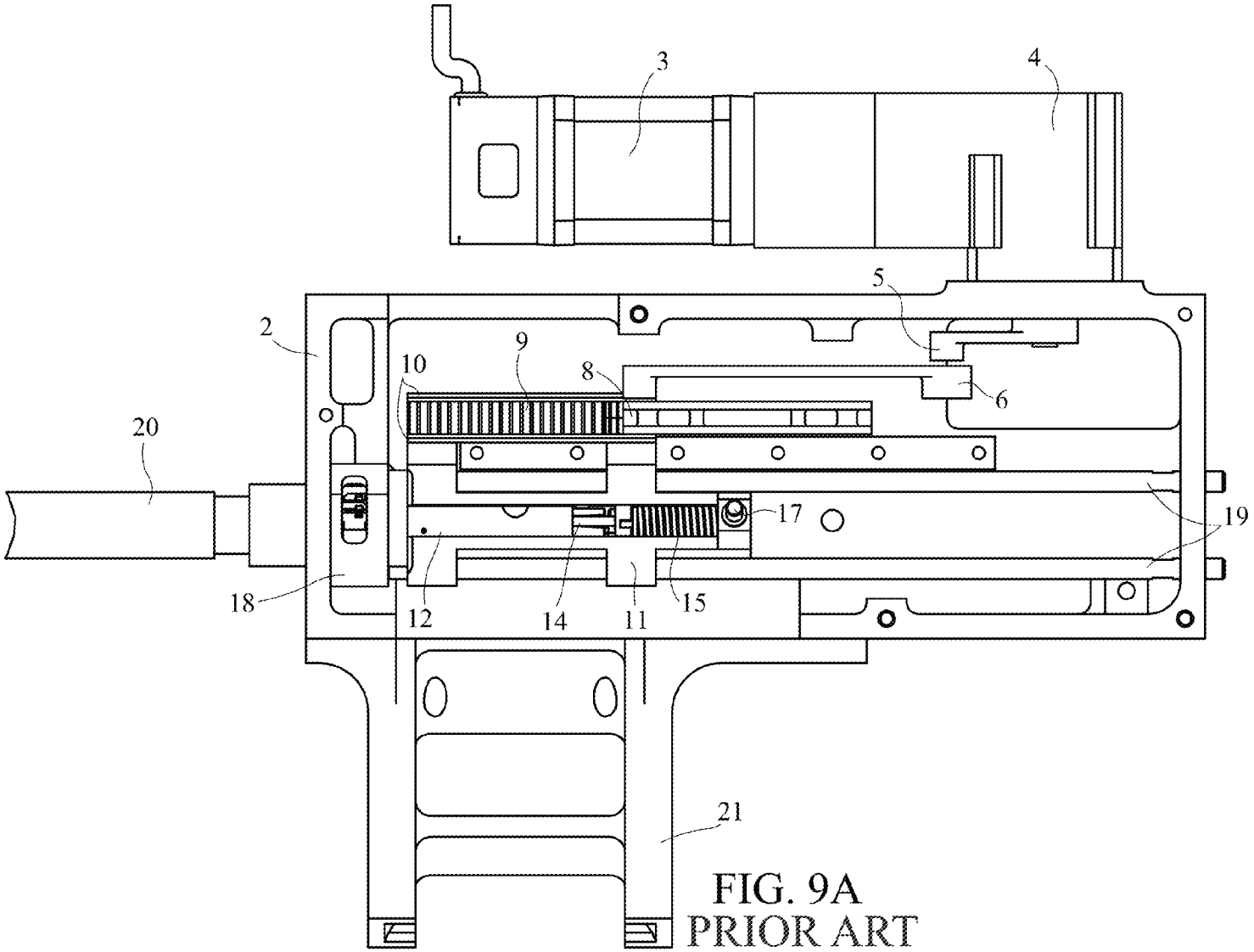
FIG. 9A PRIOR ART
FIG. 9A is a partial side view, partially cut-away.
Figure 9B:
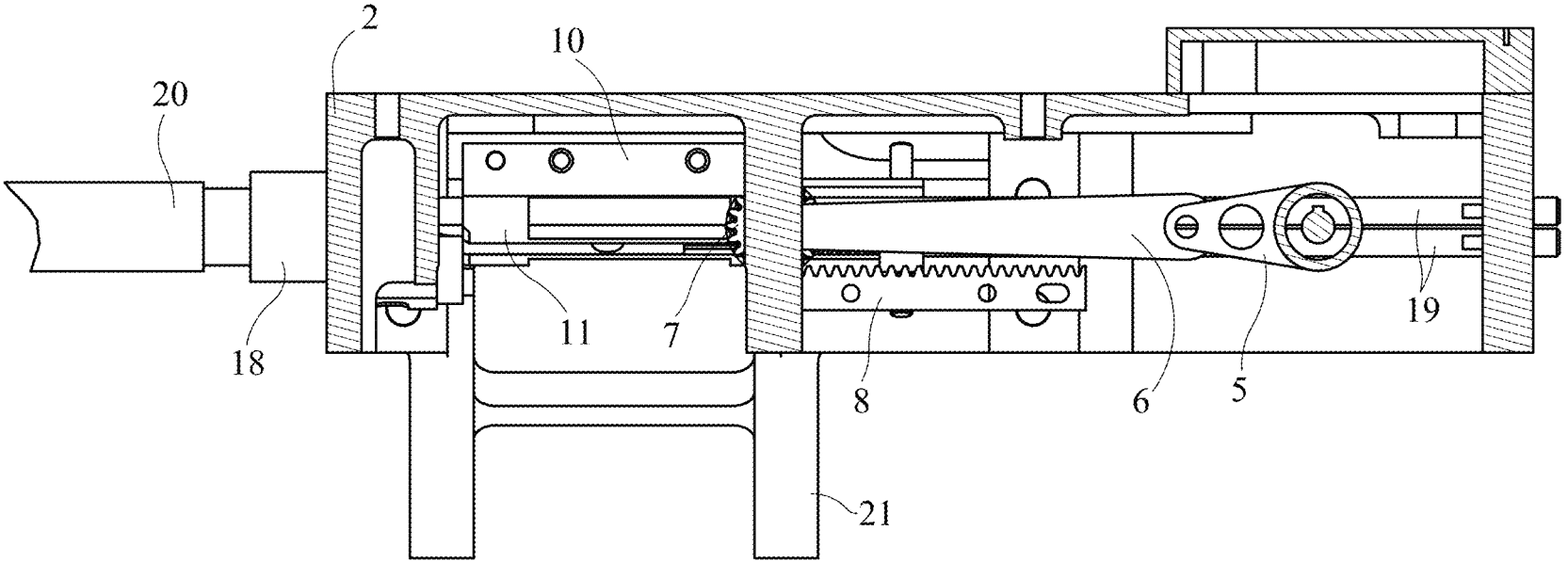
FIG. 9B PRIOR ART
FIG. 9B is a partial top view, in section, showing a fifth position of the weapon of FIG. 1.

FIG. 9A is a partial side view, partially cut-away, and FIG. 9B is a partial top view, in section, showing a fifth position of the weapon 1 of FIG. 1. The fifth position represents the end of the counterrecoil portion of the cycle and the beginning of the recoil portion of the cycle. The operating group and drivetrain subassemblies have zero instantaneous velocity at this point. Firing of the cartridge 22 has taken place at or slightly before this position, depending on the chosen rate of fire. At certain firing rates the bolt carrier 11 may still be moving forward when the cartridge 22 is fired. The firing pin subassembly 14 has traveled a forward distance, relative to the bolt subassembly 12, equal to the length L of the slot 108 in the rear of the bolt 25. This distance permits the firing pin drivespring 15 to generate sufficient velocity and energy such that the firing event is initiated when the tip of the firing pin 33 strikes the primer of the cartridge 22.

Successful ignition of the cartridge 22 is dependent only on the associated velocity and kinetic energy of the firing pin subassembly 14 and does not rely on any generated momentum associated with the rest of the operating group subassembly. The lack of dependence on the movement of any other components of the operating group subassembly is important because the design of the firing mechanism, in conjunction with the ability to vary the speed of the motor 3, allows for continuous adjustment of the firing rate. The amount of energy produced by the firing pin energy generator, which is the firing pin drivespring 15 in the disclosed embodiment, may be independent of the translation speed of the operating group subassembly and sufficient to ensure successful ignition of cartridge 22. Thus, the firing rate may be continuously adjusted from zero rounds per minute up to the designed mechanical limitation, which may be on the order of several hundred rounds per minute or greater.

Another advantage of the independence of the firing pin energy generator from the momentum associated with the rest of the operating group subassembly is, for example, when weapon 1 must be fired as accurate as possible, to engage point targets. In that case, movement of the operating group subassembly may adversely affect the accuracy of weapon 1. But, the energy available from the firing pin drivespring 15 will result in successful ignition of cartridge 22 regardless of the speed of the other components comprising the operating group subassembly. Therefore, the operating group subassembly may be positioned such that the slot 108 in the rear of the bolt 25 is very nearly aligned with the engaging feature 110 on the firing pin 33. Then, the weapon 1 may be aimed. When ready to fire, the bolt carrier 11 may be very slowly advanced only the miniscule amount necessary to complete rotation of the bolt subassembly 12 and align the slot 108 of the bolt 25 with the engaging feature 110 of the firing pin 33. When the slot 108 of the bolt 25 is aligned with the engaging feature 110 of the firing pin 33, the firing pin subassembly 14 is driven forward and the weapon 1 fires. In this manner, any inaccuracy of the weapon 1 that may be caused by movement of the components within weapon 1 may be minimized.

An additional benefit of weapon 1 is that the designed over travel in the bolt carrier 11, in combination with the control of the release of the firing pin subassembly 14 by the angular position of the bolt subassembly 12, allows for advanced ignition of the cartridge 22 (relative to the bolt carrier 11 position). Advanced ignition of the cartridge 22 may occur while the bolt 25 is fully rotated and locked, even though the bolt carrier 11 may still be moving forward during counter recoil. This feature allows for additional lock time of the bolt 25 to help mitigate hang fires of the cartridge 22, which may be problematic for certain conventional externally-actuated weapon mechanisms.

Figure 10A:
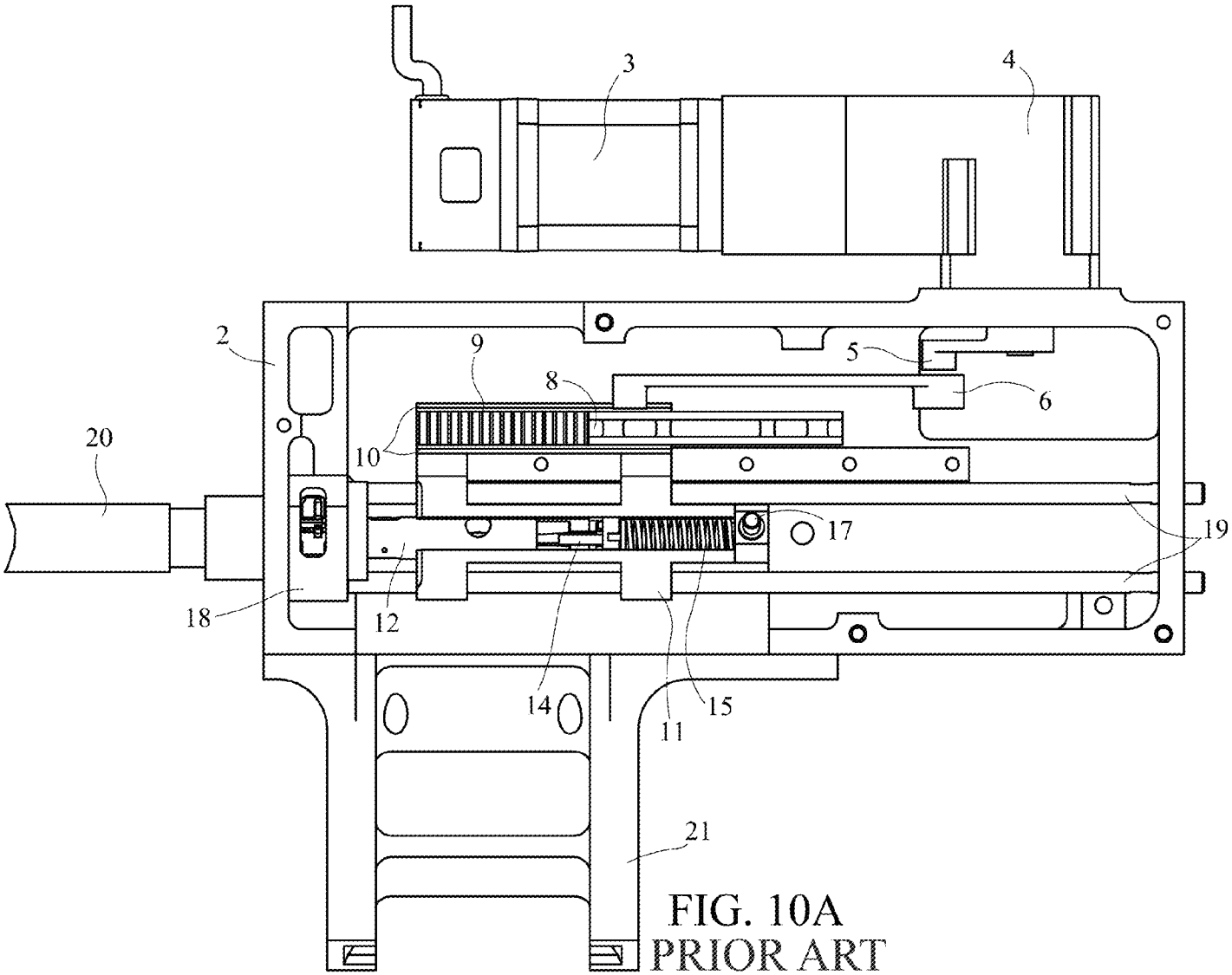
FIG. 10A PRIOR ART
FIG. 10A is a partial side view, partially cut-away.
Figure 10B:
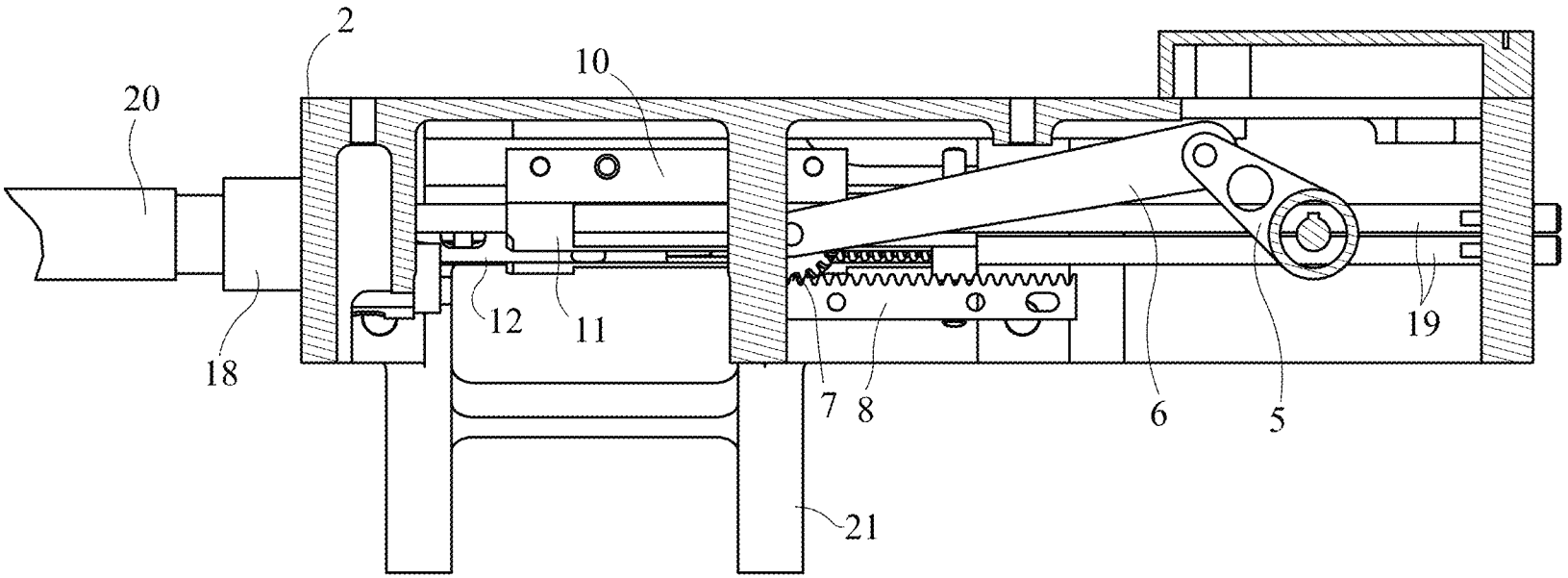
FIG. 10B PRIOR ART
FIG. 10B is a partial top view, in section, showing a sixth position of the weapon of FIG. 1.

FIG. 10A is a partial side view, partially cut-away, and FIG. 10B is a partial top view, in section, showing a sixth position of the weapon 1 of FIG. 1. The sixth position illustrates a position early in the recoil portion of the cycle when the bolt carrier 11 begins moving to the rear. At this point, the bolt subassembly 12 is not yet translating, but is undergoing rotation via the bolt cam pin 13, to unlock itself from the barrel extension 18. At the same time, the bolt carrier 11 is already moving rearward, and a shoulder 114 (FIG. 2D) internal to the bore of the bolt carrier 11 engages the firing pin base 34, thereby retracting the entire firing pin subassembly 14, in order to reset the firing pin subassembly 14 for the next cycle.

While the bolt subassembly 12 undergoes the process of unlocking, the firing pin 33 is being retracted from the slot 108 in the rear of the bolt 25. The firing pin 33 rotates with the bolt subassembly 12 and rotates relative to the firing pin base 34 (FIG. 4). The firing pin base 34 is only able to translate (and not rotate) within the bolt carrier 11. After the firing pin 33 clears the slot in the rear of the bolt 25, the torsion spring 35 acts to reset the firing pin 33 to its original angular position, relative to the firing pin base 34, at the beginning of the cycle. This action may be completed prior to completion of the unlocking of the bolt subassembly 12. When the bolt subassembly 12 is completely unlocked, the bolt subassembly 12 may translate along with the bolt carrier 11 and the remainder of the operating group subassembly.

Throughout the unlocking process of the bolt subassembly 12, the ejector 27 (FIGS. 3B and C) remains fully compressed and the extractor 26 rotates about the rim case of the cartridge 22. In certain embodiments with particular ammunition handling mechanisms, it is also possible that the PTO cam pin 17 may start to engage any number of ammunition indexing mechanisms to control the movement and presentation of subsequent cartridges 22.

Figure 11A:
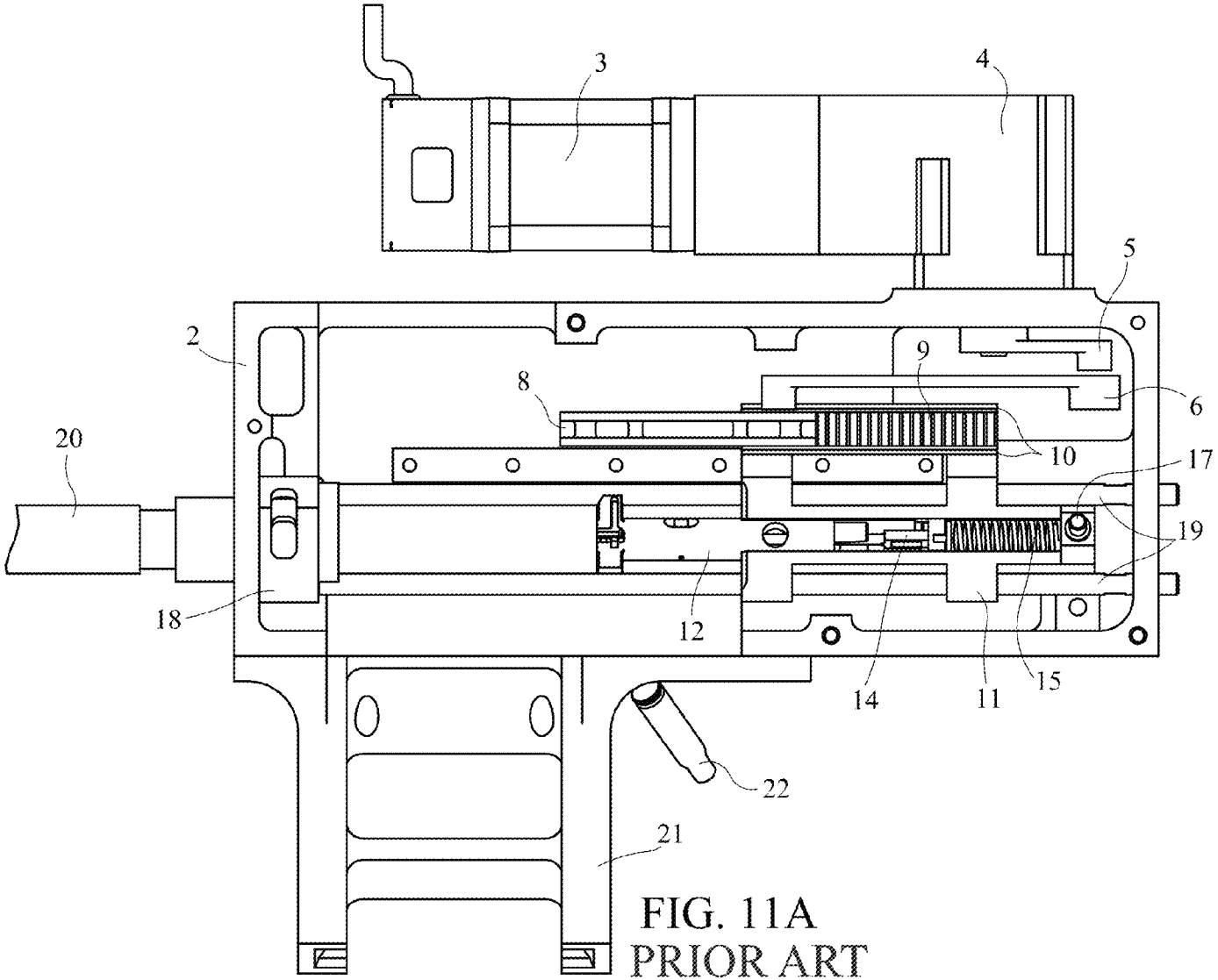
FIG. 11A PRIOR ART
FIG. 11A is a partial side view, partially cut-away.
Figure 11B:
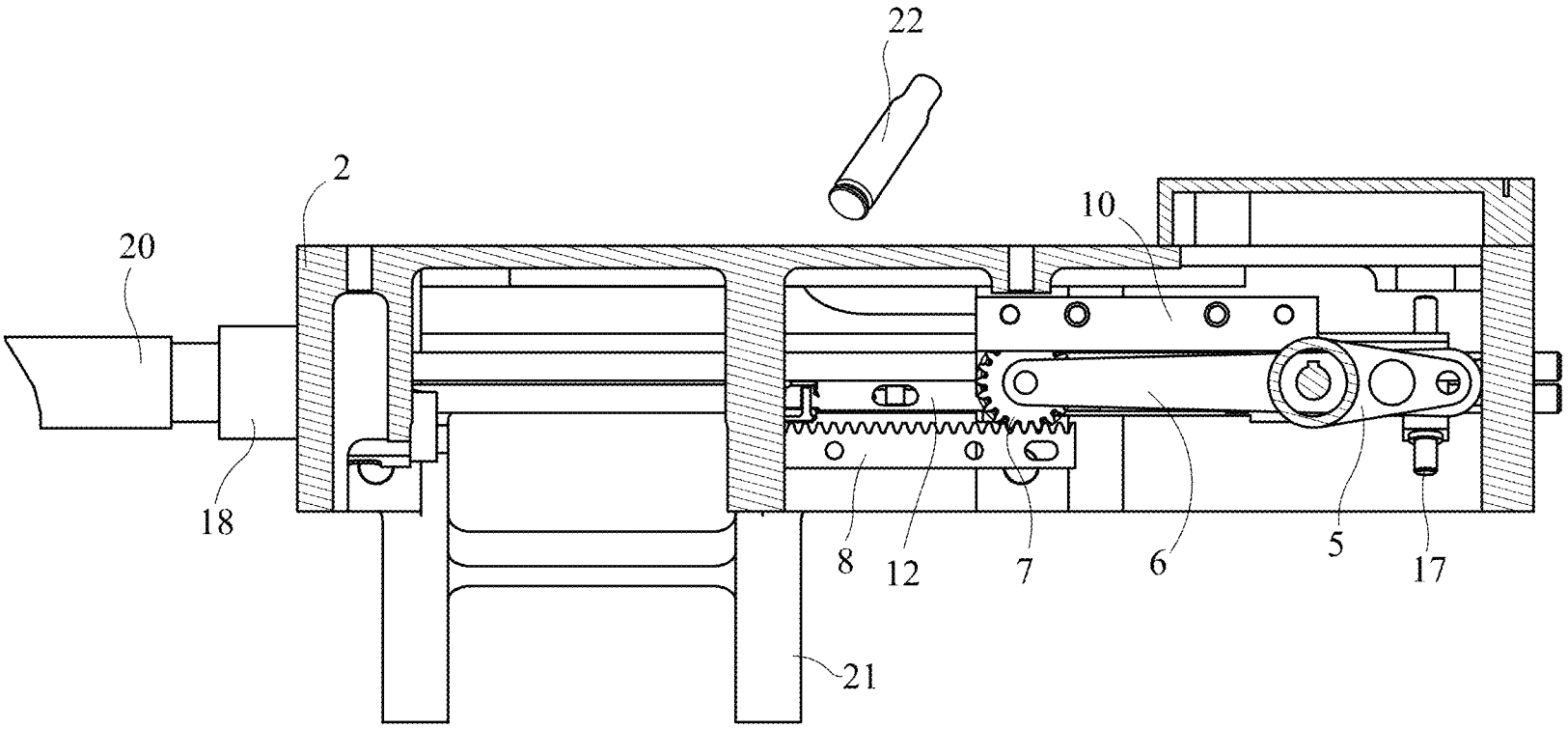
FIG. 11B PRIOR ART
FIG. 11B is a partial top view, in section, showing a seventh position of the weapon of FIG. 1.

FIG. 11A is a partial side view, partially cut-away, and FIG. 11B is a partial top view, in section, showing a seventh position of the weapon 1 of FIG. 1. The seventh position illustrates ejection of the empty case of cartridge 22. After the bolt subassembly 12 is fully unlocked and begins its movement rearward, the extractor 26 (FIGS. 3A-C) pulls the empty case of cartridge 22 from the chamber of the barrel 20. The previously compressed extractor/ejector spring 32 pushes the ejector 27 out of the face of the bolt 25, until the motion of the ejector 27 is stopped by the rear surface of the depressible radial rammer 28. As the ejector 27 moves out of the face of bolt 25, it imparts an impulsive force on the head of the empty case of cartridge 22. This impulsive force causes the case of cartridge 22 to rotate about the extractor 26 until there is no longer any surface contact, at which point the case of cartridge 22 is propelled away from the receiver 2.

In some embodiments using certain types of ammunition handling mechanisms, as the operating group subassembly passes from the sixth position to the seventh position, the depressible radial rammer 28 rotates inward about the rammer pin 30 towards the axis of the bolt 25. This action is intended and may be advantageous if the cartridge 22 that is moving into the feed position for the next cycle interferes with the path swept by the depressible radial rammer 28, in its non-depressed position. Once the depressible radial rammer 28 is free to return to its non-depressed position, a rammer spring may provide the necessary restoring force.

Another embodiment of a reciprocally-cycled, externally-actuated weapon includes an operating mechanism and supporting elements that facilitate first round select and first cycle fire capabilities. The weapon may be supplied with belted ammunition of an open-end linked configuration or a closed-end linked configuration. The closed-end link ammunition may be, for example, the M9 link style or a similar style that requires rearward cartridge extraction from the link and cannot be delinked by pushing forward or through the link. Unlike open-end ammunition links that enable forward stripping and feeding, the cartridges contained within the closed-end links must first be extracted rearward from the link itself before feeding and chambering can take place.

First round select and first round fire capabilities are important for the implementation of scalable effects (e.g., switching between non-lethal and lethal ammunitions) as well as ensuring a safe/cleared weapon following a magazine download. The weapon 200 of FIG. 12 may be used with existing belted ammunition types. For example, the belted ammunition may be the closed-end (e.g., M9 style) or open-end (e.g., M15A2 style) linked configuration. No modifications to weapon 200 are required when switching between open-end and closed-end linked ammunition and there is no degradation in weapon performance.

Weapon 200 uses an electro servo drive motor in combination with customized kinematics to tailor the motion profile of the weapon operating group. Tailoring the motion profile enables the weapon to fire in a precision fire mode, which results in demonstrated accuracy that far exceeds the accuracy of small caliber remote weapons systems that incorporate legacy weapons. Also, the electro servo drive motor enables a continuous adjustment of the rate-of-fire within the designed limits of the weapon. Additionally, this method of customized motion control can be advantageously used to reduce power consumption, increase bolt lock time to combat hang-fire malfunctions, and reduce dynamic loads experienced by weapon components and/or ammunition during certain portions of the operating cycle.

As an example of improved precision characteristics, consider the demonstrated 100 meter extreme spread dispersion of a 10-round group fired from the inventive remotely-operated weapons versus the required production qualifications for the M240B (7.62×51 mm) and M2 (.50 caliber) legacy machine guns used in prior remotely-operated weapons. For the inventive weapon in a 7.62×51 mm caliber, the average extreme spread at 100 meters is 2.0 inches, compared to 30 cm (11.8 inches) allowable extreme spread at 100 meters for the M240B 7.62×51 mm weapon.

For the inventive weapon in a .50 BMG (12.7×99 mm) caliber, the average extreme spread at 100 meters is 2.7 inches compared to 8.0 inches allowable extreme spread at 100 feet (26 inches allowable at 100 meters) for the M2 .50 caliber weapon.

The scalable effects aspect of the novel weapon is the ability to quickly and remotely change the ammunition type presented to the weapon in mid-mission to provide the most desirable terminal ballistic response to a given threat situation. A derivative of scalable effects is the desired use of both non-lethal as well as lethal ammunition types, and therein is the concern and need for first round select capability. Weapon 200 may be a component (i.e., the externally-powered firearm) of an automatically-reloadable, remotely-operated weapon system. One example of such a weapon system is disclosed in U.S. Pat. No. 8,336,442 issued on Dec. 25, 2012 to Testa et al. The entire contents of U.S. Pat. No. 8,336,442 are incorporated by reference herein.

"First round select" is the ability of the weapon to fire, on the very first cycle following a magazine change, the same ammunition type that was just loaded in a magazine, even if the ammunition type presented to the weapon in the previous magazine was of a different type. This is also accomplished without the need to clear the weapon mechanism of a remaining unfired cartridge during a magazine download. The necessity to include this capability stems from the possibility of changing from a lethal ammunition type magazine to one of a non-lethal type. The potential for unwanted collateral damage can occur if a weapon operator, expecting to fire non-lethal ammunition, were to unexpectedly initiate even a single lethal cartridge at the beginning of what was thought to be a short burst of non-lethal ammunition. First round select capability eliminates this potential danger.

First round select capability is achieved by mechanical components of the novel weapon that delink rounds and manipulate the position of delinked rounds to a feed-ready location, which is a secondary position within the ammunition magazine. The linear movement of those mechanical components is of equal speed but directionally out of phase with the primary weapon operating group by 180 degrees. Some of the important delinked cartridge control features are located in the magazine subassembly, as opposed to their traditional location within the weapon mechanism itself.

Related to first round select capability is the "first cycle fire" capability. First cycle fire capability is the weapon's ability to fire a cartridge on the very first operating cycle following a magazine upload. It is commonplace for legacy small caliber weapons utilizing closed link ammunition, such as the MK19 40 mm Grenade Machine Gun or the M2 0.50 Caliber Heavy Machine Gun, to require one or more charging cycles when initially presented with a belted ammunition supply, before the first shot may be fired. In the novel weapon, the secondary feed-ready position is included in the magazine subassembly. Thus, weapon operators who initially load the remote weapon system with its payload of magazines simply have to place a single delinked cartridge in the feed-ready position in each magazine. Then, even during the initial upload of a fresh magazine, the weapon operating group will fire a cartridge on the very first cycle while it also delinks and deposits into the feed-ready position the first cartridge of the belted supply.

Should a magazine be downloaded mid-mission before its supply of rounds is exhausted, a delinked cartridge will remain secure in the feed-ready position of the downloaded magazine. And, if that same magazine is uploaded to the weapon at a later time during the mission, the first cycle fire capability would still be achieved, without any manned intervention.

Traditional externally-powered small and medium caliber weapons that rely on an electrical power supply often implement direct current motors to drive their mechanical operation. Given this approach, the motor cycles uniformly, resulting in a fixed firing rate and no ability to locally control kinematics within a given cycle. On other hand, the novel weapon uses an electro servo motor to produce customized motion profiles that facilitate the functional capabilities of the weapon. A key advantage to the electro servo motor and customized motion profiles is the verified reduction in downrange projectile dispersion. For example, the novel weapon can shoot tighter groups that increase hit probability, especially at longer ranges, compared to legacy small caliber machine guns in mounted or remote weapon system applications. The reduction in downrange projectile dispersion is achieved by careful control over the firing mechanism's speed and position during different critical events in the firing cycle. For example, the weapon's operating group may be slowed down just prior to firing to allow the weapon to fully stabilize while concurrently minimizing the time delay between the firing command and break of the shot.

Additionally, the use of an electric servo drive motor with tailored motion control relates to higher power efficiency, which translates into lower current demands to meet operational goals. This is highly desirable because, for example, a vehicle (for example, an HMMWV) on which the weapon may be mounted has a limited supply of power to support ancillary systems, including externally-powered weapons. By implementing even a stepped input control scheme containing discrete localized rate options, it is possible to lower both the root mean square and peak torque/current and associated power (the operating voltage does not change) requirements. The "rate" is rounds fired per minute. The torque/current and power requirements are lowered by more optimally maneuvering the weapon's operating group through a cycle containing known events with known energy requirements. That is, the operating group is moved at higher localized rates (relative to the average commanded cyclic rate) during low load positions of the cycle and the operating group is moved at lower localized rates (relative to the average commanded cyclic rate) through positions/events that consume more energy.

Because the energy required to accelerate/decelerate the moving masses of the operating group (or maintain a certain commanded cyclic rate as the operating group moves differentially through energy-robbing events) is much higher than all other contributors to cyclic torque requirements combined, increasing the difference between average commanded and differential cyclic rates in this fashion produces the desired effect in terms of reduced driving torque and power. This type of customized control is accomplished without changing the total cycle time. So, the benefit of reduced power consumption is achieved transparently to the weapon user because the perceived firing rate is still maintained.

Figure 12:
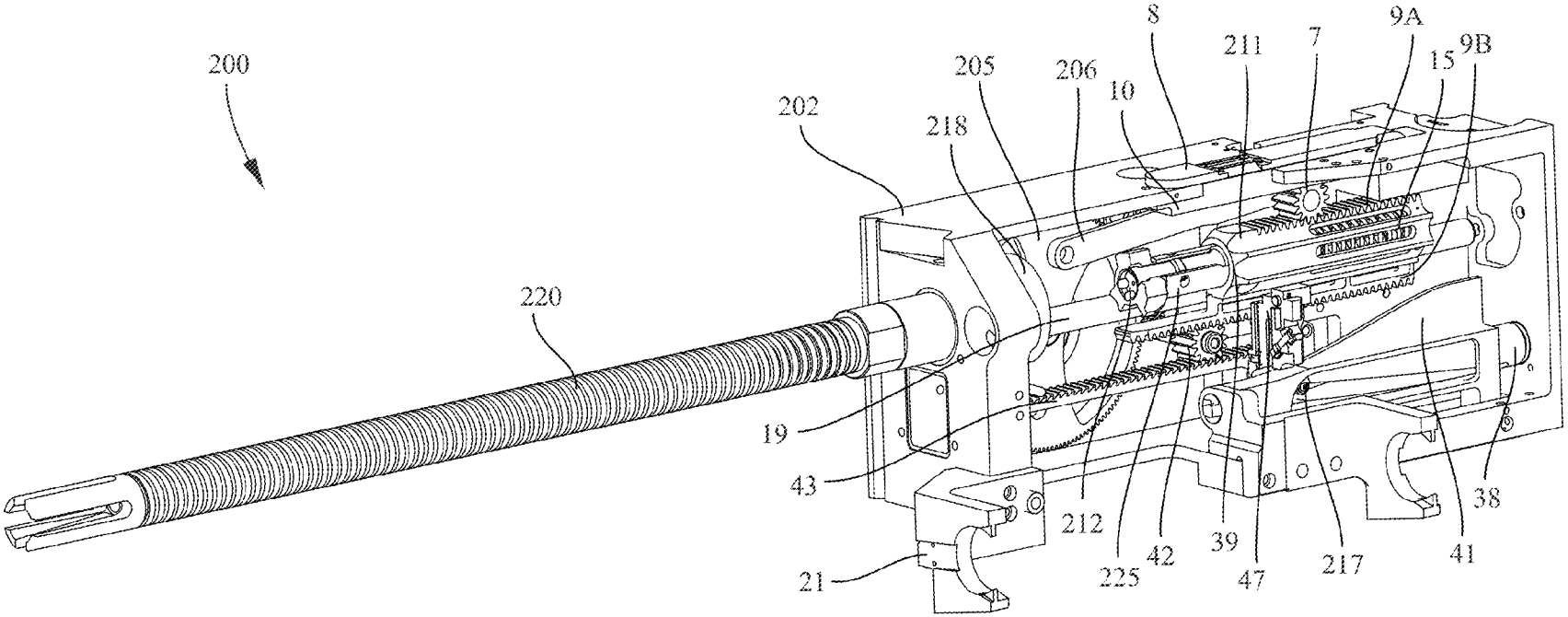
FIG. 12 is an isometric side view of another embodiment of a reciprocally-cycled, externally-operated weapon that has additional ammunition handling capabilities, compared to the embodiment of FIG. 1.
Figure 12A:
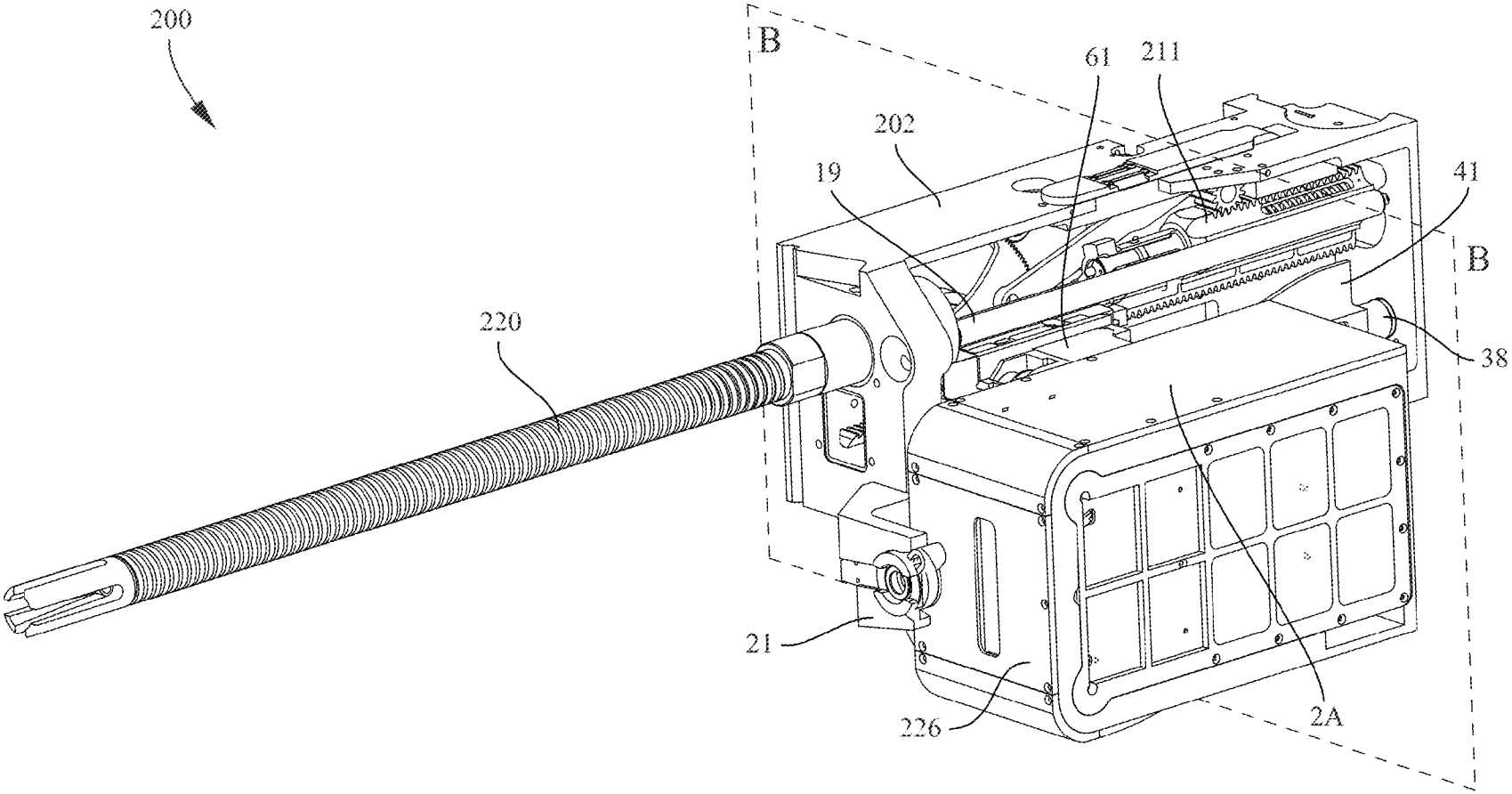
FIG. 12A is an isometric side view of the weapon of FIG. 12 with a modular active magazine coupled to it.
Figure 12B:
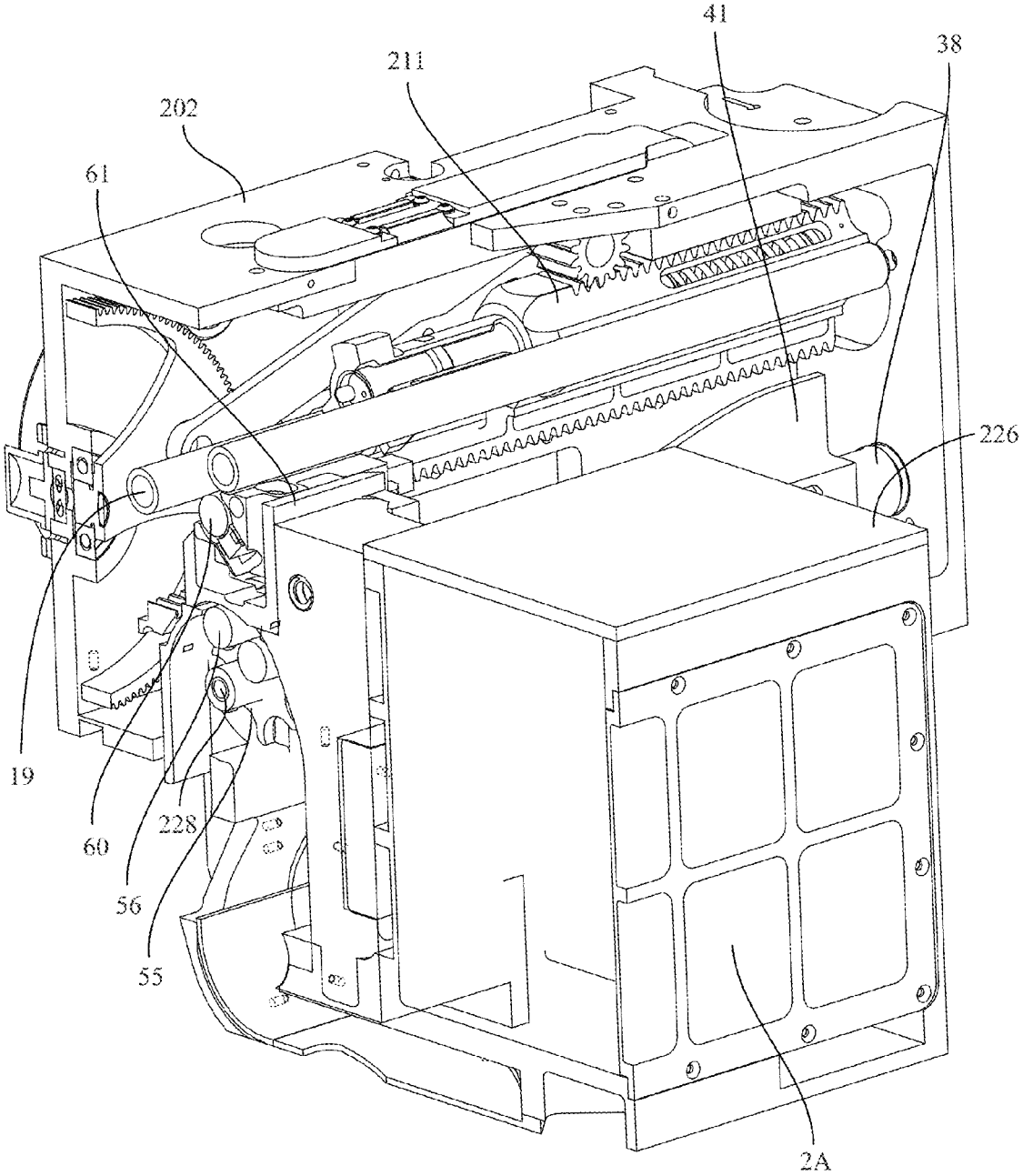
FIG. 12B is a cut away view taken along the plane BB of FIG. 12A.

It is useful here to describe in limited detail the ammunition that is compatible with the weapons 1, 200 depicted in FIGS. 1 and 12, respectively. FIGS. 12C and 12D are top and bottom isometric views, respectively, of a belt of four rounds of ammunition. The cartridges 22 are flexibly coupled in this instance by open-end links 81. These disintegrating members or links 81 snap around part of the diameter of the cartridge case 1201 but do not close on themselves as is evident in FIG. 12D. Both weapons 1, 200 are capable of firing ammunition coupled with links 81. In each weapon 1, 200, the stripping lug of the bolt 25 or 225 catches the rim 1202 and case head 1203 of the cartridge and pushes it forward through the open ended link 81 towards the barrel.

Figure 12E:
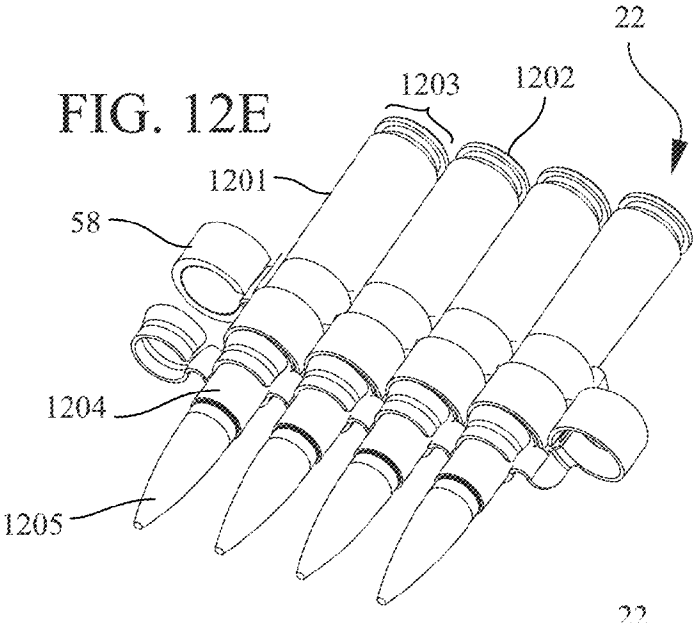
FIGS. 12C thru 12E depict known ammunition cartridges and different linking schemes for belts of cartridges.
Figure 12F:
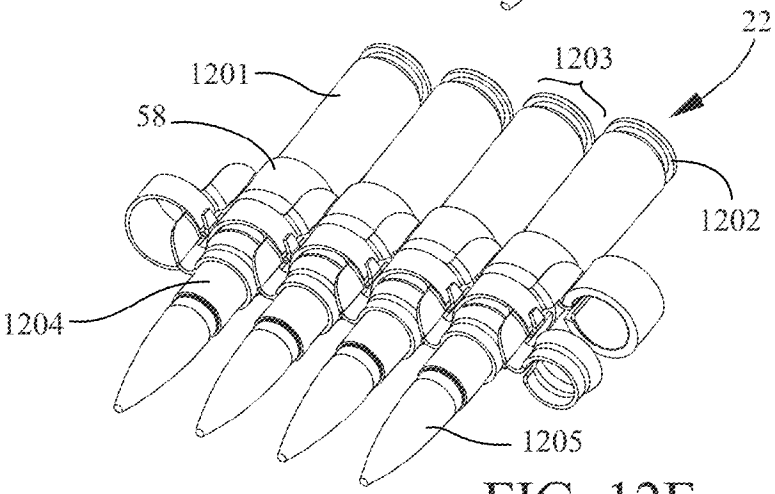
Figure 12C:
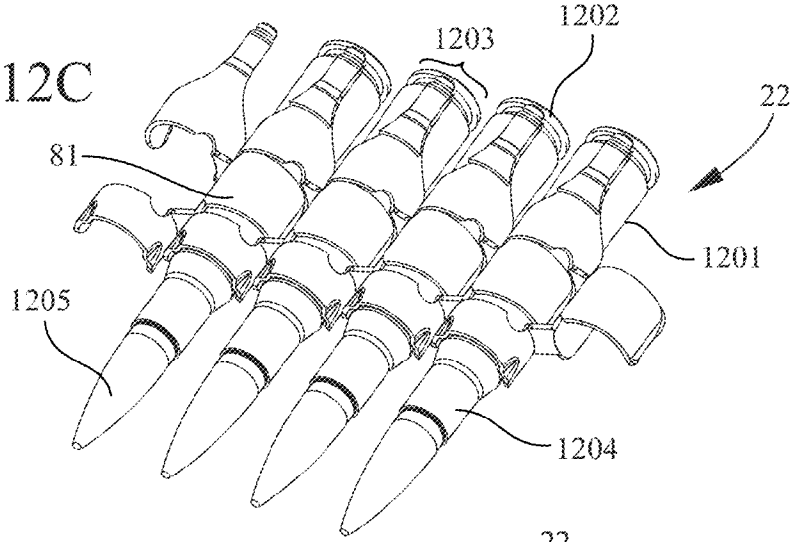
Figure 12D:
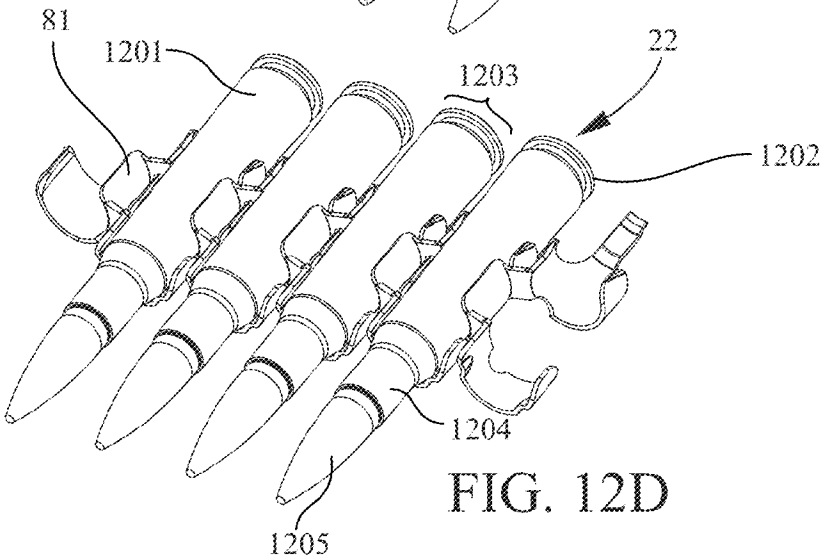

In contrast, the ammunition linking system depicted in FIGS. 12E and 12F is compatible with the weapon 200 depicted in FIG. 12 but not with weapon 1 of FIG. 1. The closed-end links 58 which couple the cartridges 22 wrap around the full circumference of the case 1201 and neck 1204 and close in loops about themselves. The cartridges 22 in the closed-end links 58 must be removed by first pulling the rim 1202 rearward to dislodge cartridge 22 from the belt of links 58.

FIG. 12 is an isometric view of an embodiment of a reciprocally-cycled, externally-operated weapon 200. FIGS. 12A and 12B show the weapon 200 coupled to the ammunition feed system. The modular, active magazine 2A is captured by the track 21. Magazine 2A includes a housing 226. Fixed to housing 226 is an ammunition indexing mechanism, such as a rotating sprocket 55. Sprocket 55 rotates about an axis 228. It suffices here to illustrate the relative positions of several key components of magazine 2A with respect to the working components of the weapon 200.

Figure 13A:
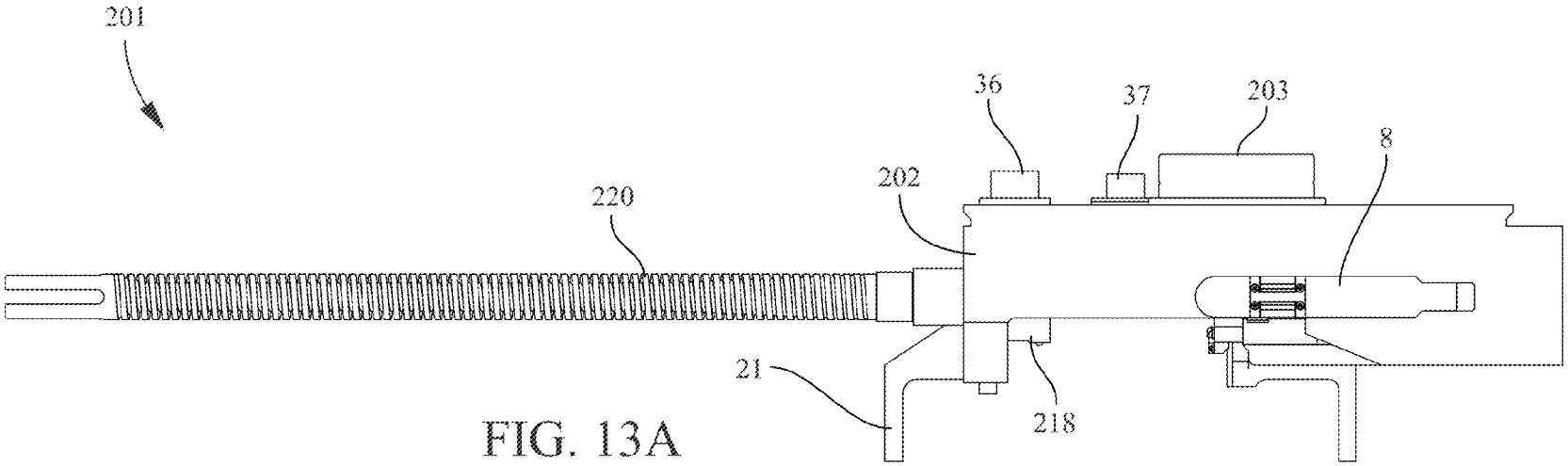
FIGS. 13A and 13B are top and open-side views of the weapon of FIG. 12 when it is in the full recoil position.
Figure 13B:
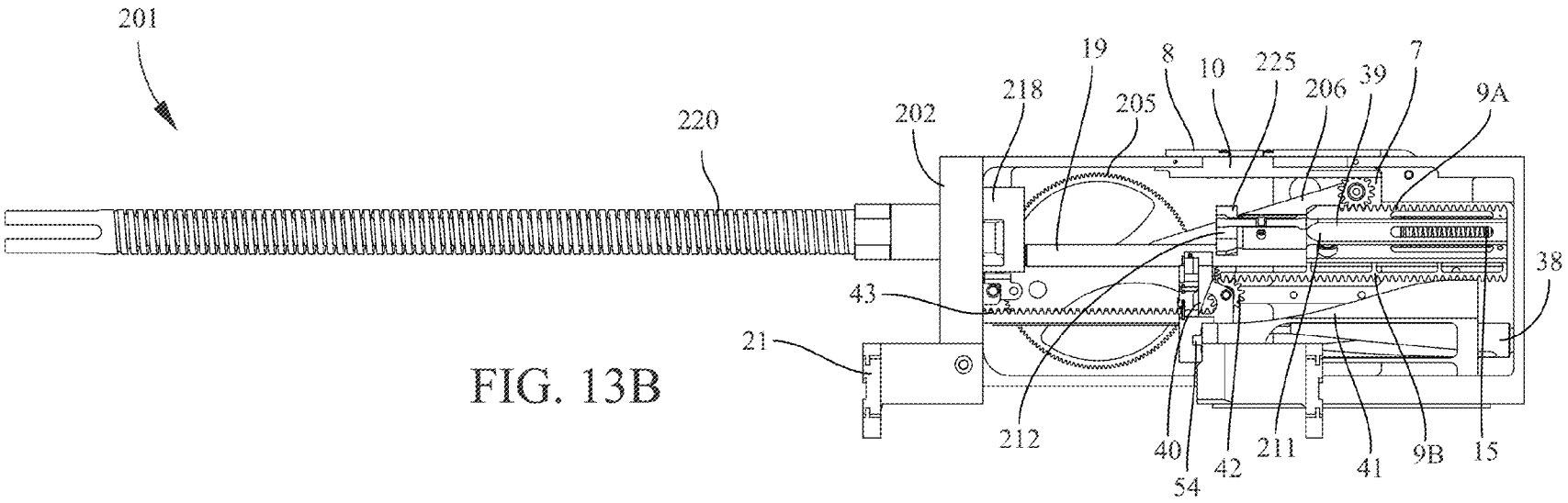
Figure 14:
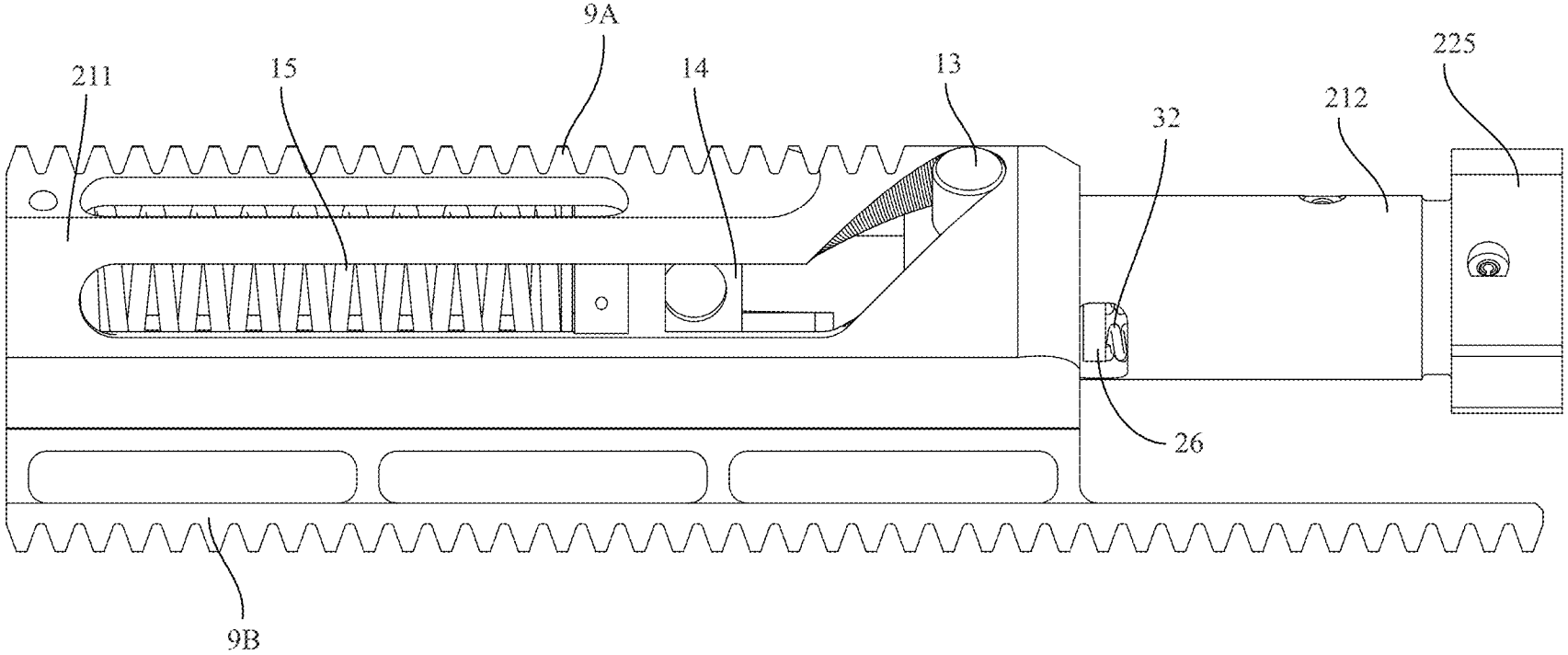
FIG. 14 is a side view of a bolt carrier with a bolt subassembly for use in the weapon of FIG. 12.

FIGS. 13A and 13B are top and side views, respectively, of the weapon 200 when the bolt carrier 211 is in the full recoil position. Compared to weapon 1, weapon 200 includes additional novel equipment and operation cycles that allow it to process ammunition which is chained together using either push-through type, open-ended links 81 or closed-end links 58. The weapon 200 does not require any parts modification or replacement to switch between the two ammunition types. Within the receiver 202 are the bolt carrier 211 and extractor body 40. The bolt carrier 211 and extractor 40 translate fore and aft at equal speeds but opposite directions within the receiver 202, thereby enabling the weapon 200 to cycle ammunition. Also within the receiver 202 is the fixed lifting cam 41 and power take-off tube 38. The power take-off tube 38 is centered around and free to rotate about an axis parallel to the gun barrel 220. The bolt carrier 211 is similar in construction and operation to the bolt carrier 11 shown in FIGS. 2C and 2D. But, bolt carrier 211 contains an additional component, namely the lower translating rack 9B shown in FIG. 14.

Figure 15A:
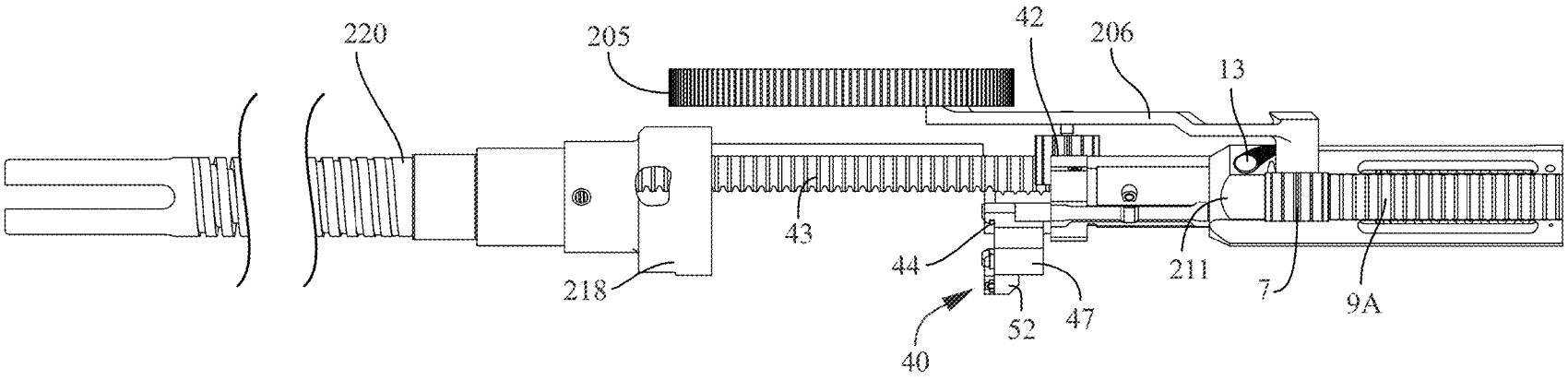
FIGS. 15A and 15B are top and side views, respectively, of some important components of the operating cycle of the weapon in FIG. 12, when they are positioned in full recoil (open bolt) position.
Figure 15B:
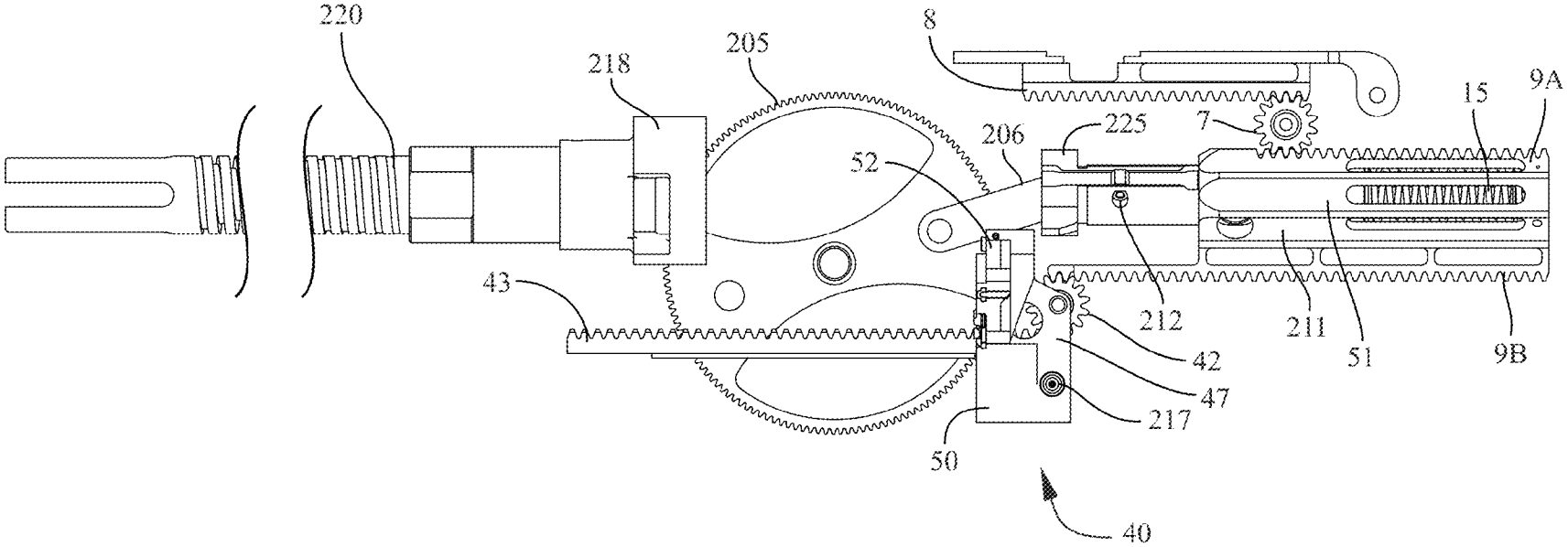
Figure 16A:
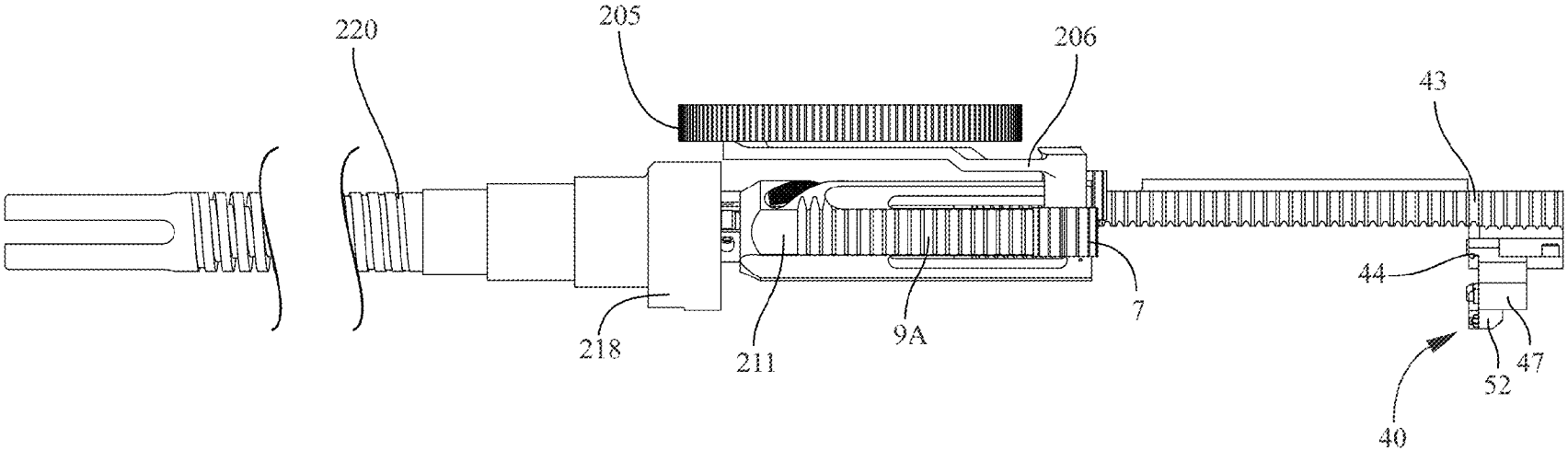
FIGS. 16A and 16B are top and side views, respectively, of some important components of the operating cycle of the weapon in FIG. 12, when they are positioned in full counter-recoil (closed bolt) position.
Figure 16B:
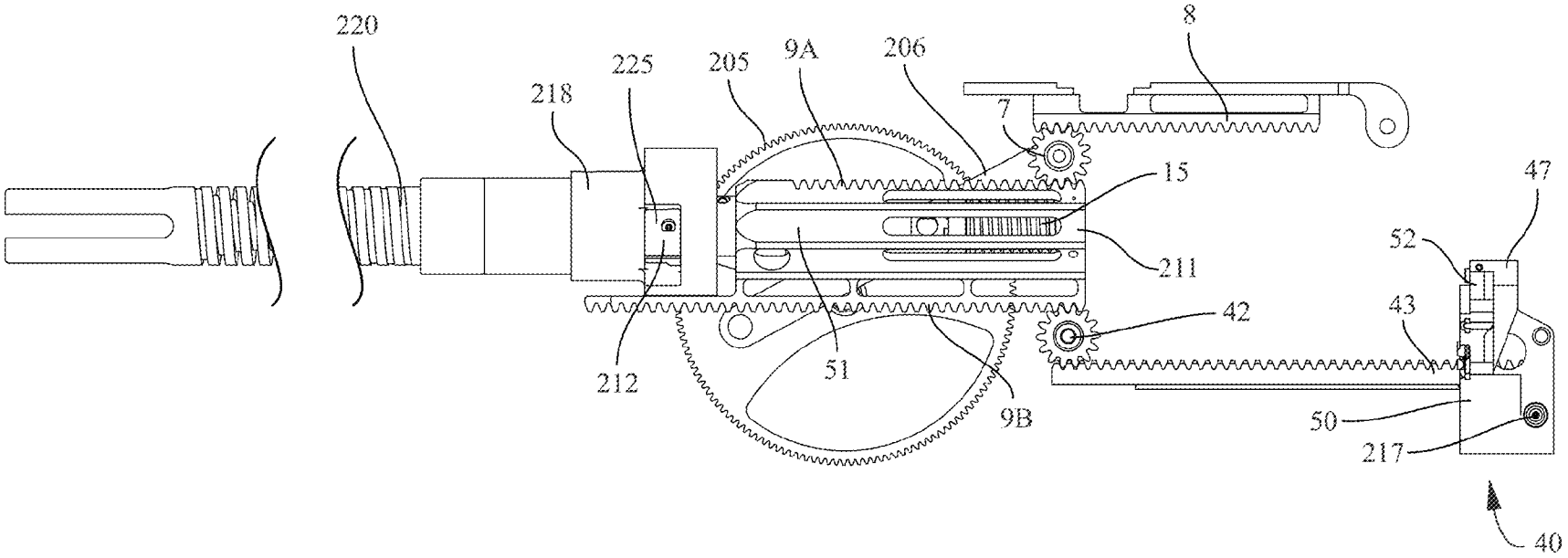
Figure 17A:
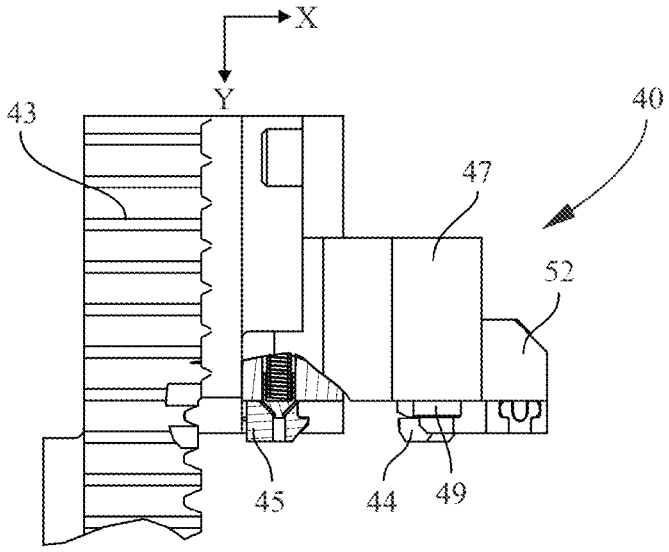
FIGS. 17A thru 17D show the extractor body assembly of the weapon in FIG. 12 in a series of orthographic projections.
Figure 17B:
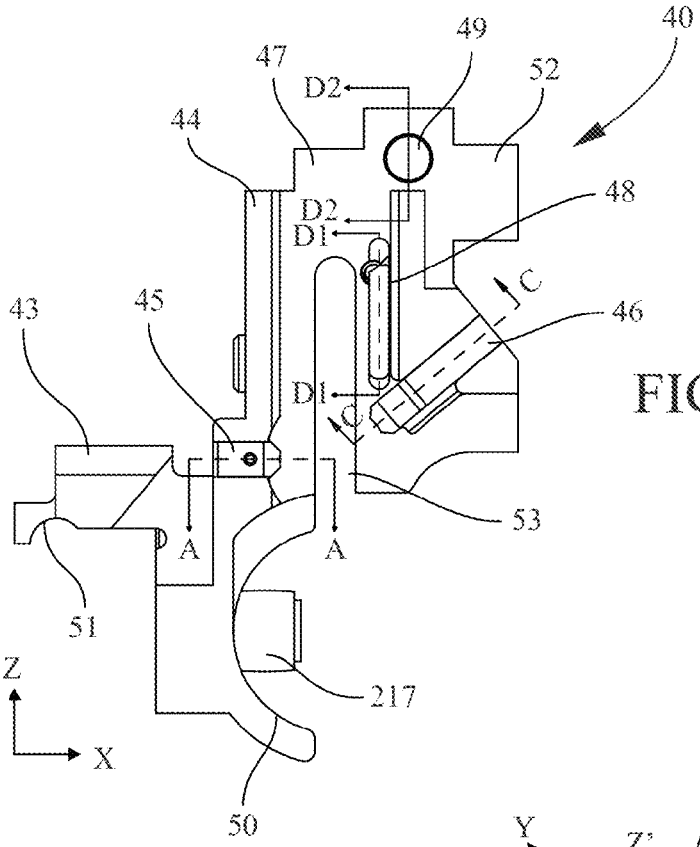
Figure 17C:
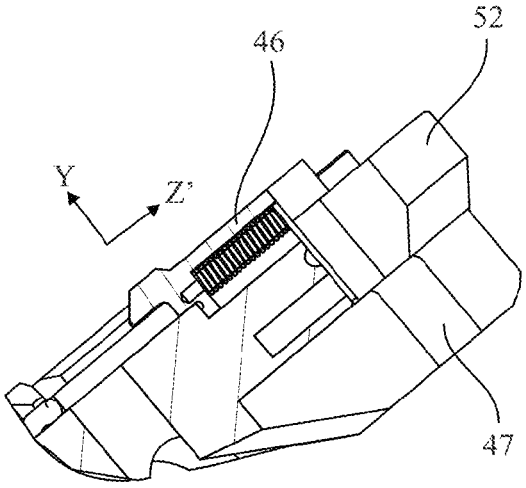
Figure 17D:
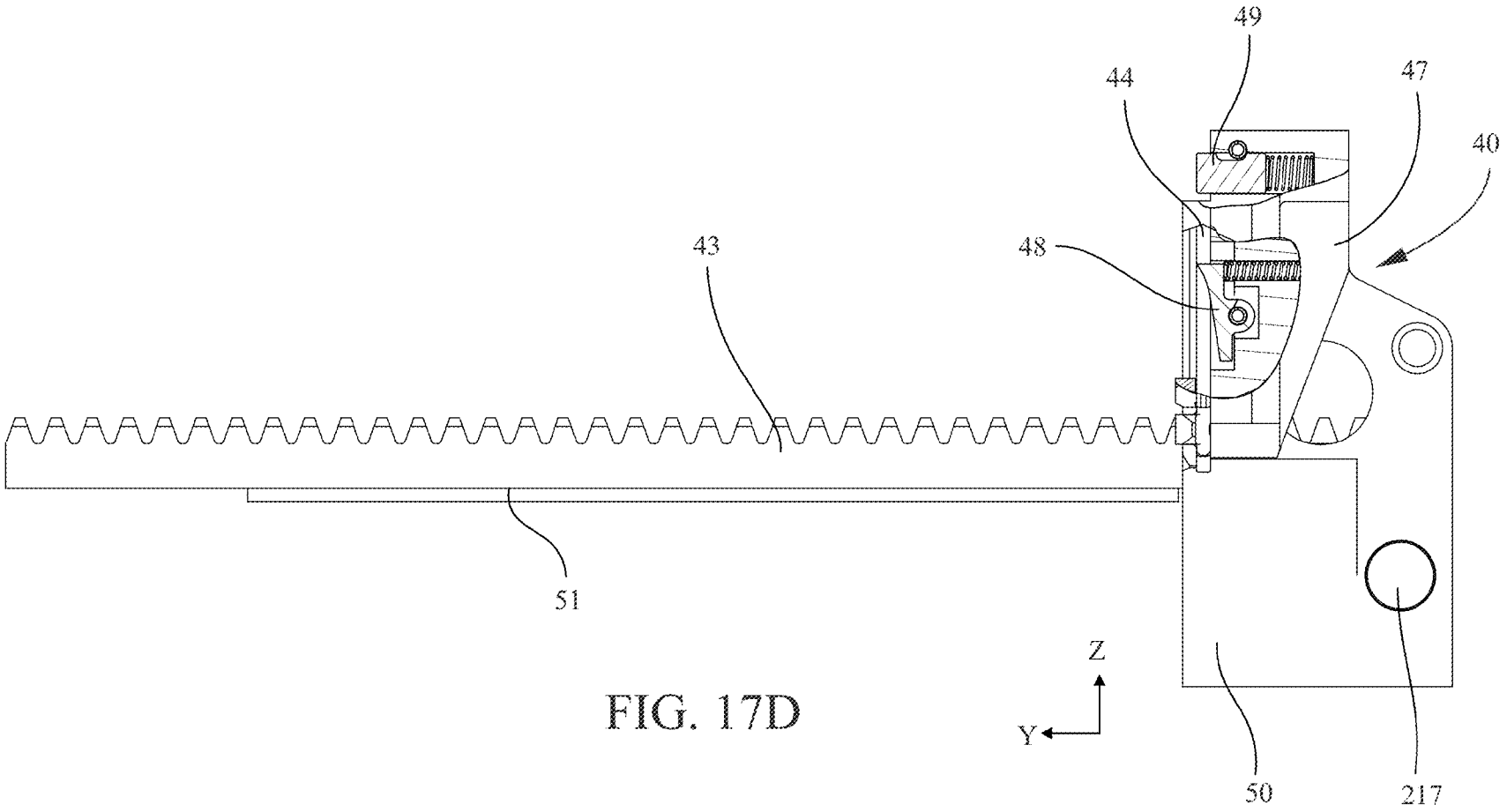

FIGS. 15A and 15B are top and side views, respectively, of the major moving components of the operating cycle. In FIGS. 15A and 15B, the bolt carrier 211 is in full recoil position. FIGS. 16A and 16B are top and side views, respectively, showing the components at the full counter-recoil position. Weapon 200 utilizes a drive-train comprised of a slider-crank mechanism with rack and pinion stroke multiplier, similar to the weapon 1 of FIG. 1, although this scheme need not be exclusive. The reciprocating motion between bolt carrier 211 and extractor body 40 is illustrated here. By means of the rack and pinion interface of the lower translating rack 9B, stationary pinion 42 and the extractor rack 43, the linear motion of the bolt carrier 211 creates movement of the extractor body 40 that is equal in speed but opposite in direction to that of the bolt carrier 211. The extractor rack 43 is rigidly fixed to the extractor body 40. As the bolt carrier 211 moves forward towards the barrel 220 and barrel extension 218, the extractor body 40 moves rearward at the same speed. The two members, bolt carrier 211 and extractor body 40, clear each other as they pass.

Figure 18:
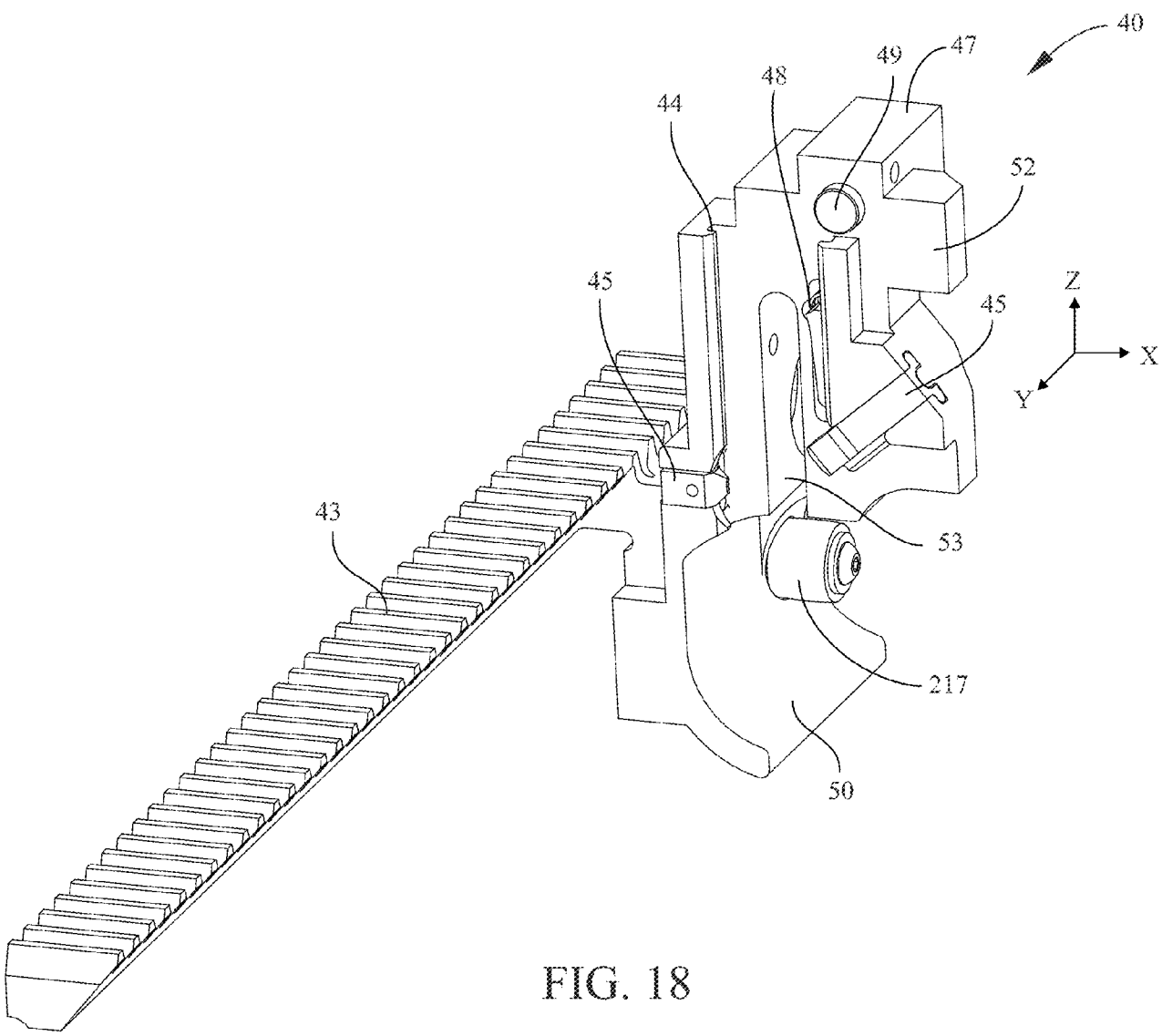
FIG. 18 is an isometric front view of the extractor body assembly.

FIGS. 17A thru 17D show the extractor body 40 in a series of orthographic projections. FIG. 18 is an isometric relief of the extractor body assembly. Extractor body 40 is primarily responsible for the delinking and manipulation of belted cartridges residing in the modular and removable magazine 2A. Extractor body 40 places a delinked cartridge into a position where it can be acted upon by the primary operating group to fire projectile 1205 down the barrel 220. The extractor body 40 is built around the extractor body frame 47. Affixed to frame 47 are the extractor rack 43 and power take off cam-pin 217. Integral to the extractor body frame 47 is the T-slot 44. The solid groove or T-slot 44 provides a channel for the rim 1202 of a cartridge 22 to slide vertically within. When engaged in the T-slot 44, a cartridge 22 can freely move up or down (along the Z-axis as defined in FIGS. 17B, 17D and 18) but not left or right (as defined by the X-axis in FIGS. 17A, 17B and 18). The lifting slot 53 defines the center plane of the extractor body 40 and accommodates movement over a lifting cam 41 (FIG. 12) during the cycle. Also integral to the extractor body frame 47 is the power take off tube bearing surface 50. This surface 50 and the guide-rod bearing surface 51 (FIG. 16B) constrain the extractor body 40 to its single degree of freedom within the receiver 202.

The short extractor 45 and long extractor 46 are movable within but captive to the extractor body frame 47. The short extractor 45 can translate or slide towards and away from the center of the lifting slot 53 parallel to the X-axis as defined in FIGS. 17A, 17B, and 18. The short extractor 45 is confined within a mating dovetail groove in the extractor body frame 47. Likewise, the long extractor 46 translates inward and outward within its own slot, parallel to the Z'-axis, which is identified in FIG. 17C. The flat rearward facing surfaces of both extractors 45, 46 mimic and form an extension to geometry of the solid T-slot 44. The extractors 45, 46 are spring biased inward toward the lifting slot 53 but are defeated when the extractor body 40 impacts the rim 1202 of a cartridge. The cartridge rim 1202 is presented at roughly the intersection of the two vectors created by the extractors' 45, 46 degrees of freedom. Lead-in angles on the forward facing side of the extractors 45, 46 facilitate capture of rim 1202. At this lower cartridge position, the extractors 45, 46 snap over the cartridge rim 1202. The extractors' flat rearward side prevents the cartridge 22 from any further relative motion forward.

The cartridge 22 is free to slide within the extractor T-Slot 44. The upper limit of translation is the cartridge upper position. The anti-backup pawl 48 is spring biased and pivots about a point in the extractor body frame 47. It is defeated by a cartridge 22 rising up through the T-slot 44. The anti-backup pawl 48 is angled such that a cartridge cannot defeat it while attempting to lower through the T-Slot 44, effectively creating a one-way gate and the lower limit of the cartridge upper position. The cartridge retainer 49 likewise defines the upper most limit for the cartridge upper position. The cartridge retainer 49 and anti-back up pawl 48 are spring-biased parallel to the Y-axis (as defined in FIGS. 17A, 17C, 17D, and 18). The cartridge retainer 49 and anti-back up pawl 48 prevent any significant vertical motion of the cartridge 22 in this upper position while the T-slot 44 is still limiting lateral motion and axial motion.

FIGS. 19A thru 19D are orthographic projections of the extractor body 40 and other select components that enable cartridge delinking and manipulation from a belted ammunition supply. In FIGS. 19A-D, the extractor body 40 begins to delink a belted cartridge. The extractor body 40 is in the fully forward position and the bolt carrier 211 is at full recoil. The relevant components of magazine 2A in this particular embodiment are the sprocket 55 and the belted ammunition secured with the closed-end links 58 and contained in the magazine 2A. The sprocket 55 is housed in the detachable magazine 2A and utilizes a gear-like rotary motion to pull a chain of linked ammunition up from a storage compartment and into the proximity of the extractor body 40. The sprocket 55 in this embodiment may be substituted by any other manner of cartridge indexing method from storage.

Figure 19A:
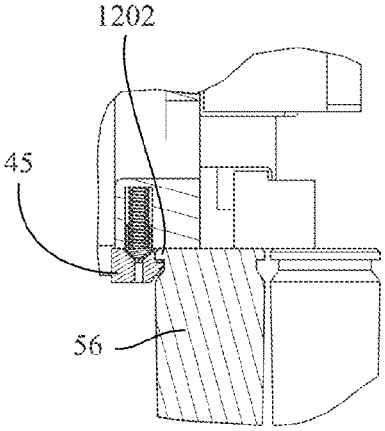
FIGS. 19A thru 19D are orthographic projections of the extractor body as it begins to delink a belted cartridge. Other select components that enable belt positioning and cartridge manipulation are depicted as well.
Figure 19B:
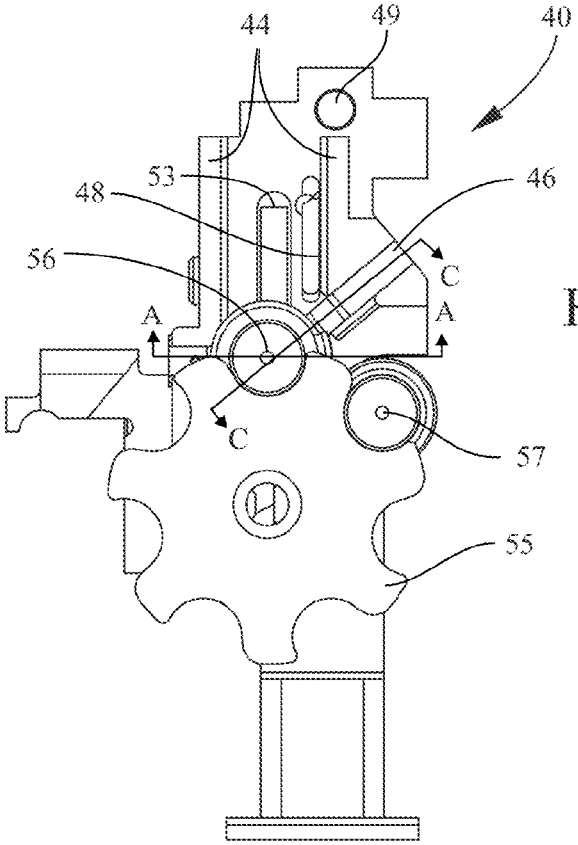
Figure 19C:
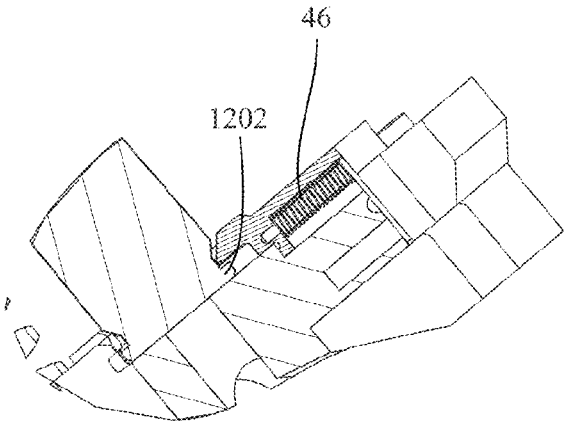
Figure 19D:
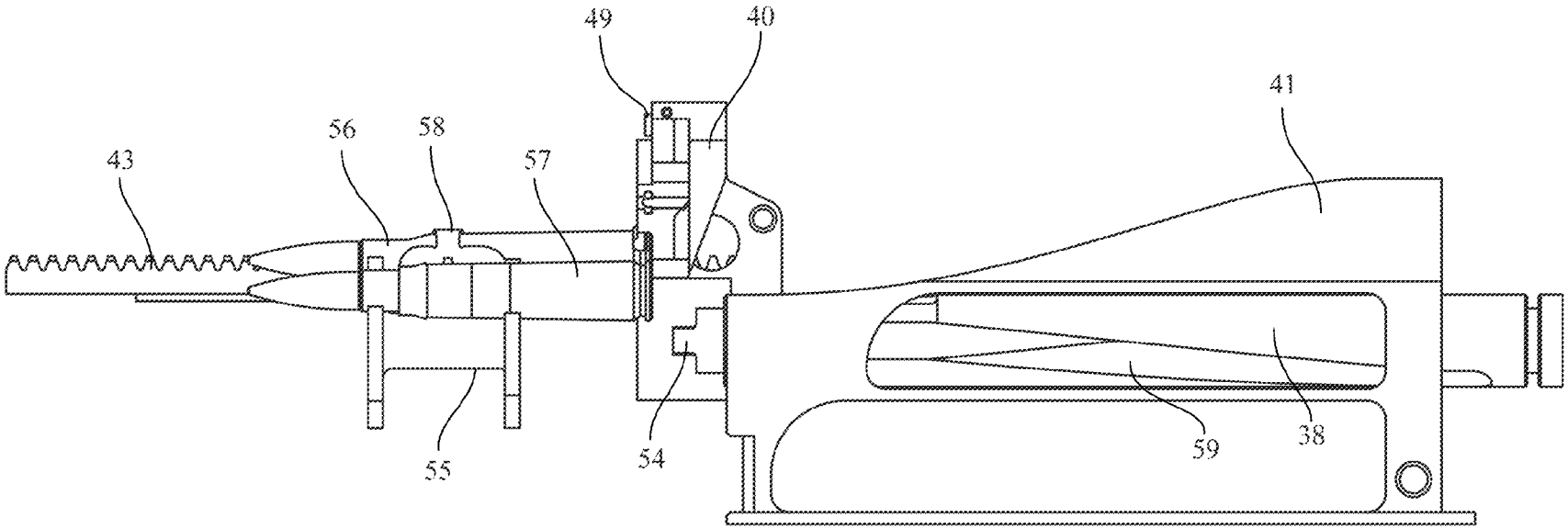

In FIGS. 19A-D, the extractor body 40 has impacted the extraction positioned cartridge 56 and the long extractor 46 and short extractor 45 have snapped over the rim 1202 of its cartridge case, as can be seen in FIGS. 19A and 19C. Also shown is the power take off tube 38 into which the power take off tube cam-slot 59 is machined. In the embodiment shown, the extractor body 40 is partially supported by the contact between the power take off tube bearing surface 50 (FIG. 18) and power take off tube 38, but may be supported in some other manner.

As the weapon cycle progresses from this recoil position into counter-recoil, the extraction positioned cartridge 56, gripped at the rim 1202 by the short extractor 45 and long extractor 46, is so too pulled rearward. It is extracted from the link 58 and pulled out of the magazine 2A into the weapon receiver 202. While constrained by the long extractor 46 and the short extractor 45 in the lower position, the cartridge 22 is pulled along the gradually sloping surface of the lifting cam 41 eventually transitioning to the solid T-slot 44 as it moves upward in the extractor body 40. The lifting cam 41 is located such that the lifting slot 53 of the extractor body 40 passes over it, imparting a controlled upward vector to the cartridge 22. The cartridge 22 defeats the anti-backup pawl 48 on the way up and is stopped from exiting the top of the extractor body 40 by the cartridge retainer 49.

Figure 20A:
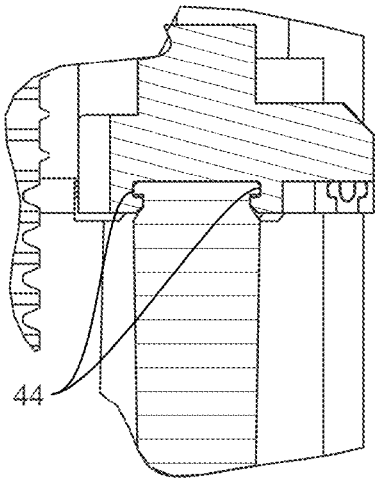
FIGS. 20A thru 20C are orthographic projections of the extractor body and select components at the full counter-recoil position of the weapon of FIG. 12.
Figure 20B:
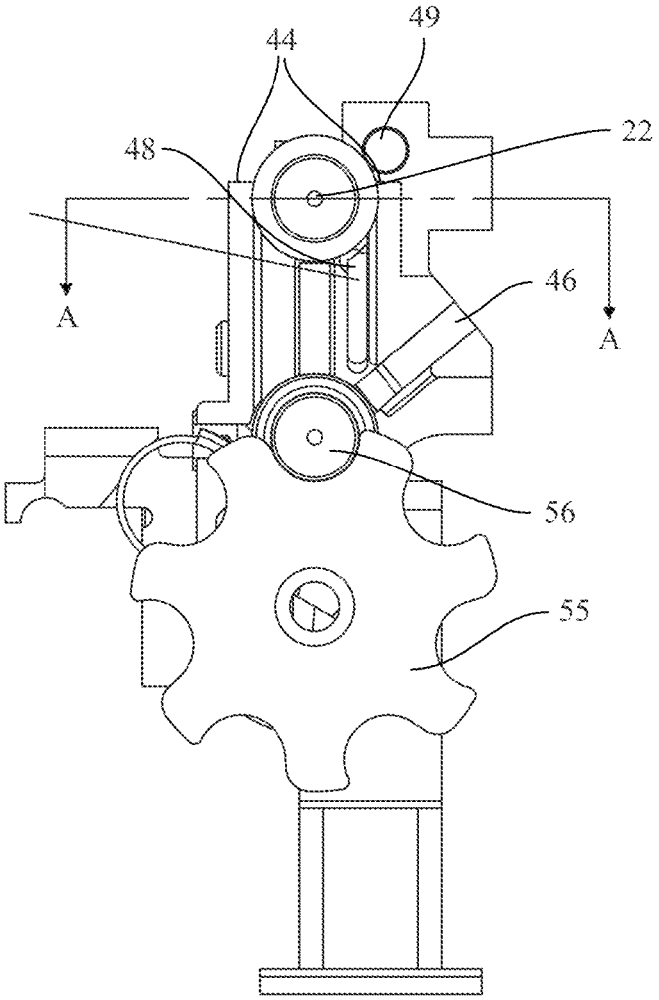
Figure 20C:
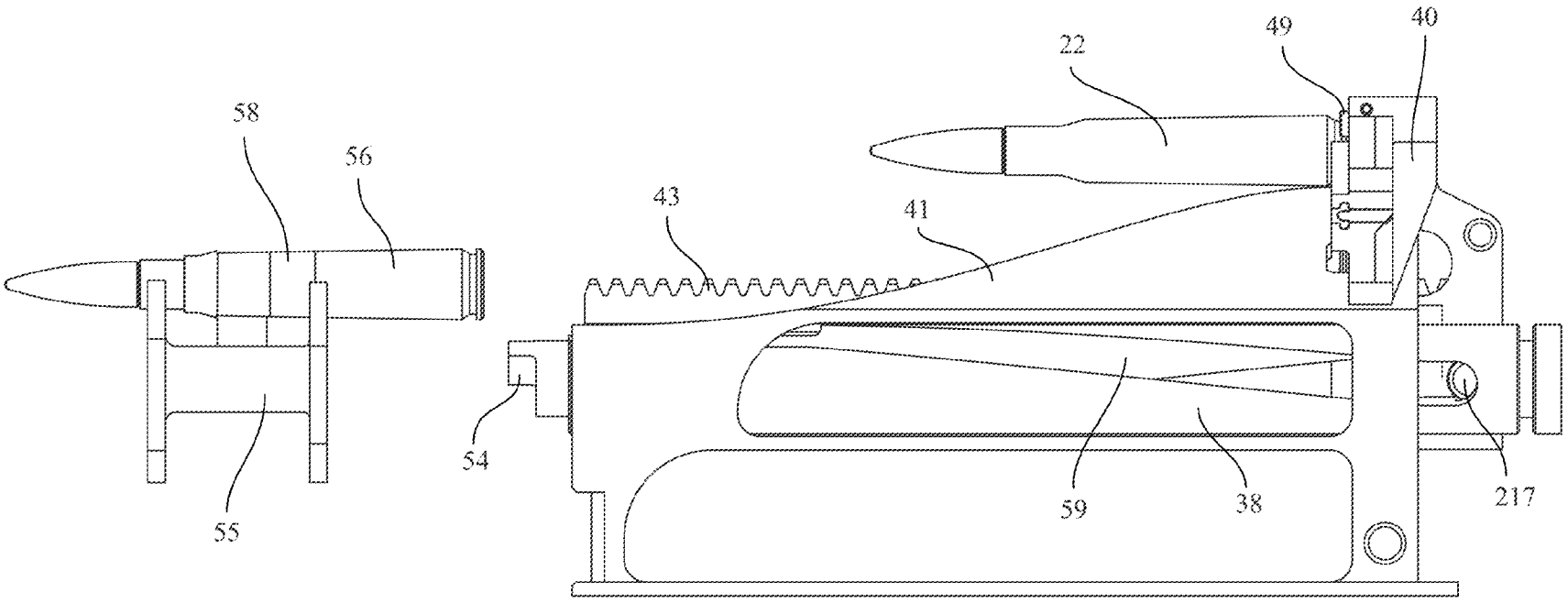

In FIGS. 20A thru 20C, the weapon components are at the full counter-recoil position. FIGS. 20A-C show how the cartridge 22 is trapped in the upper cartridge position. Then, the cycle continues, moving again towards the full recoil position of the bolt carrier 211. The ammunition indexing action, described below, occurs as the extractor body 40 is moving rearward and the bolt carrier 211 is moving forward in counter recoil. The power take off cam pin 217, located on the power take off tube bearing surface 50, is situated so as to seat within the power take off tube cam slot 59. Interaction of pin 217 and slot 59 causes the power take off tube 38 to rotate as the power take off cam-pin 217 translates linearly along slot 59. Through the interaction of the power take off tube interface 54 with structural components of the magazine 2A, the power take off cam tube 38 likewise imparts rotation to the sprocket 55. In this embodiment, the sprocket 55 rotates a cartridge 22 from the standby cartridge position 57 (FIG. 19D) into the extraction positioned cartridge location 56. When the extractor body 40 returns, location 56 is where the extractor body 40 will again impact a cartridge. Thus, the rearward motion of the extractor body 40 positions the next round in the magazine. The power take off tube interface 54 may also interact with any manner of magazine mechanisms that will serve to advance a cartridge from the standby cartridge position 57 to the extraction positioned cartridge location 56.

Figure 21:
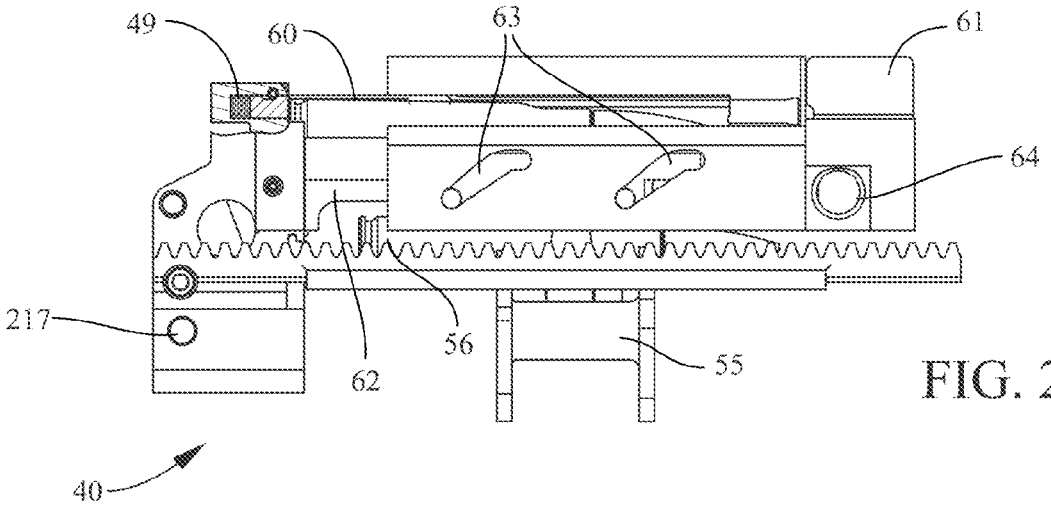
FIGS. 21 thru 23 show the magazine feed box in its position relative to the sprocket and belt in the magazine during a sequence of events that leads to final cartridge positioning to a delinked, feed-ready state.
Figure 22:
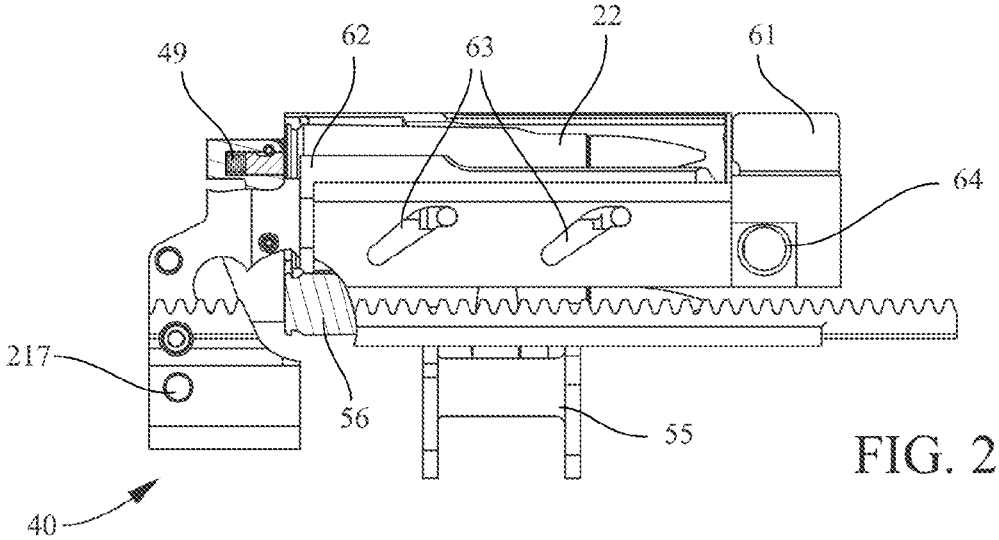
Figure 23:
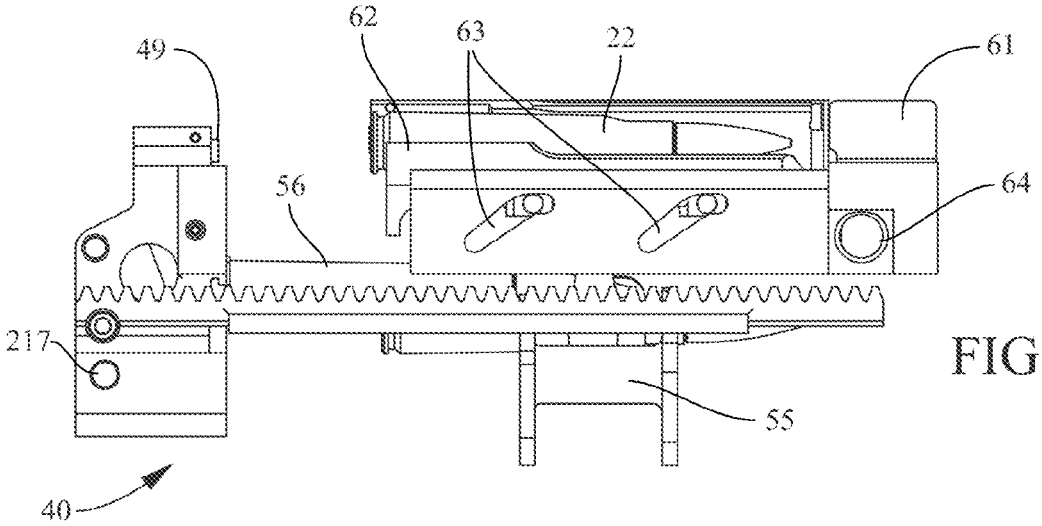

Referring to FIGS. 21-23, the magazine feed box 61 is another relevant component of the magazine 2A as it relates to the reciprocally cycled, externally actuated weapon 200. In this embodiment, the magazine feed box 61 is located above the sprocket 55 (or other relevant ammunition handling mechanism) and is integral to the magazine 2A. FIGS. 21 thru 23 show the magazine feed box 61 in its position relative to the sprocket 55 and belt in the magazine 2A, with additional magazine structure omitted. FIG. 21 depicts the period of weapon cycle when the extractor body 40 has locked a cartridge 22 into the upper position of the extractor body 40 and the bolt carrier 211 has begun to recoil. The extractor body 40 moves forward while the bolt carrier 211 moves to the rear, open bolt position.

A short distance before encountering the next extraction positioned cartridge 56 in the sprocket, the lifting boss 52 (FIG. 18) and front plane of the extractor body 40 first make contact with components of the magazine feed box 61. The magazine feed box 61 is static with respect to the magazine 2A and receiver 202 and contains the follower 62. The follower 62 is movable in the magazine feed box 61. At the portion of the cycle depicted in FIG. 21, the follower 62 is in the lower follower position. The follower 62 is spring biased into the lower follower position and has not yet moved within the magazine feed box 61.

As the extractor body 40 approaches the feed box 61, the cartridge 22 it contains is in-line with a pocket within the follower 62, which is contoured to securely contain a de-linked round of ammunition. When the front plane of the extractor body 40 contacts the rear surface of the follower 62, the cartridge 22 is fully contained within the follower 62. Simultaneously, the cartridge retainer 49 is being fully depressed by the follower rear surface, as seen in FIG. 21. The fully depressed cartridge retainer 49 finally allows further upward motion of the cartridge 22 through the T-slot 44 and eventually out of the T-slot 44 completely, as is occurring in FIG. 22. The extractor body 40 is still moving forward and the lifting boss 52, which is still in contact with the follower 62, starts to push the follower 62 against its spring bias.

The follower 62 (FIGS. 24 and 25) contains two follower cam pins 70 which are free to ride upward and forward within the magazine feed box follower cams 63. With the cartridge retainer 49 still depressed, the formerly constrained cartridge 22, which is now the follower deposited cartridge 60 (FIG. 21), moves forward and upward with the follower 62 as the extractor body 40 approaches its full forward stroke. At this point the extractor body 40 has also latched onto the next extraction positioned cartridge 56 in the sprocket 55. The vertical throw of the follower 62 is such that it lifts the cartridge clear of the solid T slot 44. Cartridge 22 and extractor body 40 are now separated.

The cycle continues to counter recoil of the bolt carrier 211 with the extractor body 40 moving rearward and bolt carrier 211 moving forward, as depicted in FIG. 23. The follower 62 is still spring biased rearward and downward but locked in the upper follower position for the time being. The feed-ready cartridge 22 is now in position to be stripped from the follower 62 by the bolt subassembly 212, being carried by bolt carrier 211, and pushed into the barrel and fired in the same manner as the reciprocally cycled, externally actuated weapon 1 of FIG. 1. The extractor body 40 has at this point also extracted another cartridge 22 from its linked position in the belted ammunition supply and the cycle continues.

Figure 24:
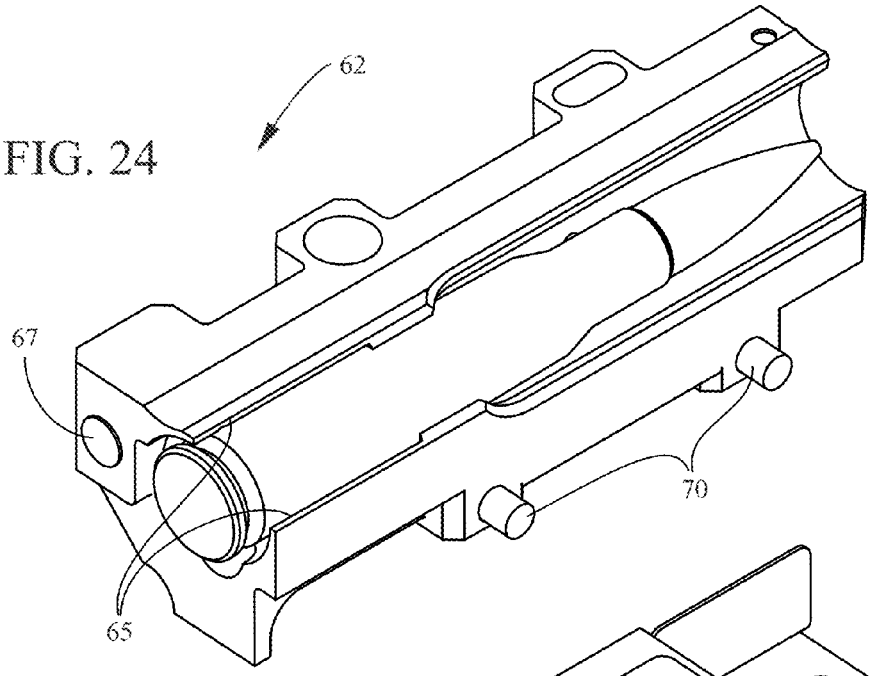
FIG. 24 is an isometric view of the follower component of magazine feed box with a delinked cartridge contained therein.
Figure 25:
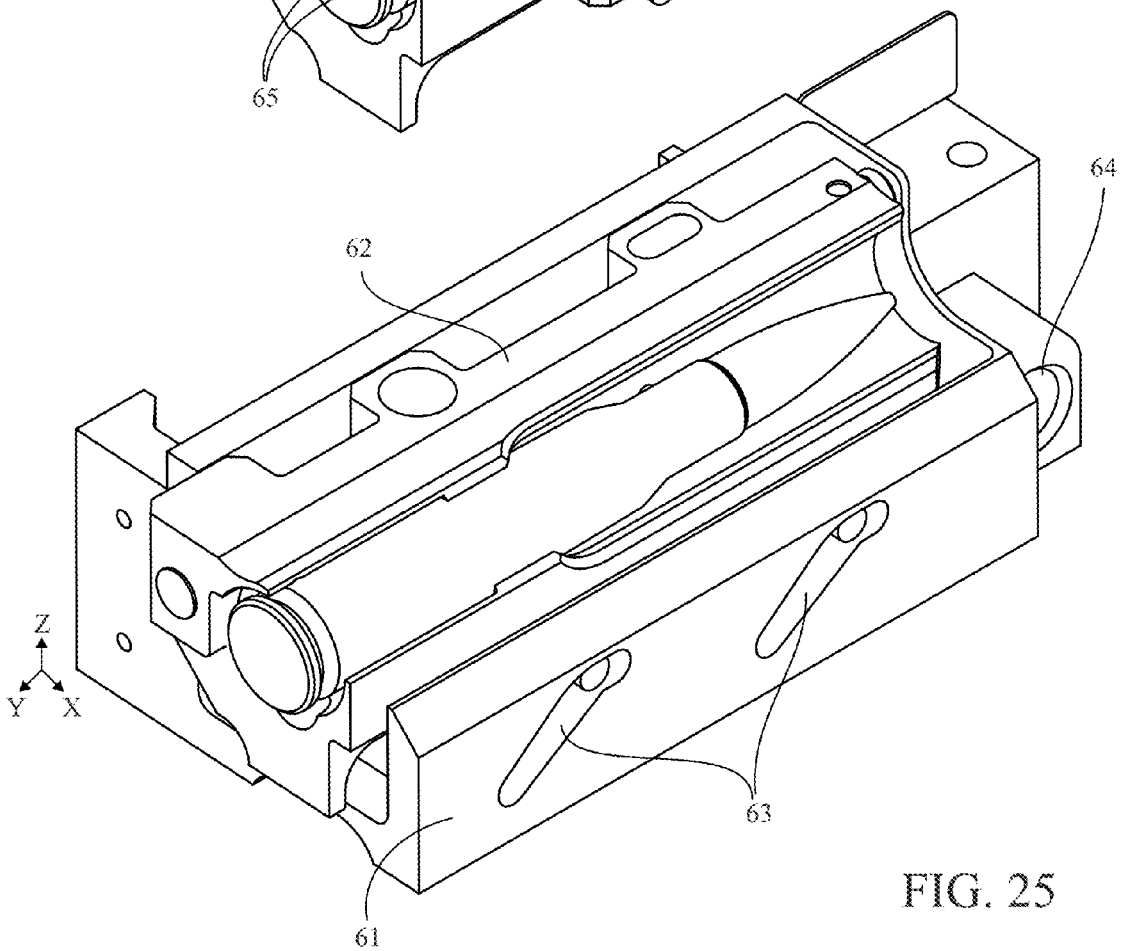
FIG. 25 is an isometric view of the follower of FIG. 24 contained within a magazine feed box.

FIG. 24 is an isometric view of the unassembled follower 62 with follower deposited cartridge 60. FIG. 25 shows follower 62 assembled and contained within the magazine feed box 61. FIGS. 26A thru 26D depict in greater detail the magazine feed box 61, follower 62, and feed-ready cartridge 22. FIGS. 26A-D are orthographic projections of the magazine feed box 61 assembly with a feed-ready cartridge 22 during the end of the recoil stroke of the bolt carrier 211. In this locked upper position of the follower 62, the approaching bolt carrier 211 is able to push on the cartridge case head 1203 (FIG. 26B) with the stripping lug on the bolt 225 and hurry the cartridge 22 toward the barrel extension.

Figure 28A:
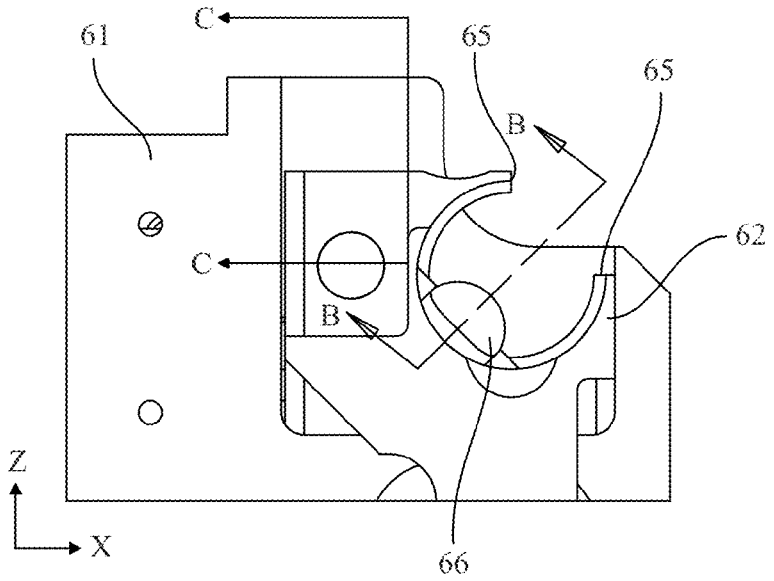
FIGS. 28A thru 28D are orthographic views that depict in greater detail the magazine feed box and follower after a cartridge has been stripped and fired from the weapon of FIG. 12.
Figure 28B:
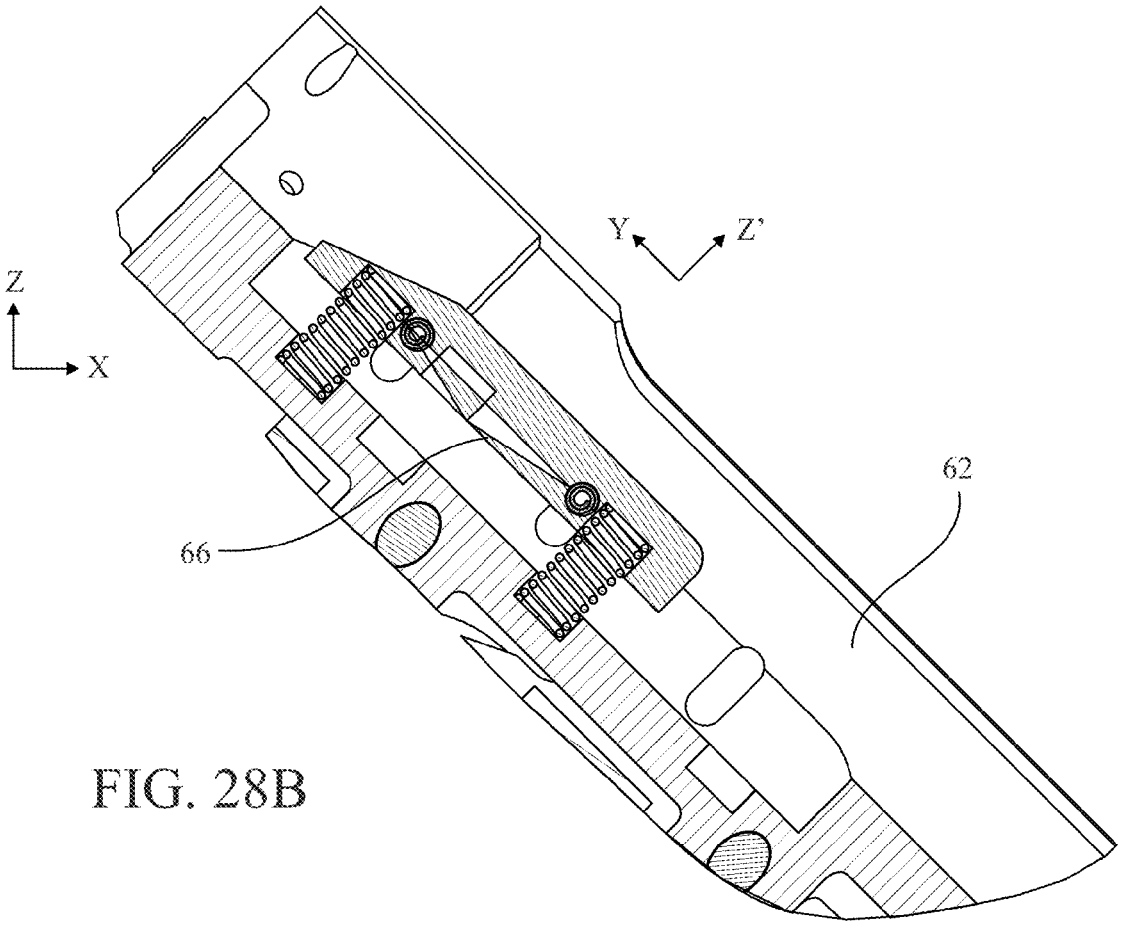
Figure 28C:
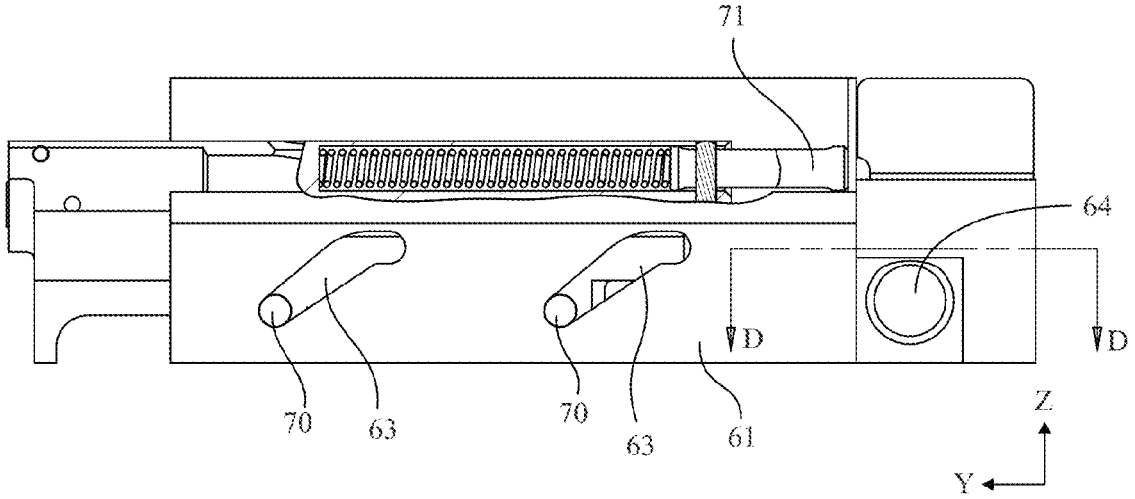
Figure 28D:
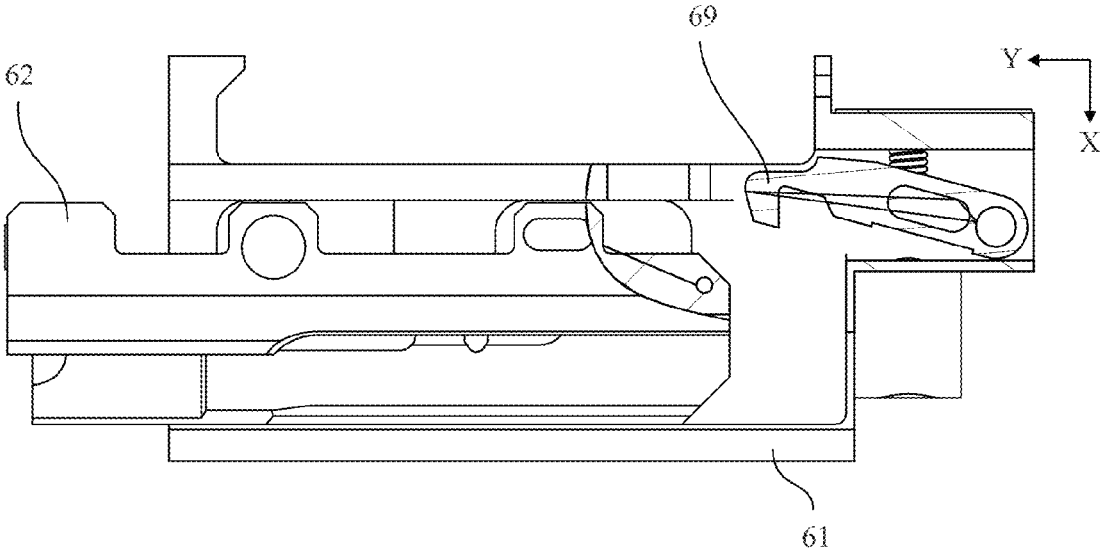
Figure 29:
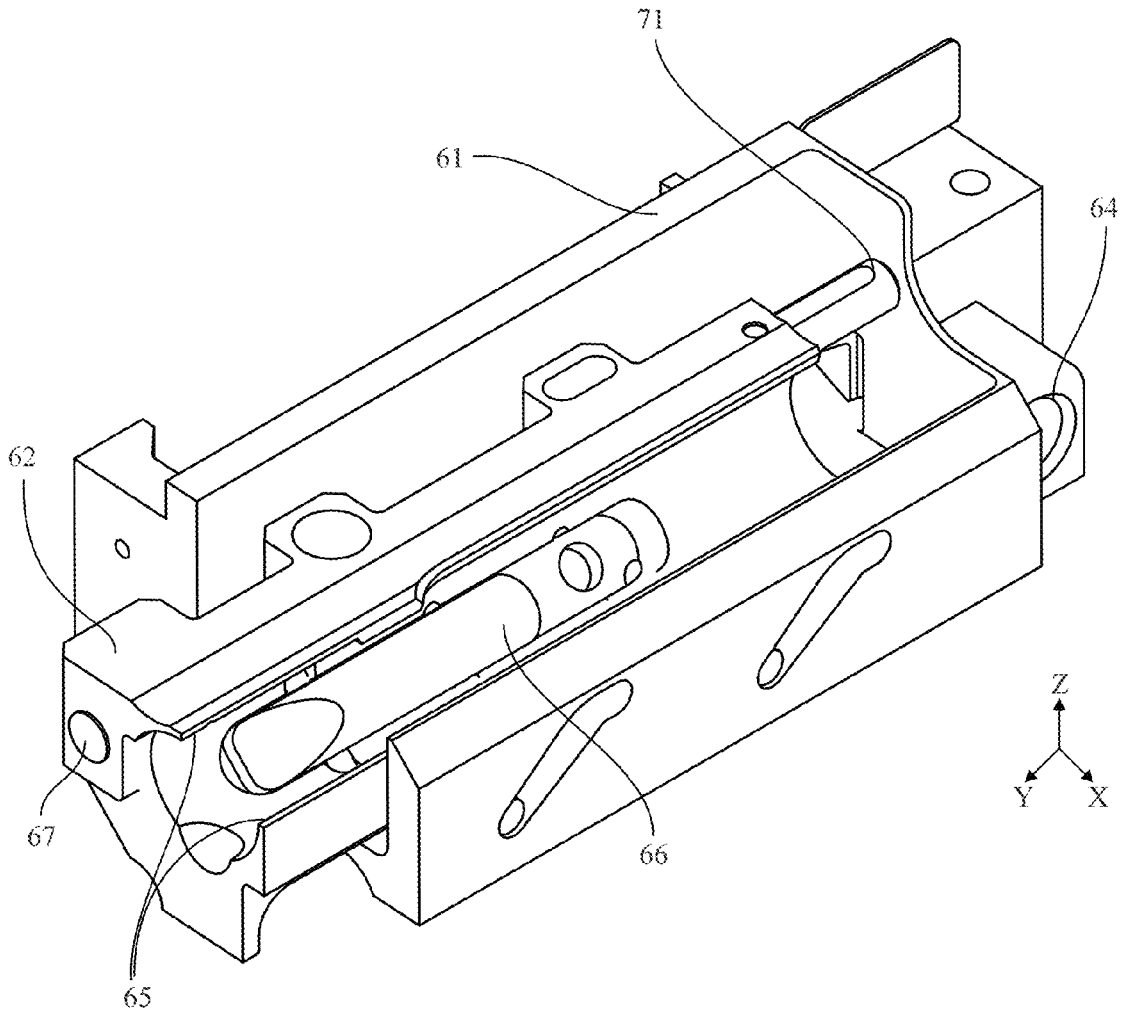
FIG. 29 is an isometric rear view of the follower as it is contained within the magazine feed box, after having been stripped of a cartridge and reset to its initial lowered position.

The follower 62 is fully constrained within the magazine feed box 61 structure except to slide upward and forward in the YZ plane as defined in FIGS. 28C and 29. The follower cams 63, which are integral to the magazine feed box 61, define the path taken by the follower cam pins 70. Within the follower 62, the follower return 71 is a spring-loaded plunger that biases the follower 62 rearward against the structure of the magazine feed box 61. The forward surface of the follower return 71 is free to slide vertically against the structure of box 61 as the follower 62 rises and falls.

The follower 62 further includes the follower sear surface 68 (FIG. 26C), which is machined integrally beneath. As the follower 62 is moved into the upper follower position by the extractor body 40, the follower sear surface 68 engages the follower release sear 69. The follower release sear 69 is spring biased to the position shown in FIG. 26C. The follower release sear 69 pivots within the magazine feed box 61 and catches the follower sear surface 68 as it passes, thereby preventing the follower 62 from any rearward or downward motion the follower return 71 would otherwise induce. The bumper 67 protrudes slightly from the rear surface of follower 62. Bumper 67 may be made of a shock absorbing polymer material to help cushion the impact with the extractor body lifting boss 52 during the lifting of the follower 62.

Figure 26A:
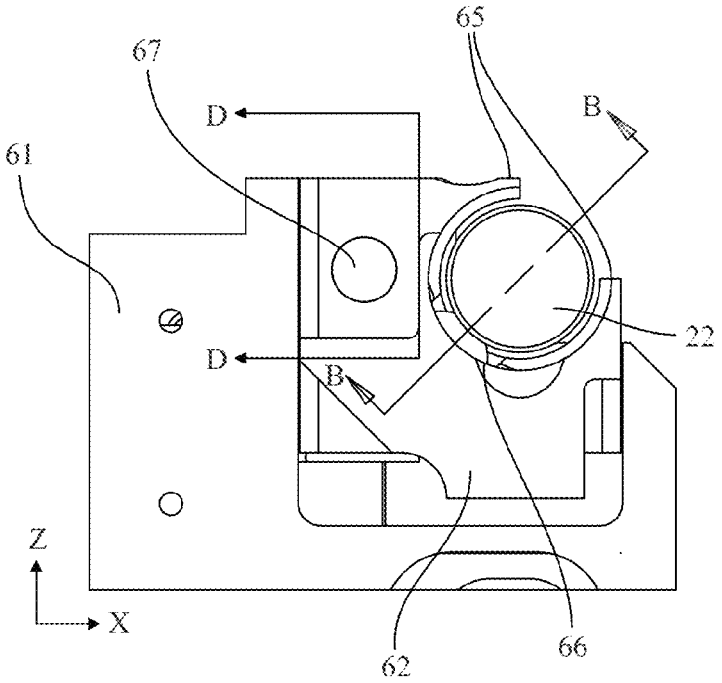
FIGS. 26A thru 26D are orthographic views of the magazine feed box, follower, and delinked feed-ready cartridge.
Figure 26B:
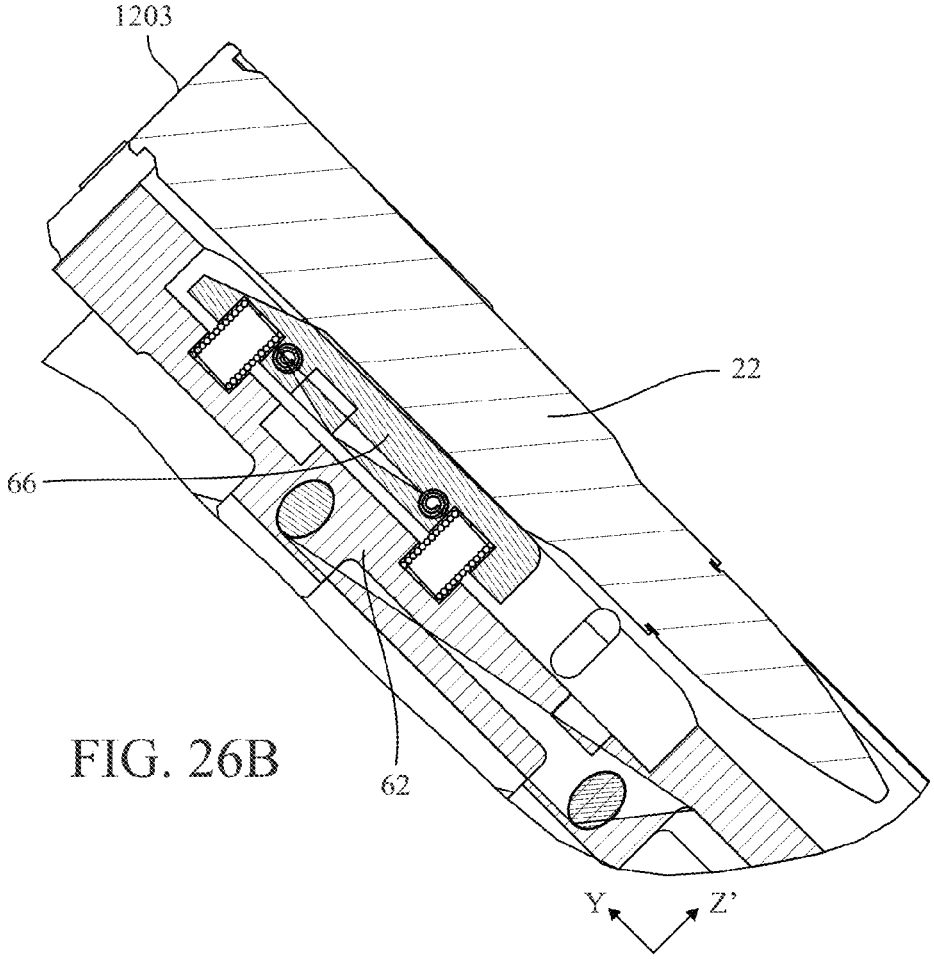
Figure 26C:
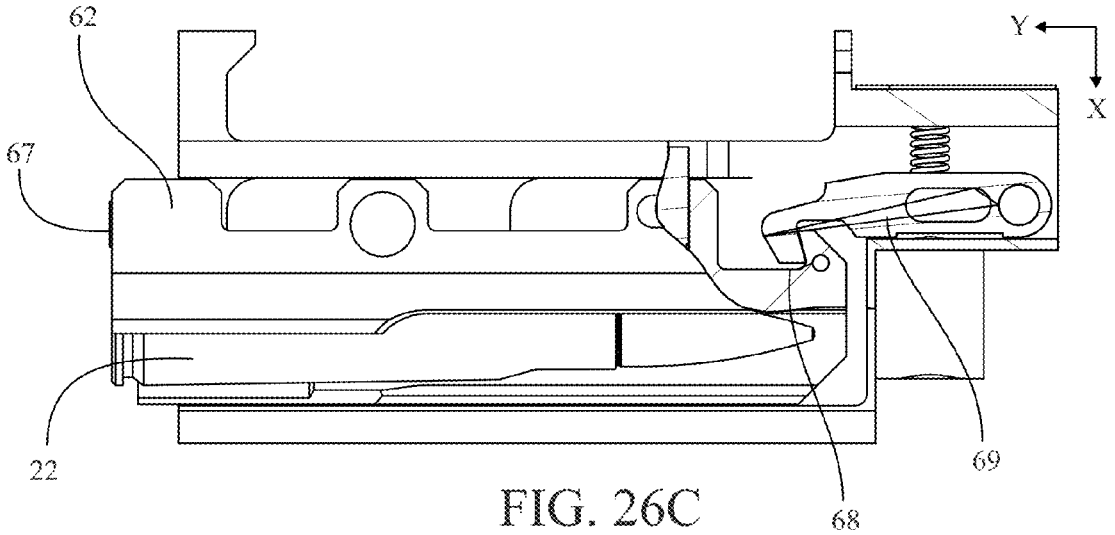
Figure 26D:
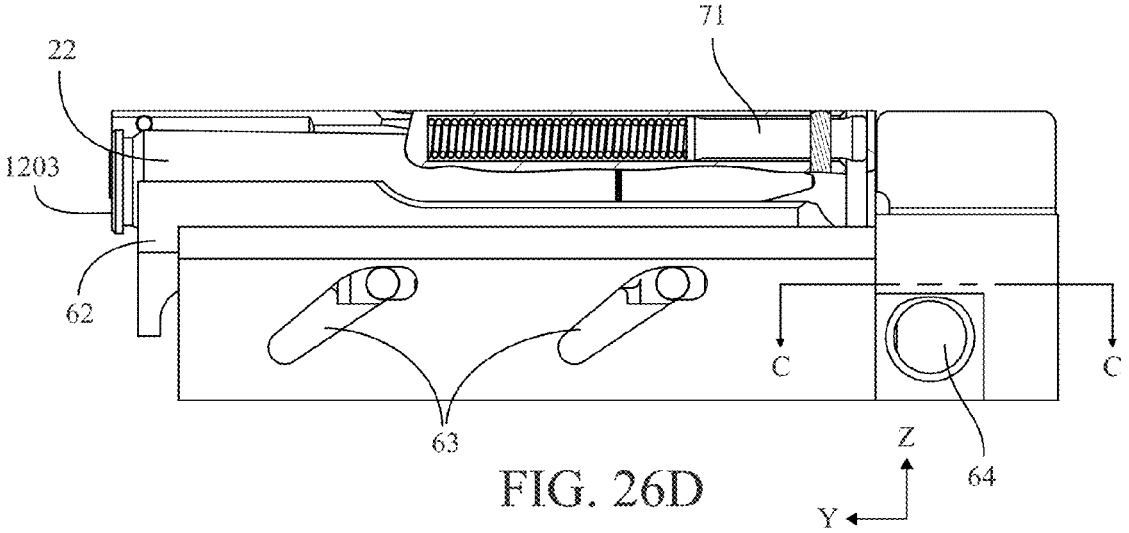

The feed ready cartridge 22 itself is positively secured within the follower 62 by the action of the sub-follower 66 that tightly biases the ammunition into the follower feed-lips 65 (FIG. 26A). The sub-follower 66 is contoured to the shape of the cartridge for gripping purposes. The sub-follower is recessed within the follower 62, as seen in FIG. 26B. The sub-follower 66 and feed lips 65 act like a conventional box magazine for a rifle, holding the de-linked cartridge 22 in place and maintaining positive control during stripping and feeding.

Figure 27:
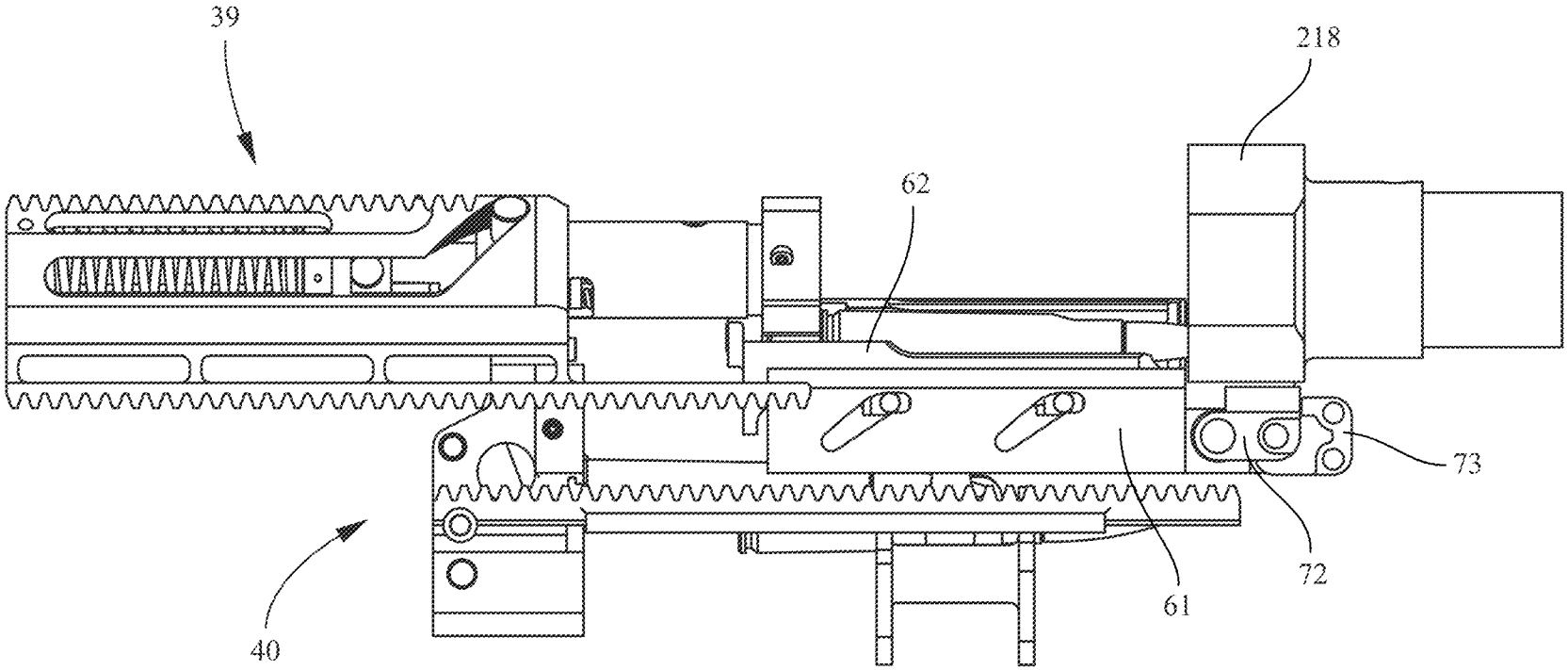
FIG. 27 is a side view showing the bolt carrier driving the stripping lug of the bolt assembly into the case head of a feed-ready cartridge from the follower into the barrel extension of the weapon depicted in FIG. 12.

The bolt carrier 211 is driving the stripping lug of the bolt sub-assembly 212 into the case head 1203 of a feed-ready cartridge 22 in FIG. 27. The cartridge 22 is biased by the sub-follower 66 toward the centerline of the barrel as it is pushed through the feed-lips 65 of the follower 62. When released, the bolt 225 will continue to drive the semi-chambered cartridge until it fully seats within the barrel 220 and the bolt sub-assembly 212 is locked in the barrel extension 218 ahead of firing. The sear trigger 72 mounts to the sear trigger mount 73. In the disclosed embodiment, the sear trigger mount 73 is itself part of the receiver 202, located beneath the barrel extension 218. The sear trigger 72 can only translate with respect to the sear trigger mount 73 in a direction parallel to the X-axis as defined in FIGS. 28A, 28D and 29.

Following stripping, feeding and firing of cartridge 22 (firing occurs just shy of the full counter-recoil position of bolt carrier 211), the now empty follower 62 and magazine feed box 61 appear as they are shown in FIGS. 28A thru 28D (orthographic projections) and FIG. 29 (isometric relief). With no cartridge 22 remaining, the sub-follower 66 returns to its upper limit of travel within the follower 62 as seen in FIG. 28B. When the bolt carrier 211 nears the end of its forward stroke, it activates a mechanism that causes the follower release sear 69 to pivot away from the follower sear surface 68 to the position shown in FIG. 28D. In doing so, the follower return 71 is free to force the follower 62 back into its lower position where the follower 62 can again accept a de-linked cartridge 22 from the extractor body 40. By now, the extractor body 40 is fully rearward and has extracted and lifted a new round to the upper cartridge position in extractor body 40, as previously described. The follower release sear 69 will return to its default closed position when the bolt carrier 211 begins its retreat during recoil. In its default closed position, the follower release sear 69 is ready to catch the follower sear surface 68 again during the next cycle.

Figure 30A:
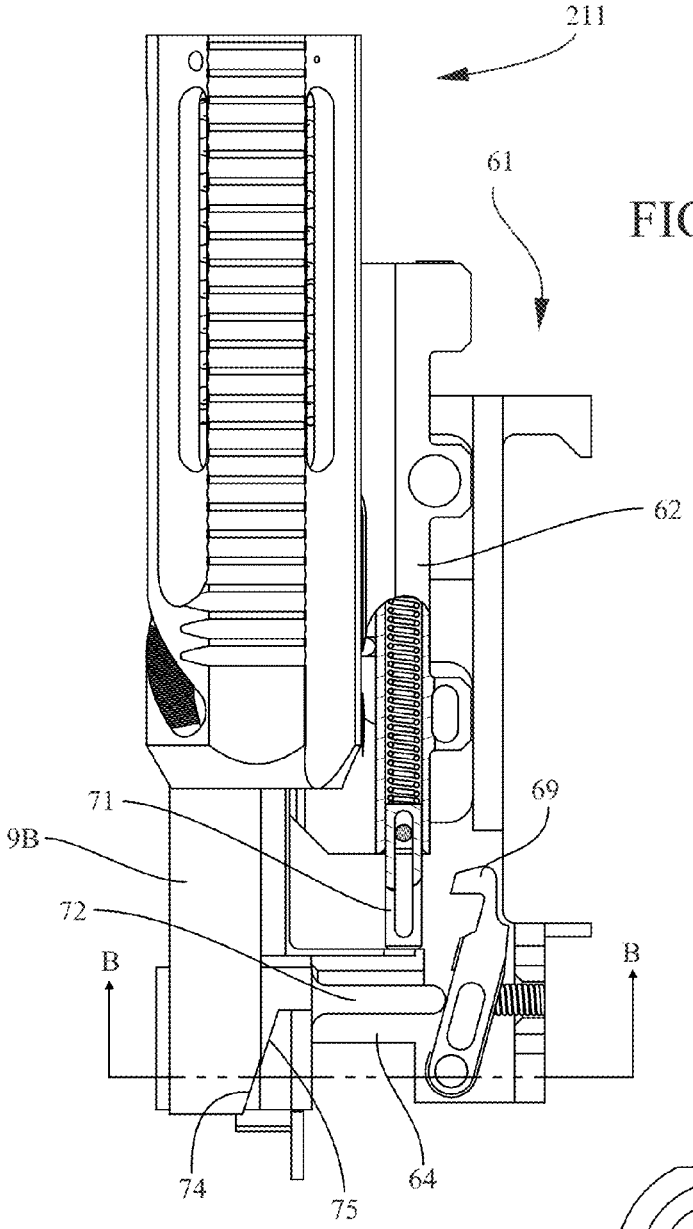
FIG. 30A is a top view of the bolt carrier without a bolt assembly, as the bolt carrier passes by and triggers the follower release sear.
Figure 30B:
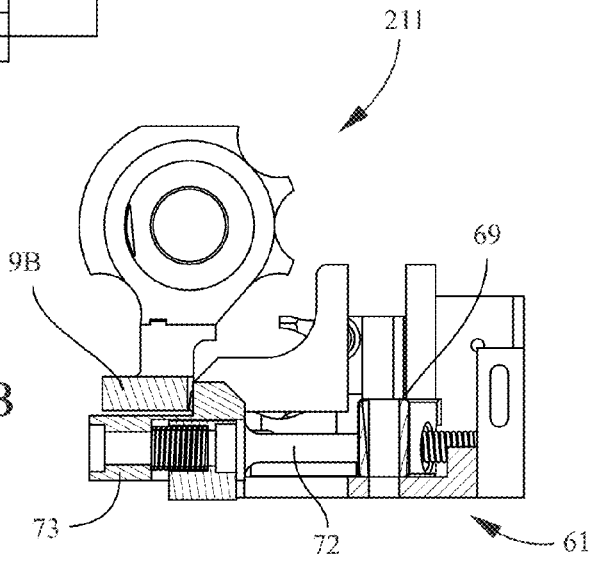
FIG. 30B is a sectional view along the line B-B of FIG. 30A.
Figure 31:
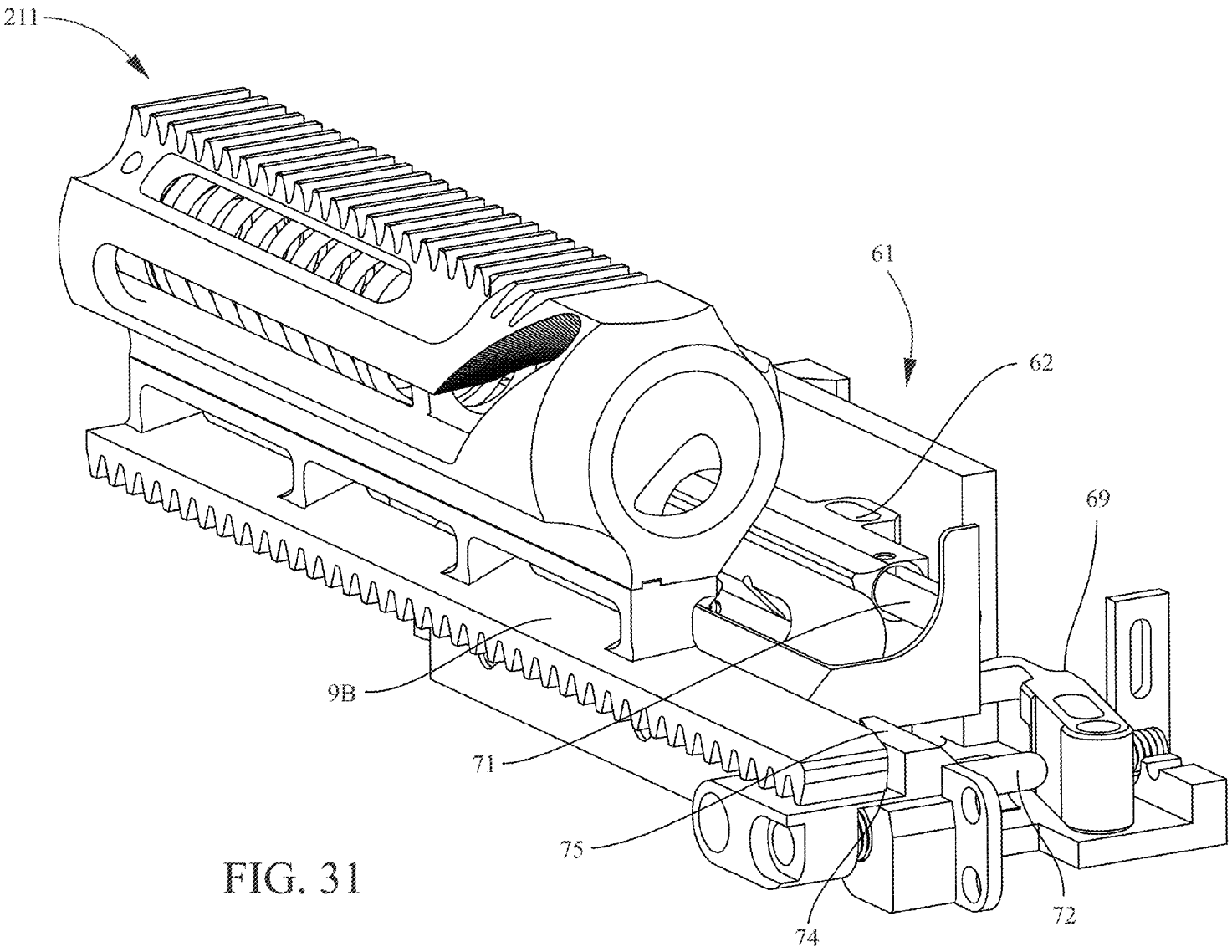
FIG. 31 is an isometric front view of FIG. 30A.

After the bolt carrier 211 has stripped and fed the feed ready cartridge 22, the follower 62 is induced to return to its lower position to receive another follower deposited cartridge 60 from the extractor body 40. The mechanism by which the bolt carrier 211 trips the follower release sear 69 is depicted in FIGS. 30A-B and 31. For clarity, only the bolt carrier 211 with lower translating rack 9B are shown, rather than all components and subassemblies comprising the primary operating group. Additionally, some magazine feed box structure 61 has been sectioned away. The shank axis of the sear trigger 72 is located coincident with the centerline of the sear window 64 when a magazine 2A is present on the weapon.

In FIG. 30A, the sear trigger 72 is shown being forced through the sear window 64 of the magazine feed box 61 and into the follower release sear 69 above its pivot thereby forcing the follower release sear 69 away from the follower sear surface 68. The sear trigger 72 is normally spring biased away from the follower release sear 69. But, the sear trigger 72 slides along the sear trigger mount 73 as the bolt carrier trigger surface 74 engages with the sear trigger disengage surface 75. The bolt carrier trigger surface 74 is an integral part of the bolt carrier 211 and typically comprises a lead-in edge on the lower translating rack 9B. The sear trigger disengage surface 75 is a likewise angled boss that is integral to the sear trigger 72.

As the bolt carrier 211 nears its full counter-recoil position, an interference condition exists between the bolt carrier trigger surface 74 and the sear trigger disengage surface 75. The correlating angled geometry of the surfaces 74, 75 causes the sear trigger 72 to slide along its guide mount. A protrusion integral to the sear trigger 72 engages the magazine components as shown in FIG. 30A. The act by the sear trigger 72 of tripping the follower 62 back to its lower position is kinematically and mechanically timed to occur after the cartridge 22 has been fully stripped and fed from the follower 62 by the bolt 225. The cycle continues until full counter-recoil of bolt carrier 211 at which point the projectile has been launched. As the bolt carrier 211 enters the recoil portion of its stroke, the previously interfering surfaces 74, 75 clear each other, the sear trigger 72 retracts, and the follower release sear 69 resets to catch the follower 62 on the next cycle.

If events dictate, the detachable, modular ammunition magazine 2A can be remotely removed from the weapon at any point during the cycle excepting the brief period between the beginning of the positioning by the extractor body 40 of the follower deposited cartridge 60 (see FIG. 21) and when the cartridge 22 is fully separated from the extractor body 40. Removing the magazine while a cartridge 22 is in the upper position on the extractor body 40, but not yet entering into the follower 62 as described can be performed but a live cartridge will then remain within the receiver 202. Any subsequent magazine that is loaded must not have a feed ready cartridge 22 in the feed box 61 or stoppage can occur under this condition.

Figure 32:
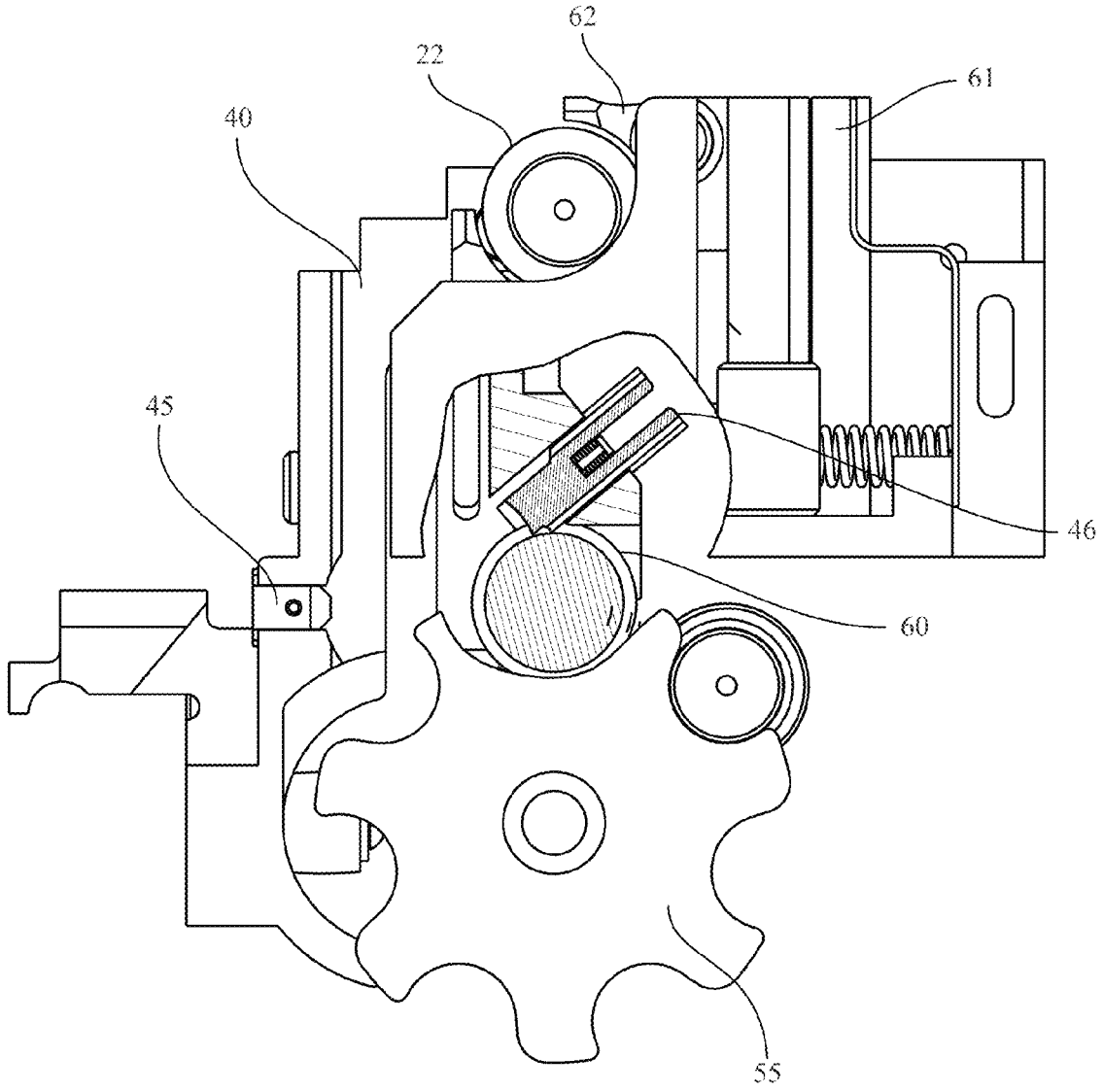
FIG. 32 is a partially sectioned front view showing the sprocket and contained ammunition being unloaded (along with the magazine) after the extractor body has already latched onto a new cartridge.

The preferable magazine download period occurs at the position depicted in FIG. 22. At this point, the feed-ready cartridge 22 is safely seated in the follower 62 in the same manner as when a full magazine is initially loaded onto the weapon system (and the cartridge 22 is completely free from the weapon). Referring to FIG. 32, the magazine sprocket 55, magazine feed box 61 and the rest of the magazine are withdrawn down and away from the extractor body 40. Although the long extractor 46 and short extractor 45 have already latched onto the extraction positioned cartridge 56 in the magazine sprocket 55, the design of the spring loaded long extractor 46 is such that the typical download motion itself will mechanically defeat it without additional intervention. Following download, the magazine 2A is fully ready to be re-inserted at any time and fired immediately on the first commanded cycle.

The magazine feed box 61, magazine sprocket 55, and detachable, modular magazine 2A enable the weapon 200 to cycle belts of ammunition whose closed-end links 58 circumferentially enclose the individual cartridges (as seen in FIGS. 12E and 12F). The cycle of operation previously described is a means to manipulate a round of ammunition from this belted configuration by delinking it, feeding it into the barrel and firing it.

Figure 33:
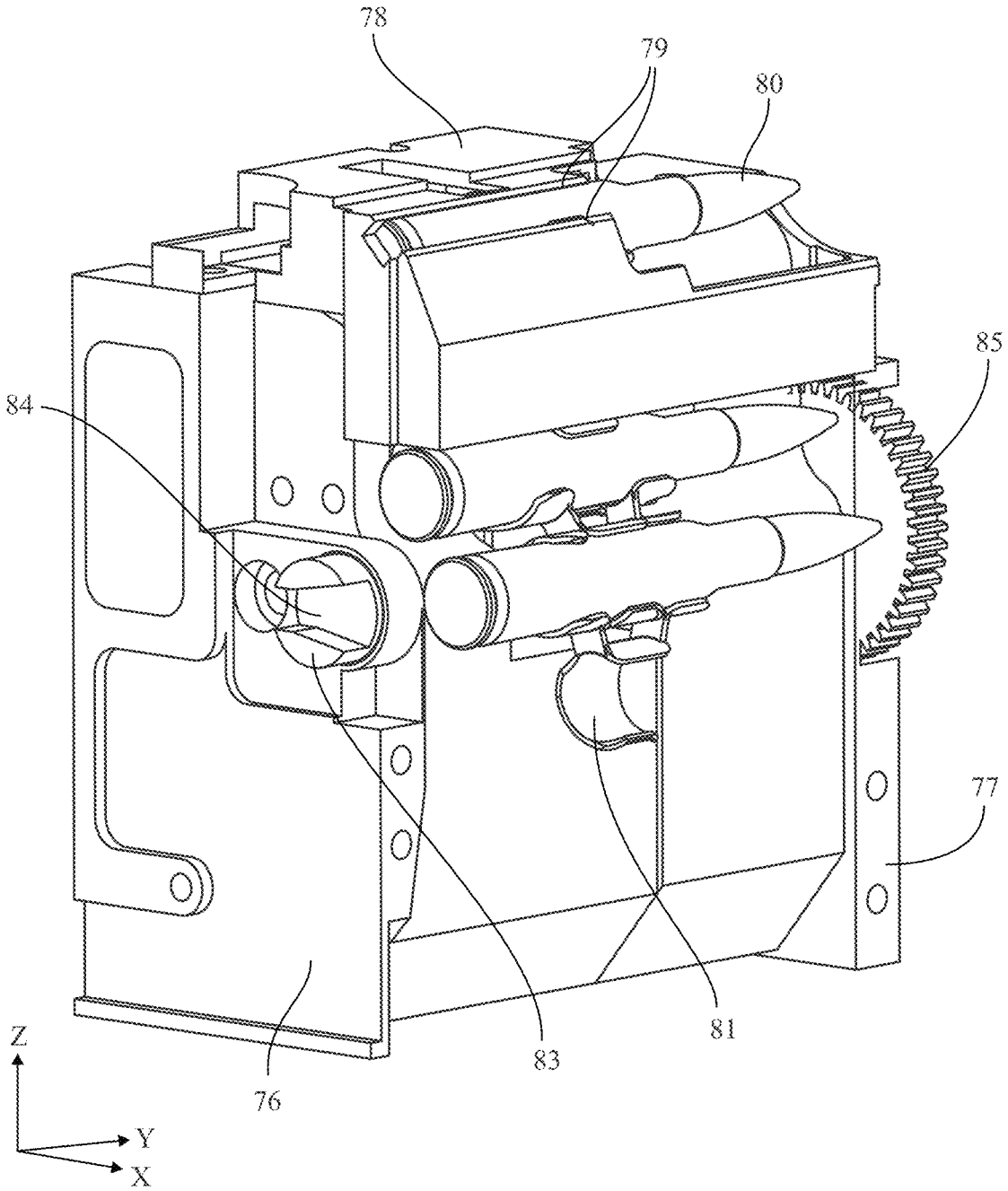
FIG. 33 is an isometric weapon-side view of an alternate open-linked ammunition magazine for the weapon of FIG. 12.
Figure 34:
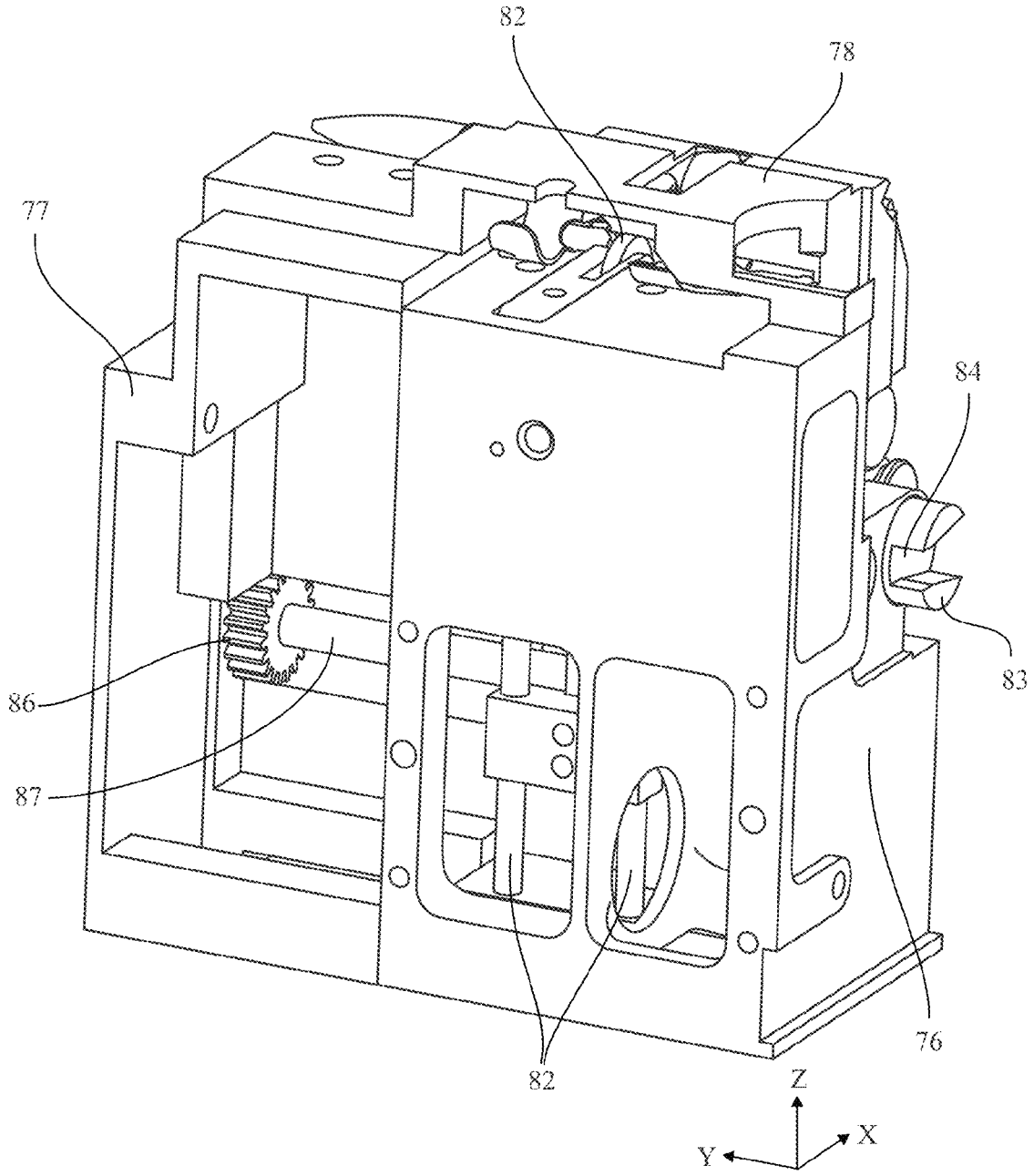
FIG. 34 is an isometric-ejection side view of an alternate open-linked ammunition magazine for the weapon in FIG. 12.

The weapon 200, with no parts changes or modification of any sort, will also accept an alternate magazine that contains belted ammunition in the open-linked configuration as depicted in FIGS. 12C and 12D. This ammunition handling system is shown in FIGS. 33 and 34 in isometric front and rear views, respectively. With respect to .50 BMG (12.7×99 mm) caliber machine guns, open-end linked belts are not as common in the U.S. military as closed-end linked belts, but the open-end linked belts offer some advantages in simplicity of the cartridge positioning and feeding cycle. As can be seen in FIG. 33, the individual member links 81 of an open-end linked cartridge belt snap around only a portion of the circumference of the cartridge case 1201. The link 81 itself serves part of the role that the feed lips of the aforementioned follower 62 provide. The stripping lug on the bolt 225 can force the cartridge from the link 81 directly forward and into the barrel extension 218 with no intermediate de-linking or repositioning.

Referring again to FIGS. 33 and 34, the open-end linked magazine typically includes an aft cover 76, fore-cover 77 and feed-cover 78, which comprises the general superstructure. The open-link feed ready cartridge 80 is presented to the bolt carrier 211 and bolt 225 stripping lug in nearly the same position and manner as it would be in the close-end link magazine feed box 61. The open-link feed lips 79 augment the spring steel links in constraining and guiding the open link, feed-ready cartridge 80. The roller 82 is spring biased upward and presses the open link feed ready cartridge 80 against the open-link feed lips 79, serving a feed-guiding purpose as well, much like the sub-follower 66 of the magazine feed box 61. The open-link power take off tube interface 84 mates with the weapon power take off tube 38 which is again actuated by the power take off cam-pin 217 in the extractor body 40. This imparts rotation to the drive shaft 83 which cycles the open-end linked belt handling mechanism and presents new rounds to be fed and fired.

Figure 35A:
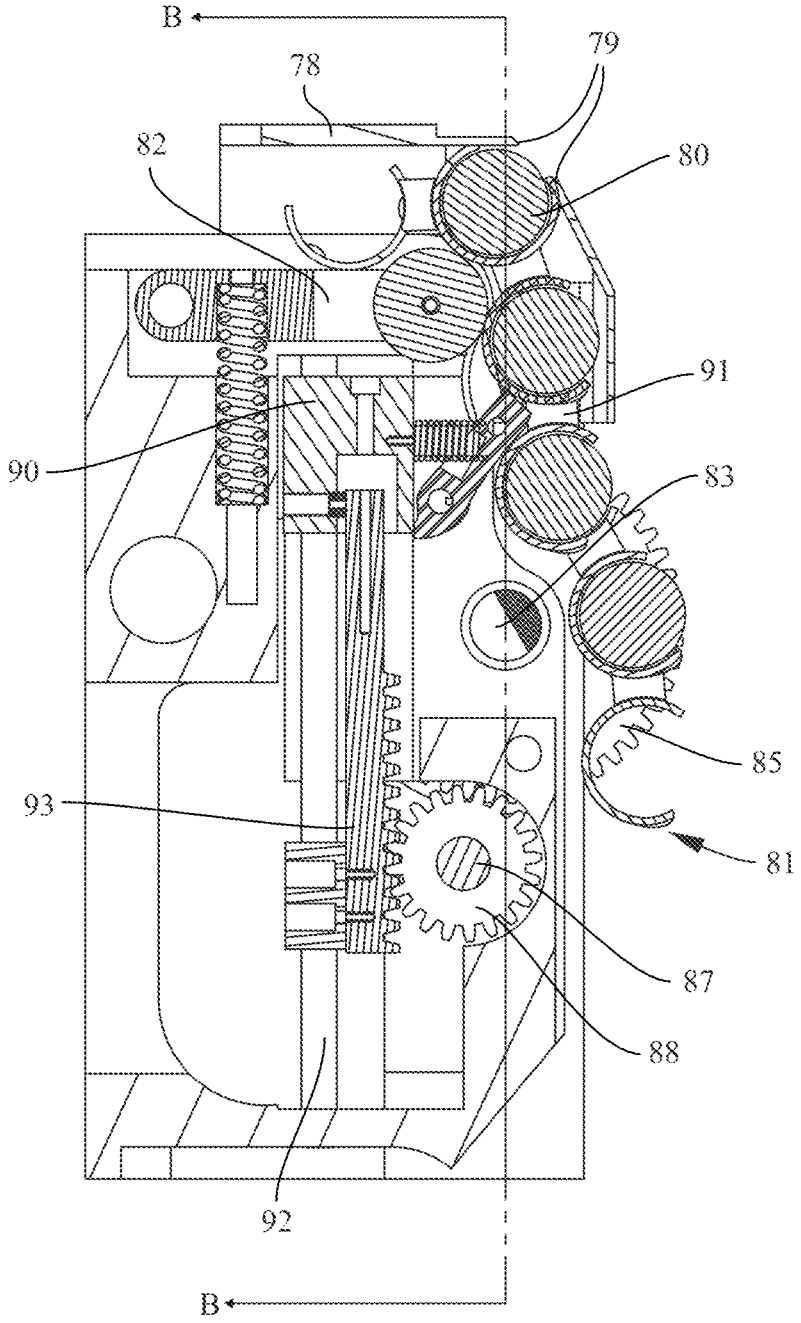
FIGS. 35A and 35B are orthographic rear and weapon-side projections of the magazine of FIGS. 33 and 34.
Figure 35B:
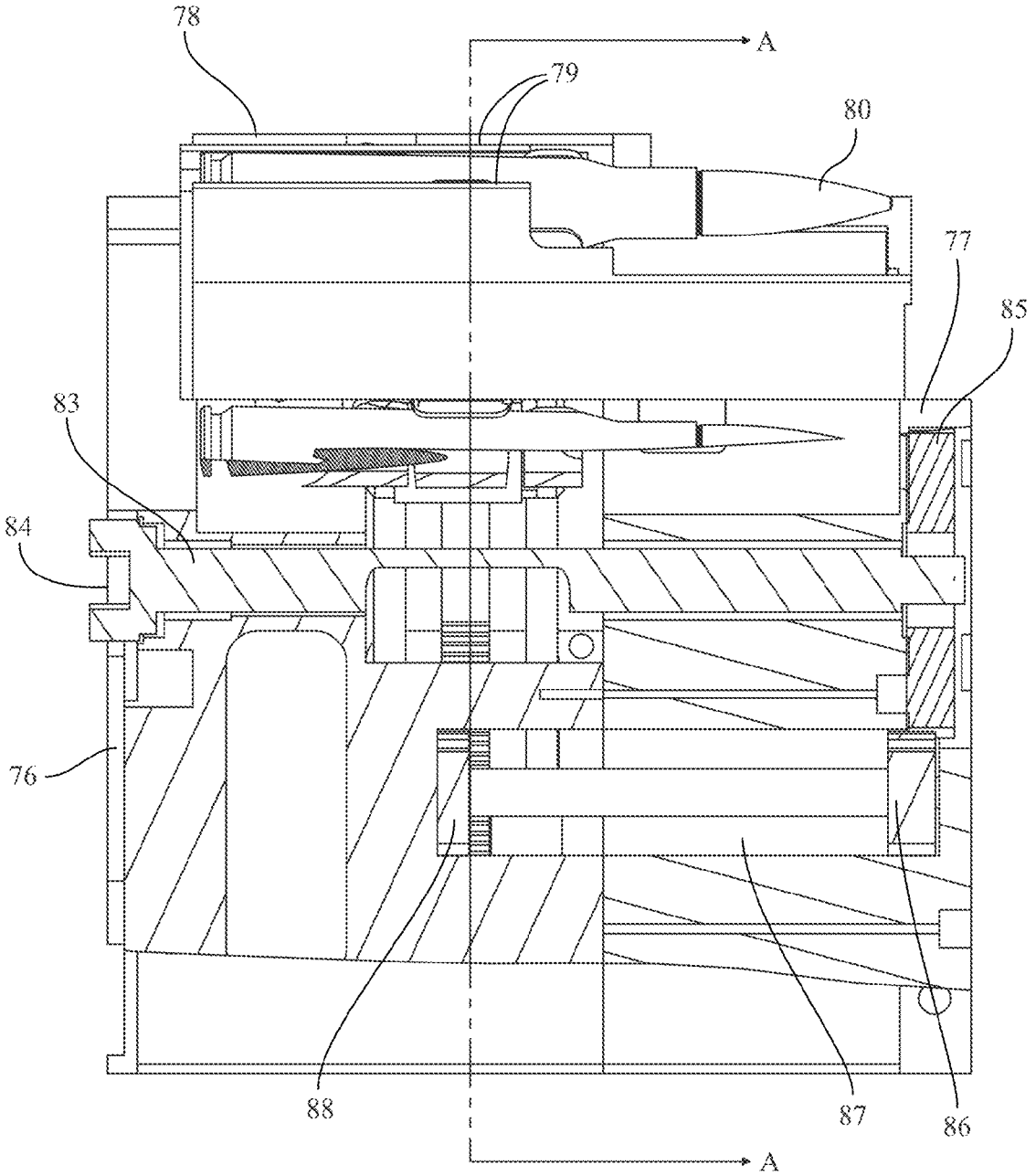

FIGS. 35A and 35B are orthographic cutaways of the magazine with a cartridge belt with open-end links 81 positioned as it would be while the bolt carrier 211 is in its full recoil position. The open-link feed ready cartridge 80 is biased against the open-link feed lips 79 of the feed cover 78 by the roller 82. The roller 82 pivots about an axis parallel to the Y-axis (as it is defined in FIGS. 33 and 34) within the feed cover and is spring loaded upward as shown in FIG. 35A. The driveshaft 83 is in an angular position corresponding to that of the weapon power take off tube 38 when the extractor body 40 is fully forward. As seen in FIG. 35B, the drive shaft 83 spans the length of the magazine and connects directly to the drive shaft pinion 85 at the front of the fore-cover 77. The drive shaft pinion 85 in turn imparts its rotation via gear mesh to the transfer shaft pinion 86. The transfer shaft 87 is connected to both the transfer shaft pinion 86 and shuttle pinion 88 and is supported on bearings. Rotation and torque from the power take off tube 38 then, is ultimately imparted to the shuttle pinion 88, which operates the feed mechanism 89.

Figure 36:
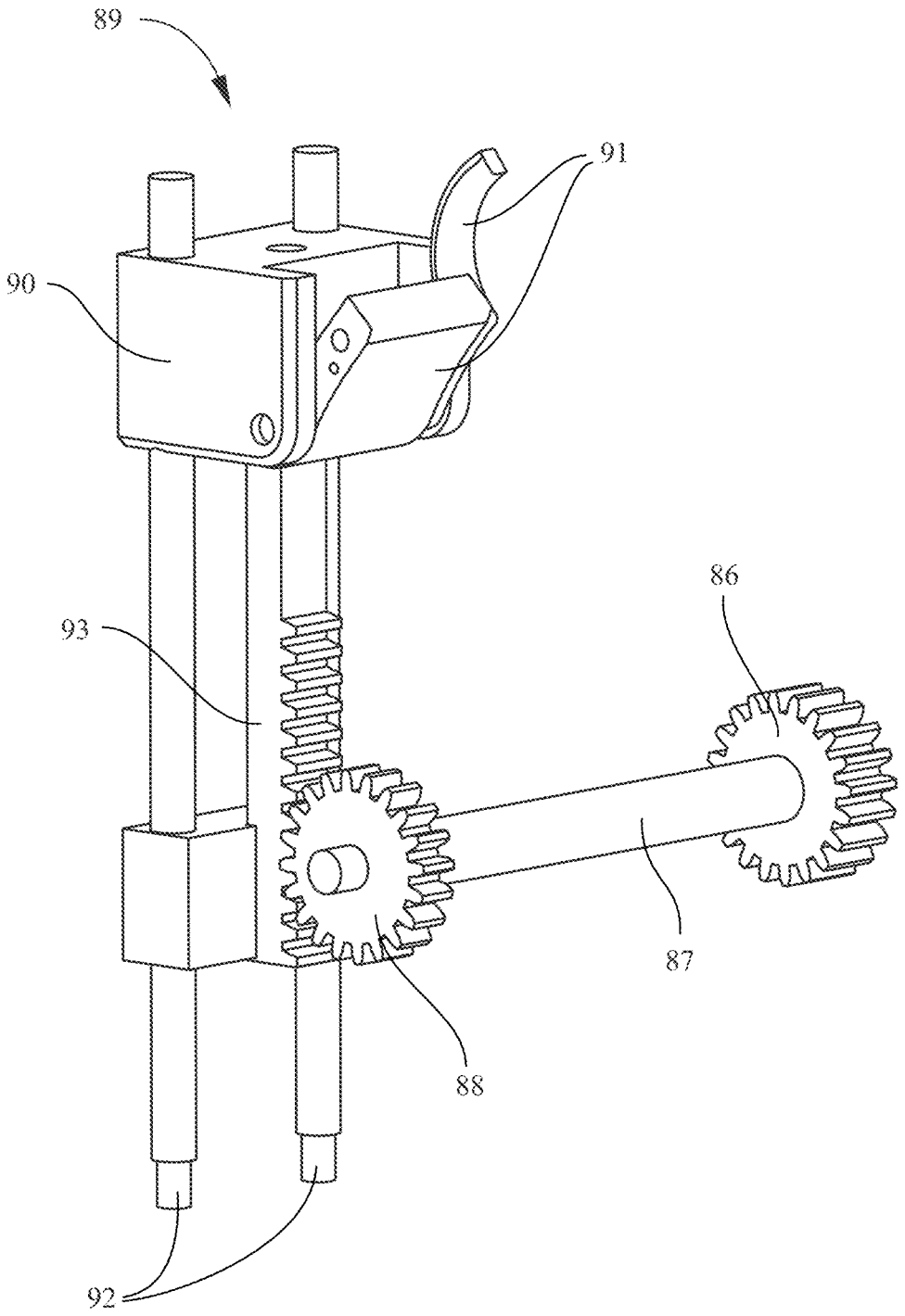
FIG. 36 is an isometric weapon-side view of the magazine feed mechanism for the magazine in FIGS. 33 and 34.
Figure 37:
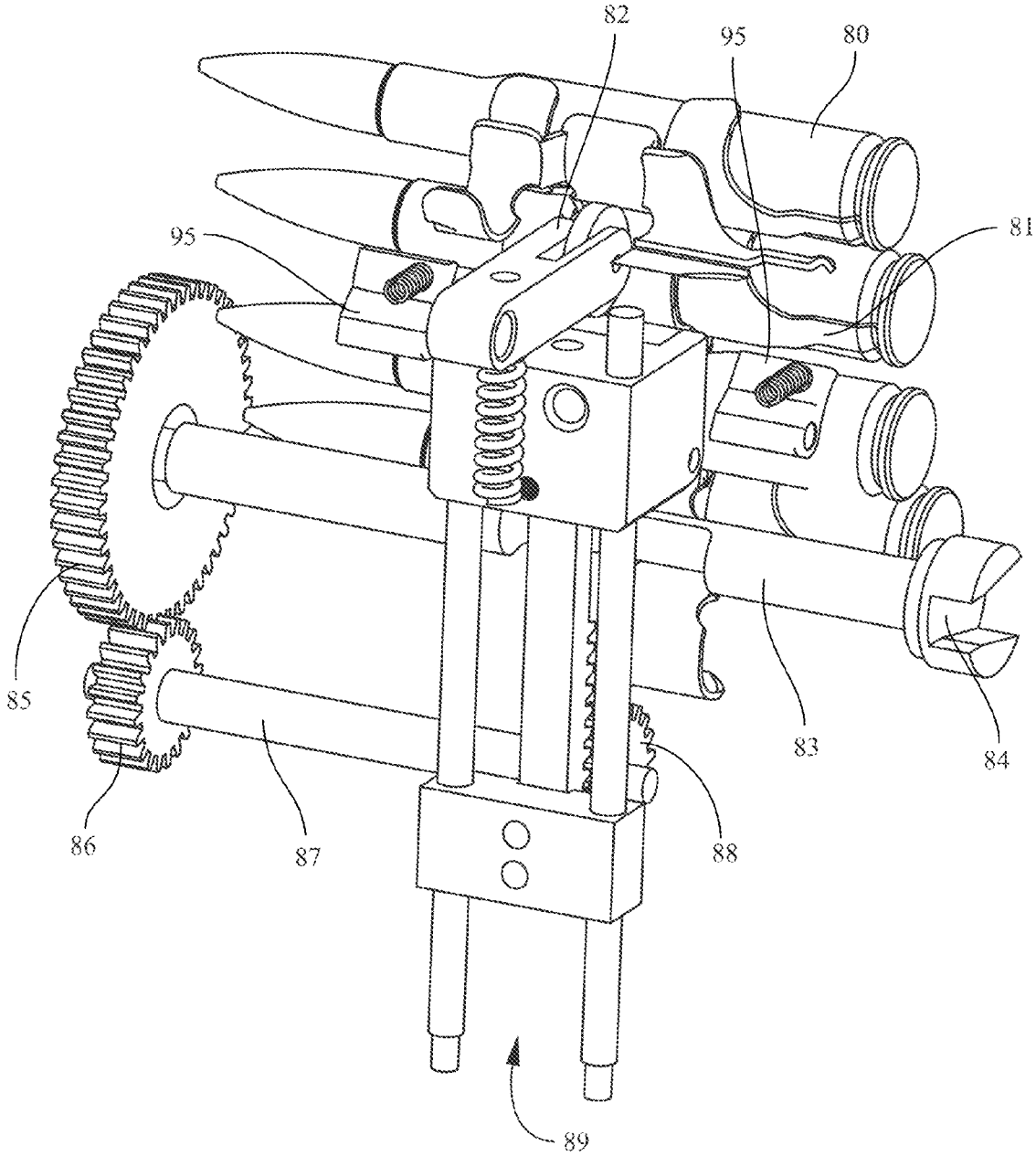
FIG. 37 is an isometric ejection-side view of the magazine feed mechanism and its interfaces with the weapon of FIG. 12 and a belt of open-linked ammunition.

The feed mechanism 89 is detailed in FIGS. 36 and 37. FIG. 36 is an isometric front view of the feed mechanism 89 only and FIG. 37 is an isometric rear view which includes the open-link power take off tube interface 84 and a belt of open-linked ammunition 81. The shuttle guide rods 92 are fixed to the aft cover 76 and span its height. They serve as a track on which the pawl shuttle 90 is free to translate vertically both upward and downward. The pawl shuttle 90 connects to the shuttle rack 93, which meshes with the shuttle pinion 88. Rotation of the shuttle pinion 88 causes shuttle rack 93 and pawl shuttle 90 to rise or descend. In this depiction, (corresponding to the full recoil position of bolt carrier 211), the pawl shuttle 90 has moved to its upper most position. The belt of ammunition is suspended in the present position by the action of the pawl fingers 91 on the pawl shuttle 90, and by the anti-backup magazine pawls 95, which are fixed to and pivot in the magazine structure. Both pawl types are spring biased to allow an upward relative motion between the pawl and the ammunition belt. A round defeats each pawl, which then springs back underneath the space between the links as the round passes, effectively hanging the belt in place.

Figure 38A:
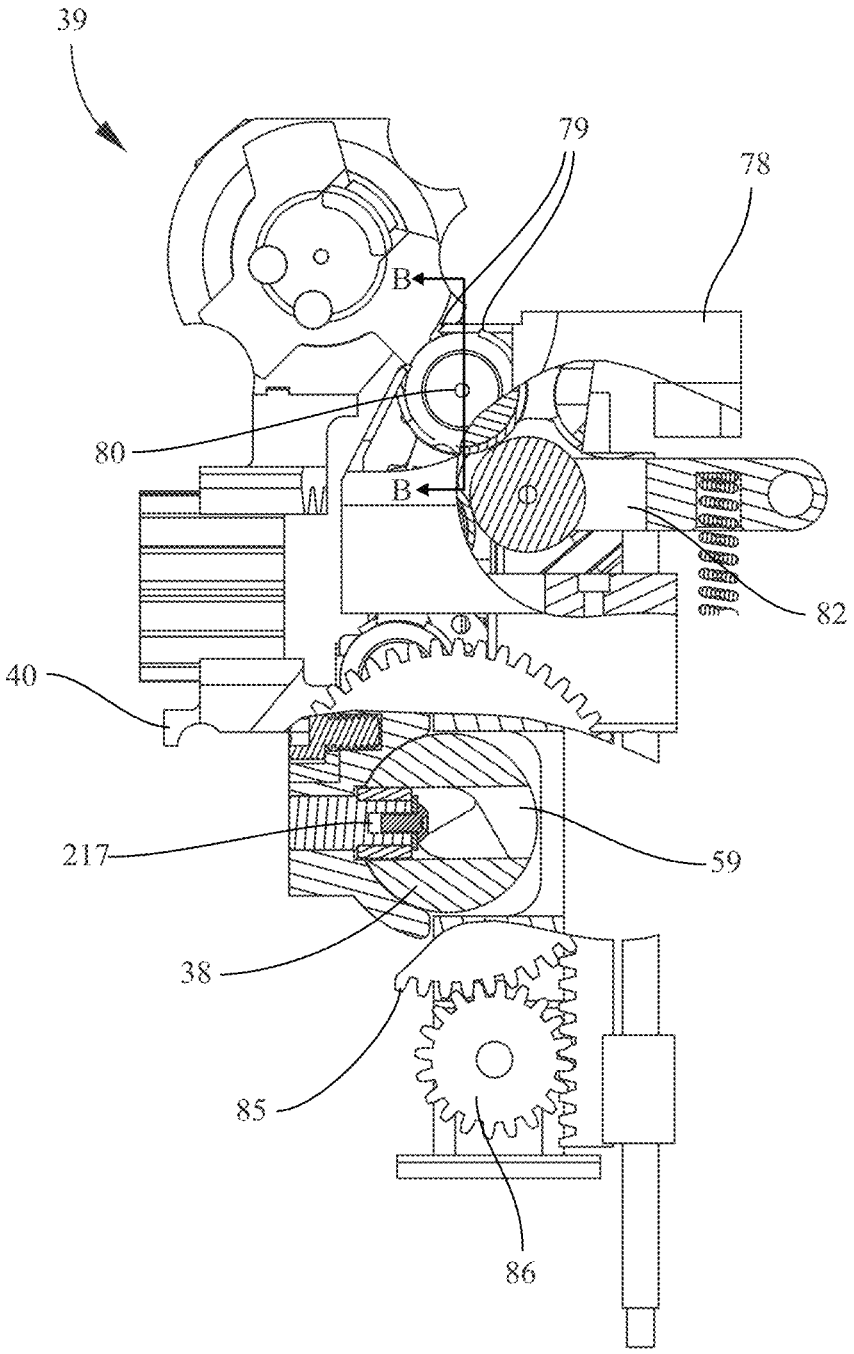
FIGS. 38A and 38B are front and side views respectively, illustrating stripping and feeding of cartridges from the magazine in FIGS. 33 and 34.
Figure 38B:
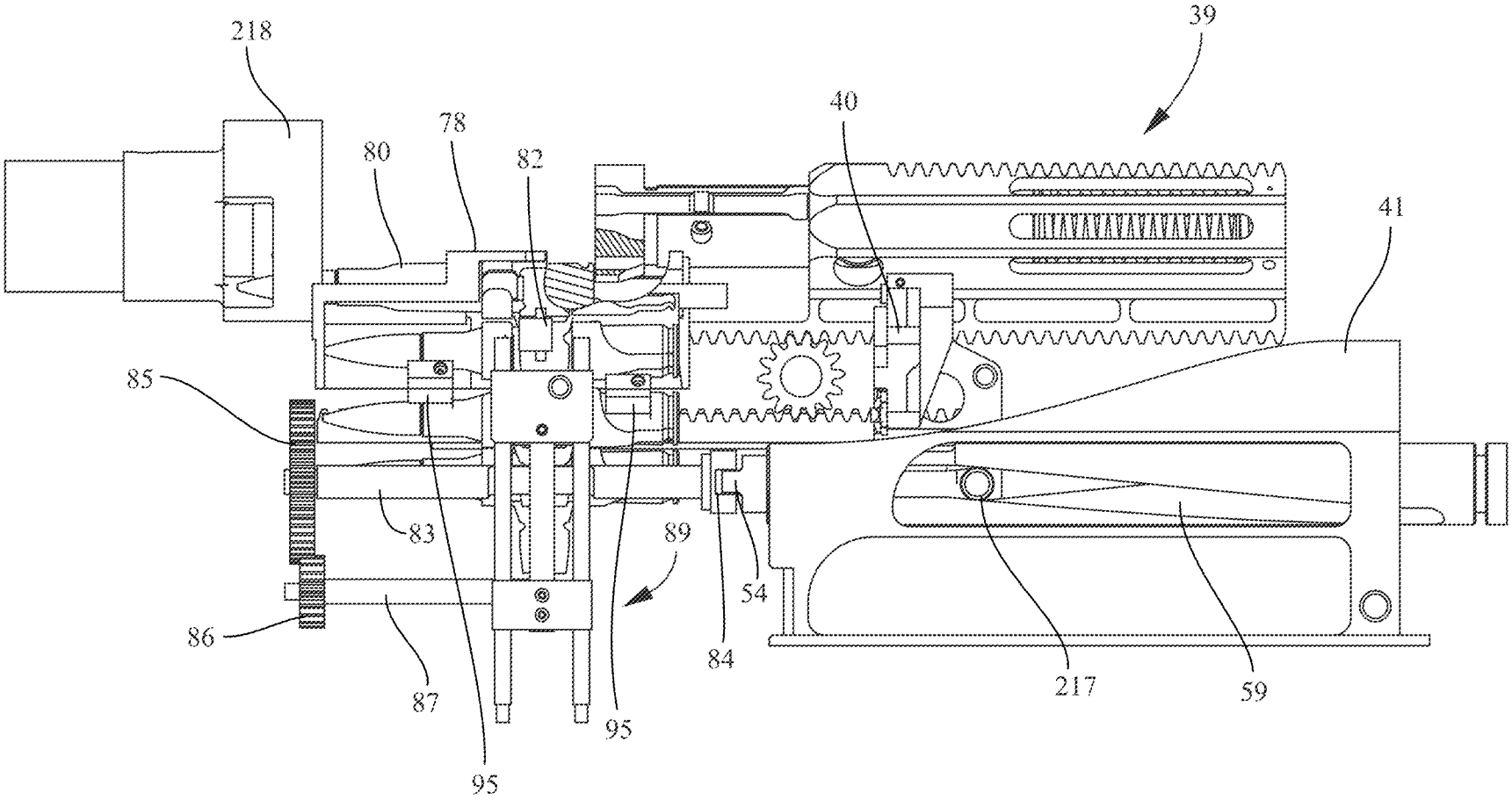

The open linked feed-ready cartridge 80 is being stripped and fed in FIGS. 38A and 38B which are front and side views, respectively, of the feed mechanism 89, ammunition and select weapon components. The bolt carrier 211 is moving forward during counter-recoil and the stripping lug engages and pushes on the case head 1203, much the same as it would with the closed-link ammunition magazine feed box 61. The spring pressure acting from the roller 82 guides the tip of the round toward the centerline of the barrel extension 218. As the round is leaving the open-link cartridge belt 81 and feed cover 78, the anti-backup magazine pawls 95 hold the rest of the belt in place. Operation of the weapon 200 is unchanged between the closed-end link magazine 2A and the open-end link magazine. The bolt carrier 211 translates fore and aft, which in turn moves the extractor body 40 in the opposite direction. The power take off cam pin 217 rotates the power take off tube 38 via the power take off tube cam slot 59. The lifting cam 41 is not used but can remain installed within the receiver 202, as it provides no obstruction to the other moving parts. Most of the extractor body 40 is not used either, although it translates without interfering with the open-end link magazine operation. The power take off tube interface 54 mates with the open-link power take off tube interface 84 to operate the driveshaft 83 and associated gears 85, 86, 88 and feed mechanism 89 as described.

Figure 39:
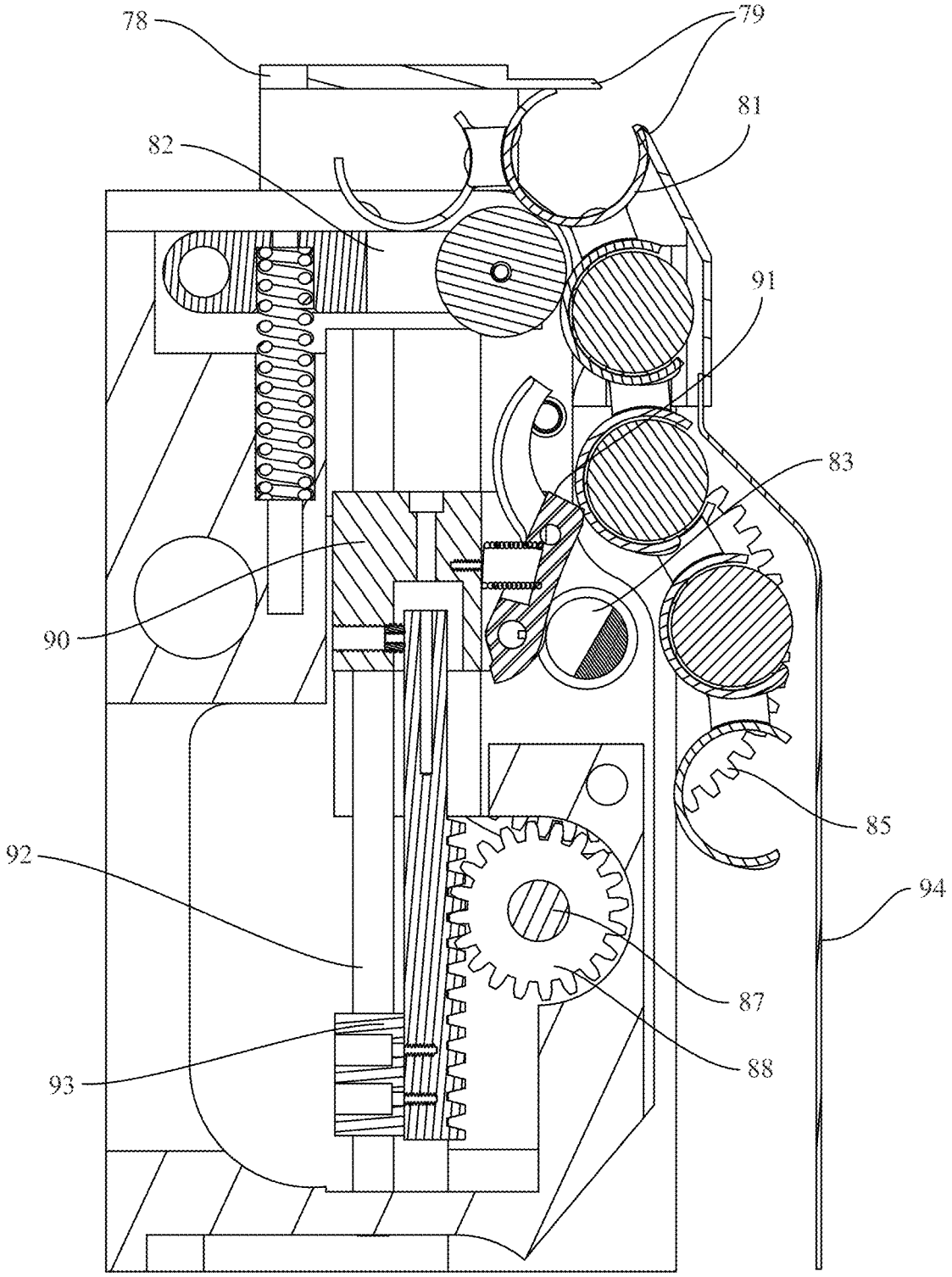
FIG. 39 is a rear view of the magazine in FIGS. 33 and 34, fully sectioned at the same location as FIG. 35A.

At full counter-recoil of the bolt carrier 211, the open link feed ready cartridge 80 has been fed and fired and the extractor body 40 is in its rearward most position. FIG. 39 is a rear view sectioned through the roller 82. The drive shaft 83 of the magazine has rotated and caused the shuttle rack 93 and pawl shuttle 90 to be lowered. The open link feed ready cartridge 80 is gone, but the link 81 remains biased against the open link feed lips 79 by the roller 82, and the entire belt is held up by the anti-backup magazine pawls 95 (FIG. 38B). The pawl shuttle 90 descends and the pawl fingers 91 pivot and collapse as they pass downward relative to the next cartridge. When clear, the pawl fingers 91 snap back out and under the next cartridge.

As the bolt carrier 211 continues into the recoil stroke, the extractor body 40 and power take off cam pin 217 begin to return forward, again rotating the drive shaft 83, though in the opposite radial direction, towards the position it was in as shown in FIG. 35A. The corresponding upward motion of the pawl shuttle 90 then pushes the remaining open link cartridge belt 81 up with it. The dust cover 94 guides the next feed-ready cartridge above it into place. The roller 82 has its pivot located such that this incoming round can roll over the cylinder and briefly depress the arm to clear it. Movement of the belt and positioning of the next cartridge to be fired displaces the empty link 81 above which is pushed out and to the left of the magazine.

Figure 40:
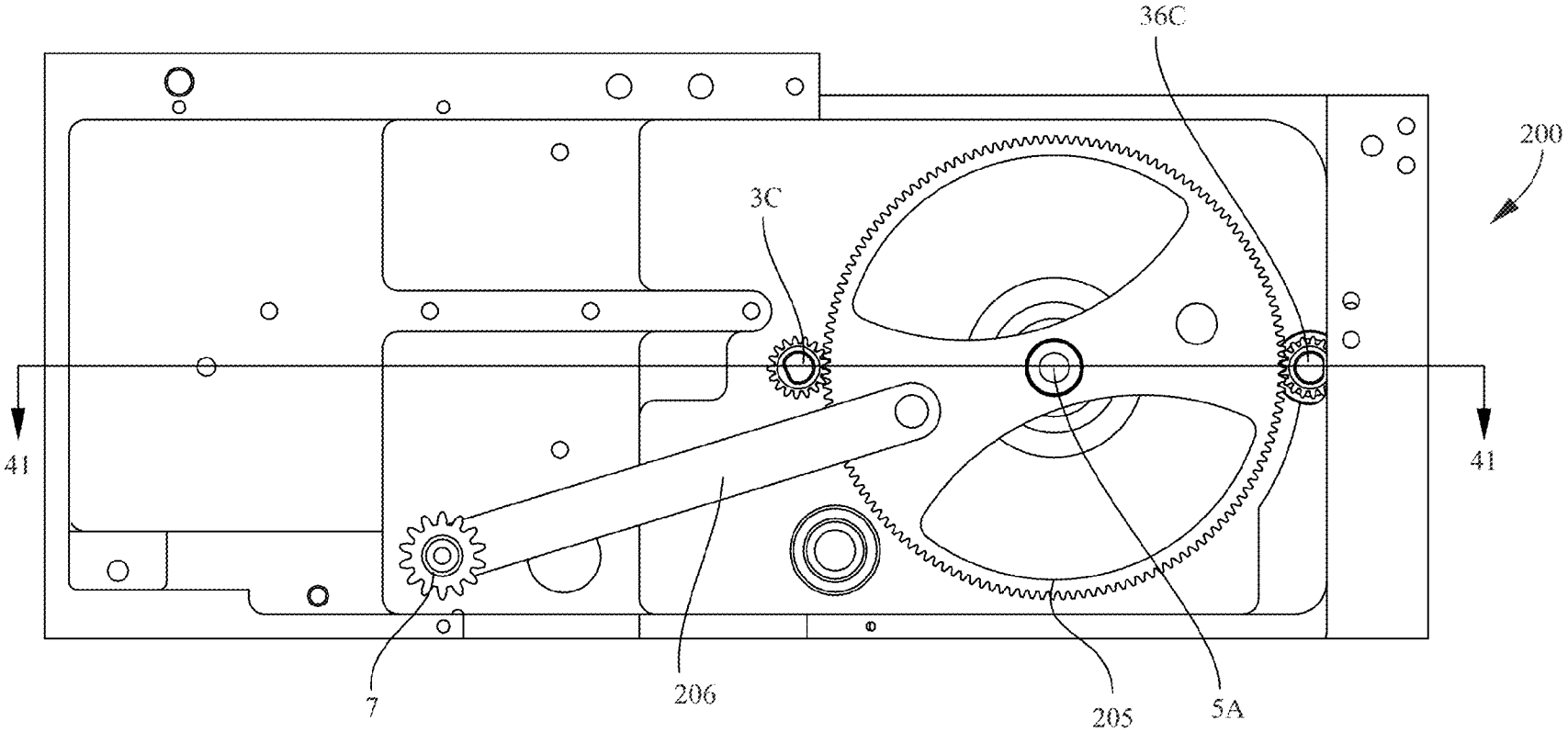
FIG. 40 is a side view of an embodiment of a weapon utilizing a servo motor in tandem with software and hardware to enable customizable and precise control of the drive train and, associatively, the weapon operating group.
Figure 41:
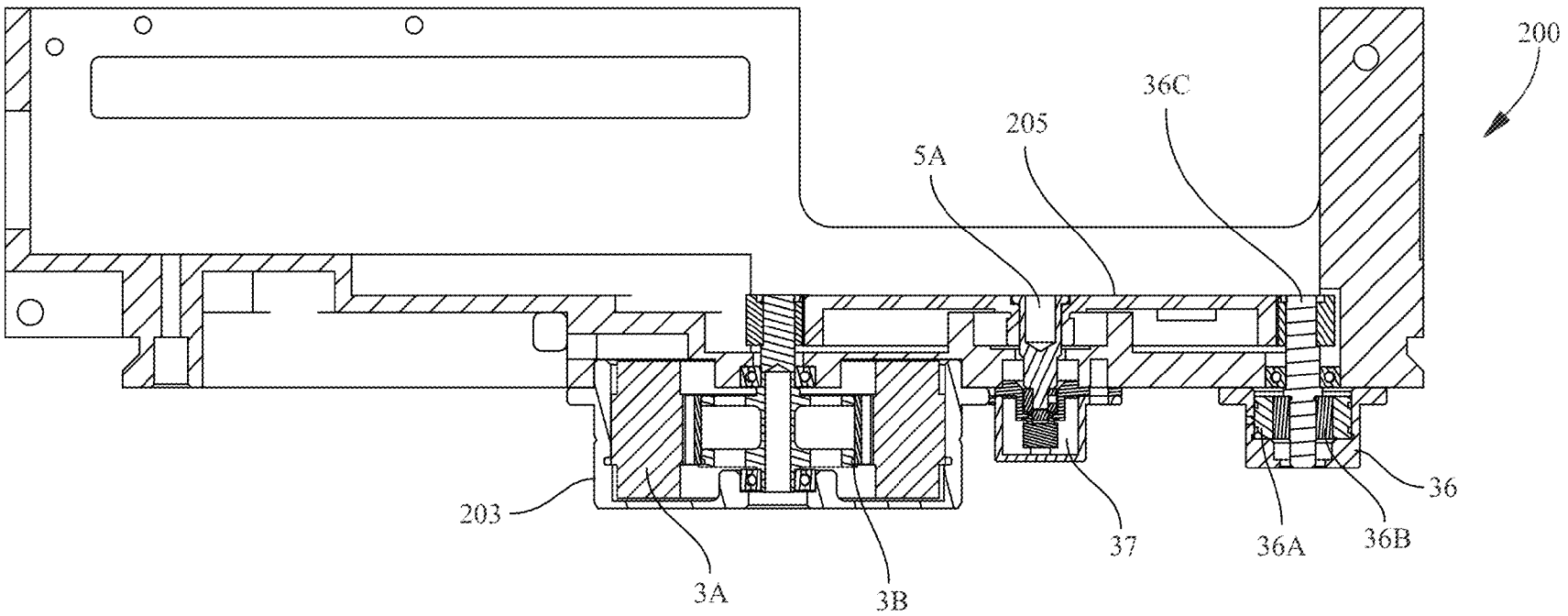
FIG. 41 is a top view of the weapon of FIG. 40 sectioned along line 41-41 of FIG. 40.
Figure 42:
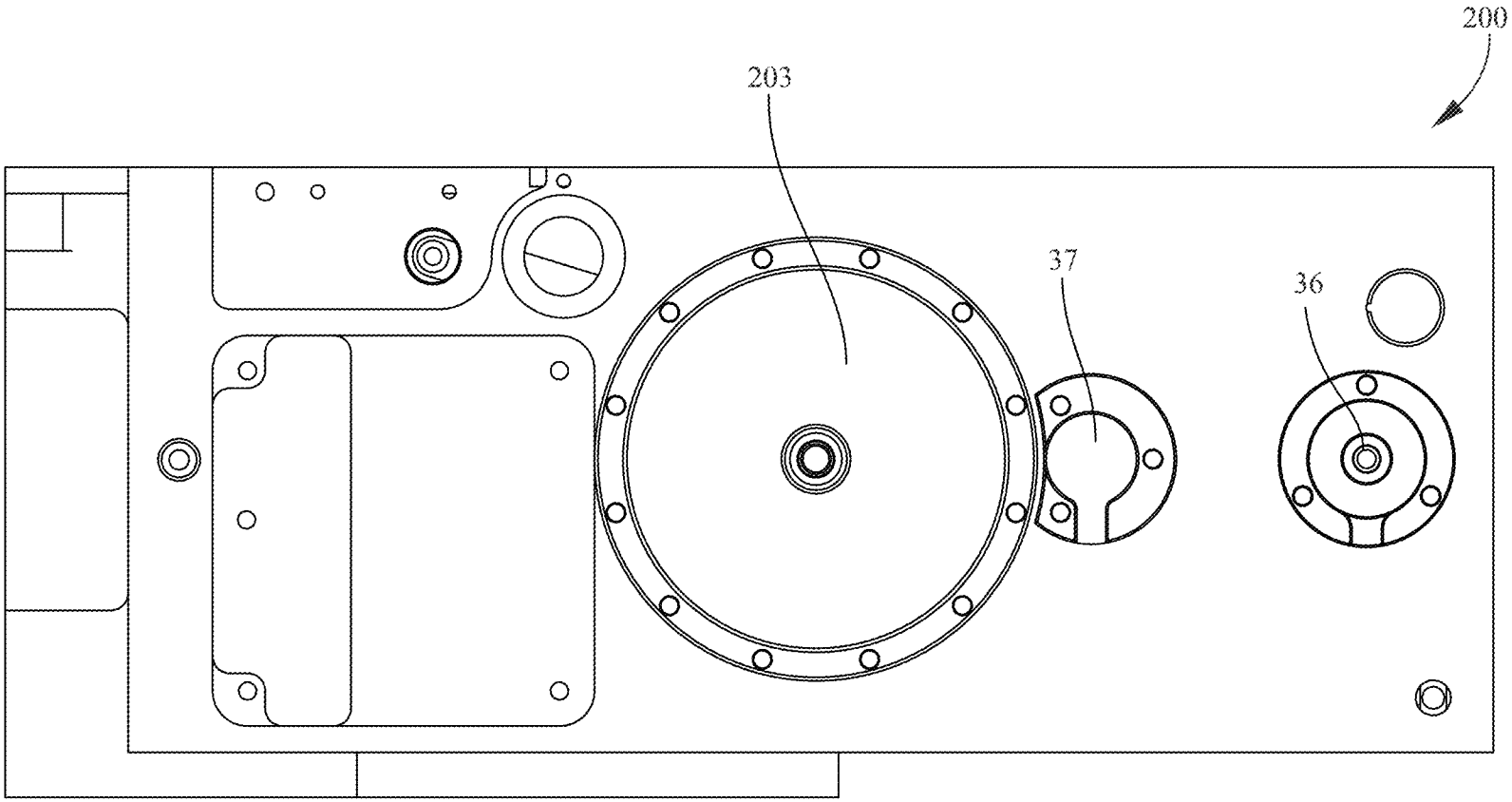
FIG. 42 is the side view opposite that depicted in FIG. 40.

As explained earlier, weapon cycling is powered externally and not dependent on a fired cartridge's impulse. In a particular embodiment of the weapon system, software is used in conjunction with specialized motor and sensor hardware to drive operation intelligently. This is in contrast with more simple on/off or high rate/low rate schemes. Additional hardware for the weapon power and drive train is depicted in FIG. 40, which is a view looking into the weapon 200 from the magazine side. FIG. 41 is a sectional view from the top and FIG. 42 is a view looking at the weapon's closed side. Some components have been omitted for clarity.

Like the weapon 1 of FIG. 1, motor torque is transferred to the crank 205 of weapon 200 to move the connecting rod 206 and bolt carrier 211. In this particular embodiment, the crank 205 is a large spur gear which meshes with the motor transfer gear 3C, which is driven directly by an electric servo motor 203. The servo motor 203 includes an independently mounted motor stator 3A and a concentric motor rotor 3B that interfaces with the weapon drive train.

The servo motor 203 departs from a typical direct current motor in that motor 203 has better power efficiency and the ability to precisely control its output motion profile (angular displacement, velocity and acceleration). Control of the output motion profile is required to facilitate continuously variable firing rates, remote clearing of some malfunctions, high levels of accuracy and precision (while still firing from the open-bolt position), and capitalizing on the kinematics of the linkage motion to reduce power consumption. To allow for precision control, weapon software and driver hardware need real time, accurate feedback on the position of the motor rotor 3B, speed, and angular momentum. Redundant sensors perform this task.

The resolver transfer gear 36C meshes with the crank member 205 one hundred and eighty degrees away from the motor torque input. Mechanical support from the resolver transfer gear 36C balances the highly non-linear and severe loading imparted to the crank 205. A more critical function of resolver transfer gear 36C is the rotary data the resolver transfer gear 36C feeds to the weapon resolver 36. Consisting of the resolver rotor 36B tied to the gear 36C and stationary resolver stator 36A, the resolver 36 is a rotary transformer that tracks absolute displacement, rate of displacement, and number of rotations at very high resolution. The resolver transfer gear 36C and motor transfer gear 3C have the same pinion geometry (1:1 motion profile relationship) so feedback from the resolver 36 tracks the motor exactly and allows for the primary control of the weapon in both commutation and feedback.

Figure 43:
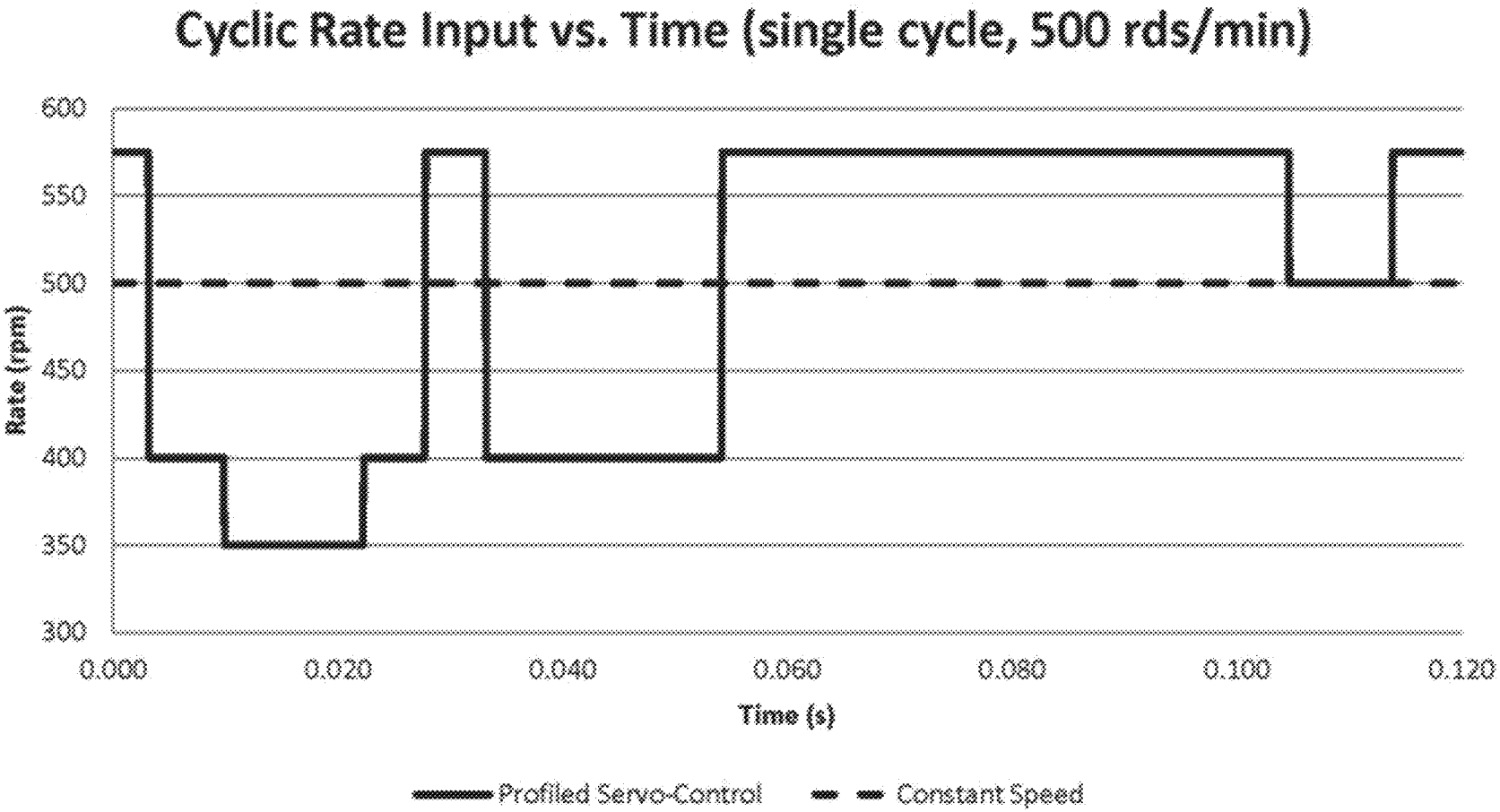
FIG. 43 shows an example of a control method for a weapon cycle and compares a uniform rate of fire over the duration of a cycle to a rate of fire that varies as a series of step inputs. Localized high and low velocity during the cycle achieves the same aggregate rate of fire as a constant speed input, but with additional performance benefits.
Figure 44:
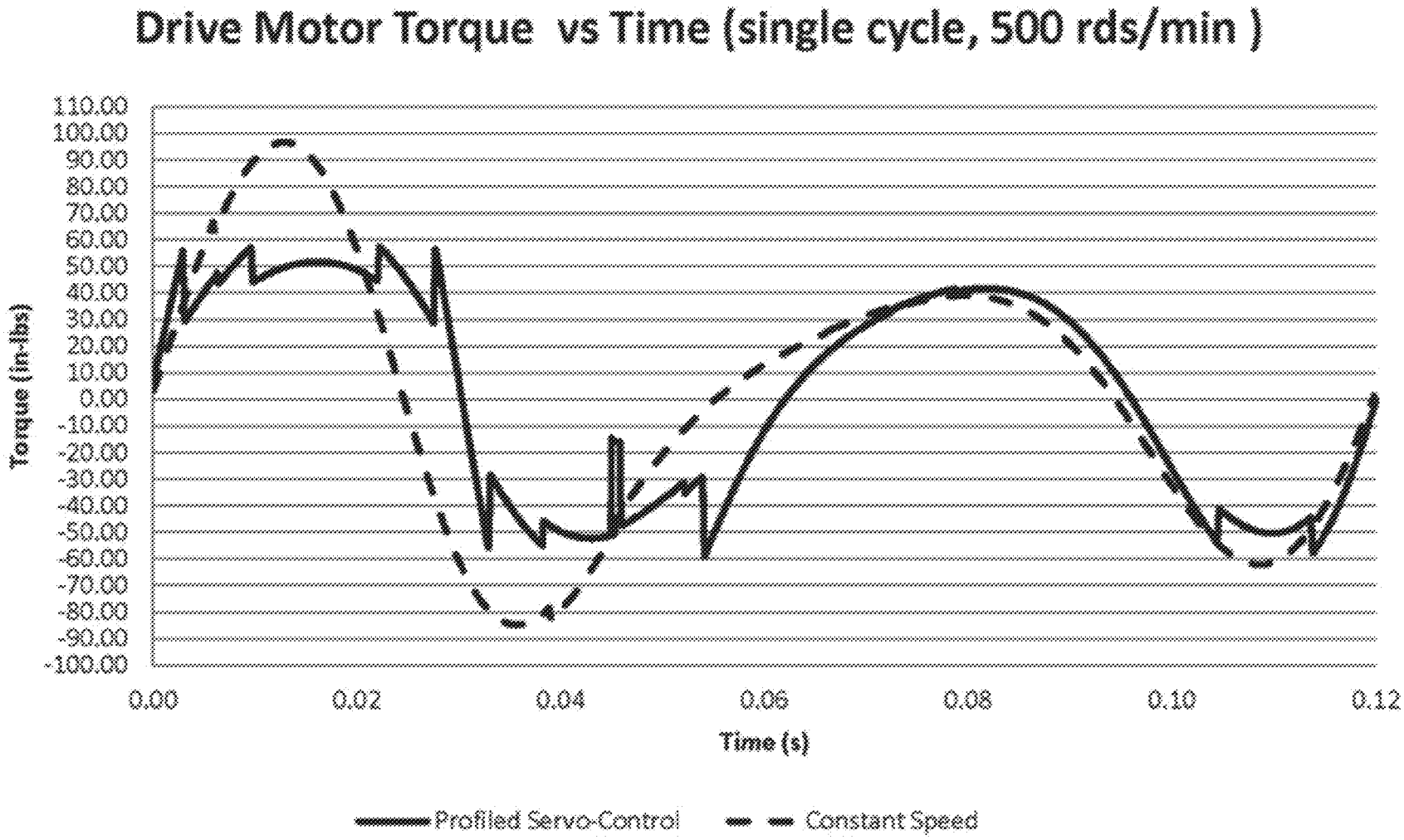
FIG. 44 shows motor torque (directly related to current and power consumption) as a function of time. The motor torque required to sustain the prescribed rate of fire when the weapon is controlled at a constant speed is shown by a dashed line and motor torque that is controlled through the use of control software/sensors to vary the speed of the weapon is shown by a solid line.

A secondary control element, the encoder 37, is directly connected to the crank shaft 5A and thus offers positional feedback not subject to the slight variability of gear meshing ratios and pitch circle deviations. Encoder feedback also represents the true, un-geared position of crank 205. Though not able to measure in discrete steps as small as a resolver 36, the encoder 37 maintains positional information even in the event that power is removed from the system. This provides for a critical safety function in the event of a malfunction, user error, or other unintended interruption of operation. Alternatively, the servo motor 203, resolver 36, and encoder 37 may all be mounted directly on the crank shaft 5A, if space permits. Use of data from the encoder 37 for rough positional feedback also frees the more accurate resolver 36 to drive the motor's velocity directly (instead of differentiating from displacement) and thus run more efficiently. FIGS. 43 and 44 demonstrate this potential. The drive and commutation elements described can be utilized to provide localized motor commands and rapid adjustments in velocity and acceleration to take advantage of the intrinsic mechanical dynamics of the system. FIG. 43 is a control regime in which the cyclic rate of the weapon varies between low and high speeds at different points in time of a single cycle at a desired average perceived firing rate. This is compared in FIG. 43 to a constant angular velocity, delivering the same average firing rate. Known mechanical events (such as ammunition indexing, bolt locking, and the dynamic profile of the slider crank linkage) correspond to these times. FIG. 43 shows rate changes as idealized step inputs to illustrate a more preferable and proactive strategy for handling known high energy/torque cyclic events.

FIG. 44 presents a pair of curves showing the torque of drive motor 203 (and by analogy, motor power and current consumption) for each rate control regime. The slider-crank arrangement of the weapon 200 is offset. Referring back to FIG. 40, it can be seen that the plane of horizontal, linear motion for the pinion 7 is not in-line with the axis of rotation of the crank member 205. This arrangement provides for asymmetry in the kinematic and dynamic profiles of the displacement of the bolt carrier 211. Localized areas of high and low acceleration translate into peaks and lulls in current demand. By utilizing a profiled control regime, the motor can be over-driven during areas of low resistance and let off when kinematic demand is higher. As seen, the constant rate suffers from just such high torque peaks. By contrast, power demand when using the servo motor 203 to its full potential eliminates these areas and provides for a smoother, more consistent current draw. The smoother current draw also smooths out shocks and impacts on the physical hardware as well, thereby reducing stress and wear.

An additional advantage to the servo driven and sensor controlled weapon is in precision of firing. Conventional machineguns and marksman rifles serve two very different roles on the battlefield. The machinegun saturates a target area with bursts of automatic fire in order to impede enemy movement and affect mass casualties. To this end, a high rate of fire is typical and, along with more loosely fitting components, allows the weapon to generally develop a relatively wide dispersion pattern of outgoing projectiles. This lack of precise fire from shot to shot is not necessarily undesirable in this type of system. Conversely, a marksman or sniper rifle is highly tuned and components are very tight fitting. Typically available in semi-automatic or manual cartridge cycling, a sniper rifle is fired at a low cadence from a well-supported and stable platform to enable highly accurate and repeatable targeting. This approach facilitates successful, accurately placed engagements over much longer distances.

A servo motor controlled weapon can fill both of these roles. Continuously adjustable rate of fire allows for both suppressive and precision firing. The ability to speed up or slow down the weapon operating group through the use of a profiled cycle means that a cartridge can still be quickly chambered and all but fired before all moving parts are dramatically slowed down, relatively speaking, allowing the system to stabilize for maximum precision. This approach to precision fire also allows exploitation of said advantages to minimize shot to shot dispersion while also minimizing the time delay between commanded fire and break of the shot, as the overall cycle time must still occur sufficiently fast as to not result in a noticeable lag from the operator's perspective. Laboratory testing has confirmed that this mode of fire enables the disclosed weapons 1, 200 to approach the performance metrics of currently fielded small caliber sniper rifles when operated in the precision firing mode. One of the keys in implementing multi-role (operationally speaking) weapon systems is to ensure that all firing cycles begin from the full recoil, open bolt position. Beginning from the full recoil, open bolt position greatly limits cartridge cook off malfunctions, especially in the case where the mode of weapon operation changes during the course of a mission from suppressive fire to long range precision fire, for example. Careful attention to such details and the deliberate implementation of these types of customized kinematic controls does offer a real possibility of a single weapon serving more than one battlefield role.

While the invention has been described with reference to certain embodiments, numerous changes, alterations and modifications to the described embodiments are possible without departing from the spirit and scope of the invention as defined in the appended claims, and equivalents thereof. For example, a self-powered weapon, such as a gas or recoil operated weapon, may incorporate the disclosed structure to delink and manipulate cartridges using opposing bolt carrier and extractor body movements, and may accommodate both open-end and close-end linked ammunition.

What is claimed is:

1. An ammunition magazine for use with a reciprocally-cycled weapon for delinking and firing cartridges in close-end linked ammunition belts, comprising:

a housing with an ammunition indexing mechanism fixed to one side of the housing, the housing configured to store the close-end linked ammunition belts and the ammunition indexing mechanism configured to feed the close-end linked ammunition belts; and a magazine feed box disposed above the ammunition indexing mechanism, the magazine feed box including a movable follower having an upper and a lower position and cam pins that engage cam slots in the magazine feed box, the movable follower being configured to receive a cartridge from the weapon, and wherein the ammunition indexing mechanism is a rotating sprocket that rotates about an axis and engages the close-end linked ammunition belts, and wherein the rotating sprocket is driven by the weapon, and wherein the movable follower is biased to the lower position by a spring-loaded follower return.

2. The magazine of claim 1, wherein the follower includes a spring-loaded sub-follower that imparts to a cartridge therein motion that is transverse to the axis of the sprocket.

3. The magazine of claim 2, wherein the magazine feed box includes a follower release sear that holds the follower in the upper position.

4. The magazine of claim 2, wherein the movable follower has two degrees of freedom with respect to the magazine feed box.

5. The magazine of claim 4, wherein the follower release sear holds the follower in the upper position by engaging a follower sear surface.

6. The magazine of claim 5, wherein the magazine feed box includes a sear window.

7. An ammunition magazine for use with a reciprocally-cycled weapon for delinking and firing cartridges in close-end linked ammunition belts, comprising:

a housing with a rotating sprocket fixed to the housing, the housing configured to store the close-end linked ammunition belts and the sprocket configured to feed the close-end linked ammunition belts; and a magazine feed box disposed above the sprocket, the magazine feed box including a movable follower having an upper and a lower position and cam pins that engage cam slots in the magazine feed box, the movable follower being configured to receive a cartridge from the weapon and having two degrees of freedom with respect to the magazine feed box, and, wherein the rotating sprocket is rotated about an axis by the weapon, and, wherein the movable follower is biased to the lower position by a spring-loaded follower return.

8. The magazine of claim 7, wherein the follower includes a spring-loaded sub-follower that imparts to a cartridge therein motion that is transverse to the axis of the sprocket.

9. The magazine of claim 8, wherein the magazine feed box includes a follower release sear that holds the follower in the upper position.

10. The magazine of claim 9, wherein the follower release sear holds the follower in the upper position by engaging a follower sear surface.

11. The magazine of claim 10, wherein the magazine feed box includes a sear window.

* * * * *